US009297540B2

(12) United States Patent
Sinur et al.

(10) Patent No.: US 9,297,540 B2
(45) Date of Patent: Mar. 29, 2016

(54) DOWNDRAFT SYSTEM

(71) Applicant: Broan-NuTone LLC, Hartford, WI (US)

(72) Inventors: Richard R. Sinur, West Bend, WI (US); Brian R. Wellnitz, Grafton, WI (US); Jay F. Perkins, Hartford, WI (US); Sean Montag, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 178 days.

(21) Appl. No.: 13/959,374

(22) Filed: Aug. 5, 2013

(65) Prior Publication Data

US 2014/0034040 A1 Feb. 6, 2014

Related U.S. Application Data

(63) Continuation-in-part of application No. 13/887,028, filed on May 3, 2013.

(60) Provisional application No. 61/642,060, filed on May 3, 2012.

(51) Int. Cl.
*F24C 15/20* (2006.01)

(52) U.S. Cl.
CPC ..... *F24C 15/2042* (2013.01); *F24C 15/2021* (2013.01); *F24C 15/2085* (2013.01); *F24C 15/2092* (2013.01)

(58) Field of Classification Search
CPC ..... F24C 15/2029; F24C 15/2042; F24C 15/2085
See application file for complete search history.

(56) References Cited

U.S. PATENT DOCUMENTS 2,868,108 A * 1/1959 Petersen ..... 126/299 D
3,043,290 A 7/1962 Gibbons
3,409,005 A * 11/1968 Field ..... 126/300
(Continued)

FOREIGN PATENT DOCUMENTS

CN 2331883 Y 8/1999
WO 2011080097 A2 7/2011
WO WO-2013/166445 A1 11/2013

OTHER PUBLICATIONS

KIPO Search Report and Written Opinion dated Sep. 27, 2013 for corresponding Application No. PCT/US2013/039554.
(Continued)

*Primary Examiner* — Steven B McAllister
*Assistant Examiner* — Jonathan Cotov
(74) *Attorney, Agent, or Firm* — Schwegman Lundberg & Woessner, P.A.

(57) ABSTRACT

Some embodiments of the invention provide a downdraft assembly capable of ventilating a cooktop including housing with a frame, a fluid box, and a movement assembly with a belt-lift. In some embodiments, the movement assembly can include a vertically moveable chimney. Some embodiments include a chimney with an upper and lower horizontal member and dual fluid inlets. In some embodiments, a first control panel can be coupled to the housing to activate at least one function of the downdraft assembly while remaining substantially stationary as the chimney moves. Some embodiments include a second control panel coupled chimney. Some embodiments include a visor and at least one illumination source configured and arranged to at least partially illuminate the cooktop. In some embodiments, the visor can articulate to control illumination or the flow of a cooking effluent into at least one of the dual inlets.

21 Claims, 54 Drawing Sheets

(56) References Cited

U.S. PATENT DOCUMENTS

| | | | | |
|---|---|---|---|---|
| 4,501,260 | A * | 2/1985 | Grace | 126/299 R |
| 4,945,891 | A * | 8/1990 | Cecil | 126/299 D |
| 5,062,410 | A * | 11/1991 | Sarnosky et al. | 126/299 D |
| 5,690,093 | A | 11/1997 | Schrank et al. | |
| 5,810,658 | A * | 9/1998 | Seo | F24F 13/06 454/233 |
| 6,276,358 | B1 * | 8/2001 | Brin et al. | 126/299 D |
| D452,556 | S * | 12/2001 | Kurokawa | D23/354 |
| 6,455,818 | B1 * | 9/2002 | Arntz et al. | 219/452.11 |
| 6,698,419 | B2 * | 3/2004 | Lee | B01D 47/021 126/299 D |
| 7,836,877 | B2 * | 11/2010 | Gagas et al. | 126/299 D |
| 8,020,549 | B2 * | 9/2011 | Huber et al. | 126/299 R |
| 8,312,873 | B2 * | 11/2012 | Gagas et al. | 126/299 D |
| 9,010,313 | B2 | 4/2015 | Mikulec | |
| 2006/0278215 | A1 * | 12/2006 | Gagas | F24C 15/2092 126/299 D |
| 2007/0261693 | A1 * | 11/2007 | Fortuna | 126/299 D |
| 2007/0295324 | A1 * | 12/2007 | Feisthammel et al. | 126/299 D |
| 2009/0241934 | A1 * | 10/2009 | Canavari | 126/299 D |
| 2010/0012110 | A1 * | 1/2010 | Feisthammel et al. | 126/299 D |
| 2010/0059040 | A1 * | 3/2010 | Shaffer et al. | 126/299 D |
| 2010/0065038 | A1 * | 3/2010 | Davies | 126/299 D |
| 2012/0152227 | A1 * | 6/2012 | Oagley et al. | 126/299 D |
| 2012/0204855 | A1 * | 8/2012 | Huber | 126/299 R |
| 2013/0125764 | A1 * | 5/2013 | Jeong et al. | 99/357 |
| 2014/0041649 | A1 | 2/2014 | Sinur et al. | |

OTHER PUBLICATIONS

"European Application Serial No. 13784786.9, Office Action mailed Dec. 10, 2014", 3 pgs.

"International Application Serial No. PCT/US2013/039554, International Preliminary Report on Patentability mailed Nov. 13, 2014", 8 pgs.

"U.S. Appl. No. 13/887,028, Non Final Office Action mailed Oct. 15, 2015", 12 pgs.

"European Application Serial No. 13784786.9, Response filed Jun. 17, 2015 to Office Action mailed Dec. 10, 2014", 8 pgs.

U.S. Appl. No. 13/887,028, Response filed Jan. 15, 2016 to Non Final Office Action mailed Oct. 15, 2015, 13 pgs.

Chinese Application Serial No. 201380032413.1, Office Action mailed Dec. 23, 2015, 17 pgs.

* cited by examiner

Competitor "D"

Competitor "C"

Current Production "BEST" Brand

Current Production "Broan-Elite" Brand

FIG. 39A

| | | Brand Model | Capture Rating Front | Capture Rating Rear | Capture Rating All | Time To Boil | Time to Boil (Minutes)–Rear Center Burner 6" Pot 0 | 5 | 10 | 15 | 20 | 25 | 30 | 35 | 40 | 45 | 50 | 55 | 60 | 65 | 70 | 75 | 80 | 85 | 90 |
|---|---|---|---|---|---|---|---|---|---|---|---|---|---|---|---|---|---|---|---|---|---|---|---|---|---|
| | 5/31/2013 | Base 5/31 | | | | 0:18:30 | 19 | 43 | 67 | 88 | 99 | 0 | 0 | 0 | 0 | 0 | 0 | 0 | 0 | 0 | 0 | 0 | 0 | 0 | 0 |
| | 6/3/2013 | Base 0/3 | | | | 0:18:10 | 17 | 40 | 65 | 80 | 99 | 0 | 0 | 0 | 0 | 0 | 0 | 0 | 0 | 0 | 0 | 0 | 0 | 0 | 0 |
| | 6/4/2013 | Base 6/4 | | | | 0:18:20 | 16 | 40 | 67 | 89 | 99 | 0 | 0 | 0 | 0 | 0 | 0 | 0 | 0 | 0 | 0 | 0 | 0 | 0 | 0 |
| | 6/5/2013 | Base 6/5 | | | | 0:18:40 | 18 | 40 | 66 | 88 | 100 | 0 | 0 | 0 | 0 | 0 | 0 | 0 | 0 | 0 | 0 | 0 | 0 | 0 | 0 |
| | 6/21/2013 | Base 6/21 | | | | 0:18:50 | 19 | 42 | 66 | 87 | 99 | 0 | 0 | 0 | 0 | 0 | 0 | 0 | 0 | 0 | 0 | 0 | 0 | 0 | 0 |
| | 6/26/2013 | Base 6/26 | | | | 0:1950 | | | | | | | | | | | | | | | | | | | |
| | 6/27/2013 | Base 6/27 | | | | 0:18:1 | | | | | | | | | | | | | | | | | | | |
| Broan | 6/3/2013 | Broan/27 3603 | 1 | 4 | 1 | | 16 | 34 | 54 | 72 | 85 | 96 | 99 | 0 | 0 | 0 | 0 | 0 | 0 | 0 | 0 | 0 | 0 | 0 | 0 |
| | 6/3/2013 | Figidaire/FMODSAMS/35" (5599) | | | | | | | | | | | | | | | | | | | | | | | |
| | 6/3/2013 | GE/PVB(Bdt/36" (S809)-Blk | 2 | 5 | 2 | | 17 | 34 | 53 | 71 | 85 | 96 | 98 | 0 | 0 | 0 | 0 | 0 | 0 | 0 | 0 | 0 | 0 | 0 | 0 |
| | 6/5/2013 | NextGen 12" 2T 1B 3H | 3 | 0 | 2 | | 17 | 33 | 50 | 66 | 79 | 89 | 95 | 99 | 99 | 0 | 0 | 0 | 0 | 0 | 0 | 0 | 0 | 0 | 0 |
| | 6/4/2013 | NextGen 12" 2T 1B 4H | 4 | 0 | 3 | | 18 | 34 | 53 | 69 | 84 | 94 | 98 | 0 | 0 | 0 | 0 | 0 | 0 | 0 | 0 | 0 | 0 | 0 | 0 |
| | 6/4/2013 | NextGen 12" 3T 2B 6H | NR | NR | NR | | 19 | 33 | 50 | 62 | 74 | 83 | 90 | 93 | 96 | 96 | 97 | 97 | 97 | 97 | 97 | 97 | 96 | 97 | 96 |
| | 6/4/2013 | NextGen 12" 2T 2B 4H | 4 | 0 | 4 | | 17 | 32 | 48 | 63 | 75 | 85 | 93 | 99 | 99 | 0 | 0 | 0 | 0 | 0 | 0 | 0 | 0 | 0 | 0 |
| | 6/4/2013 | NextGen 12" 3T 2B 3H | 5 | 0 | 5 | | 17 | 32 | 48 | 57 | 68 | 78 | 84 | 90 | 93 | 95 | 96 | 96 | 97 | 97 | 96 | 96 | 97 | 98 | 96 |
| Broan-Elite | 6/3/2013 | Faber/SCIR3608SSIB/36" ($919) | 2 | 5 | 2 | | 17 | 36 | 57 | 75 | 91 | 98 | 0 | 0 | 0 | 0 | 0 | 0 | 0 | 0 | 0 | 0 | 0 | 0 | 0 |
| | 6/3/2013 | Kiehinald/KXD4636YSS/36" ($1034) | 2 | 4 | 2 | | 17 | 40 | 65 | 87 | 99 | 0 | 0 | 0 | 0 | 0 | 0 | 0 | 0 | 0 | 0 | 0 | 0 | 0 | 0 |
| | 5/31/2013 | Bosch/DHD3614JHC/36" ($1050) | 2 | 5 | 2 | | 18 | 39 | 62 | 81 | 96 | 99 | 0 | 0 | 0 | 0 | 0 | 0 | 0 | 0 | 0 | 0 | 0 | 0 | 0 |
| | 6/4/2013 | NextGen 15" 1T 2B 4H | 3 | 0 | 4 | | 18 | 36 | 54 | 72 | 85 | 94 | 98 | 99 | 0 | 0 | 0 | 0 | 0 | 0 | 0 | 0 | 0 | 0 | 0 |
| | 6/5/2013 | NextGen 15" 2T 1B 3H | 4 | 0 | 3 | | 17 | 34 | 51 | 65 | 78 | 89 | 95 | 97 | 98 | 98 | 98 | 98 | 98 | 98 | 98 | 0 | 0 | 0 | 0 |
| | 6/5/2013 | NextGen 15" 2T 2B 3H | 5 | 0 | 4 | | 16 | 30 | 46 | 60 | 73 | 83 | 90 | 95 | 96 | 98 | 98 | 97 | 98 | 98 | 97 | 0 | 0 | 0 | 0 |
| | 6/4/2013 | NextGen 15" 3T 2B 6H | 4 | 0 | 5 | | 18 | 36 | 55 | 73 | 86 | 96 | 99 | 0 | 0 | 0 | 0 | 0 | 0 | 0 | 0 | 0 | 0 | 0 | 0 |
| | 6/21/2013 | NextGen 15" 2T 2B 5H | 5 | | | | 20 | 38 | 56 | 7 | 86 | 95 | 98 | 99 | 0 | 0 | 0 | 0 | 0 | 0 | 0 | 0 | 0 | 0 | 0 |
| | 6/21/2013 | NextGen 15" 3T 2B 5H | 5 | | | | 20 | 39 | 50 | 76 | 90 | 98 | 99 | 0 | 0 | 0 | 0 | 0 | 0 | 0 | 0 | 0 | 0 | 0 | 0 |
| | 6/27/2013 | NextGen 15" 2T 1B 6H | 4 | | | | 20 | 43 | 66 | 85 | 96 | 99 | 0 | 0 | 0 | 0 | 0 | 0 | 0 | 0 | 0 | 0 | 0 | 0 | 0 |
| | 6/27/2013 | NextGen 15" 3T 1B 5H | 4 | | | | 20 | 41 | 63 | 82 | 94 | 99 | 0 | 0 | 0 | 0 | 0 | 0 | 0 | 0 | 0 | 0 | 0 | 0 | 0 |

To FIG. 39B

FROM FIG 39A

| | | | | | | | | | | | | | | | | | | | | | | | | | | |
|---|---|---|---|---|---|---|---|---|---|---|---|---|---|---|---|---|---|---|---|---|---|---|---|---|---|---|
| Best | 6 /3 /2013 | Best | 3 | 5 | 4 | | 17 | 35 | 54 | 71 | 84 | 55 | 98 | 0 | 0 | 0 | 0 | 0 | 0 | 0 | 0 | 0 | 0 | 0 | 0 |
| | 6 /3 /2013 | Viking | 2 | 5 | 3 | | 17 | 38 | 58 | 77 | 91 | 99 | 0 | 0 | 0 | 0 | 0 | 0 | 0 | 0 | 0 | 0 | 0 | 0 | 0 |
| | 6 /17 /2013 | Electrolure / E136DDIOKS / 36" ($1350) | NR | NR | NR | | 19 | 36 | 55 | 71 | 85 | 96 | 99 | 0 | 0 | 0 | 0 | 0 | 0 | 0 | 0 | 0 | 0 | 0 | 0 |
| | 6 /6 /2013 | Decore / PRV36 / 36" ($1620) | NR | NR | NR | | 17 | 35 | 56 | 73 | 88 | 98 | 99 | 0 | 0 | 0 | 0 | 0 | 0 | 0 | 0 | 0 | 0 | 0 | 0 |
| | 6 /3 /2013 | Decor / ERV3615 / 36" ($1730) | 3 | 5 | 3 | | 17 | 41 | 65 | 86 | 99 | 0 | 0 | 0 | 0 | 0 | 0 | 0 | 0 | 0 | 0 | 0 | 0 | 0 | 0 |
| | | Frigidaire / FMODSOMS / 36" ($1830) | | | | | | | | | | | | | | | | | | | | | | | | |
| | | Micle / DA6499500 / 36" ($1949) | | | | | | | | | | | | | | | | | | | | | | | | |
| | 6 /5 /2013 | NextGen 18" 3T 1B 5H | 4 | 0 | 4 | | 17 | 36 | 57 | 74 | 87 | 97 | 99 | 0 | 0 | 0 | 0 | 0 | 0 | 0 | 0 | 0 | 0 | 0 | 0 |
| | 6 /5 /2013 | NextGen 18" 1T 2B 3H | 5 | 0 | 5 | | 17 | 30 | 45 | 58 | 70 | 79 | 87 | 92 | 95 | 95 | 96 | 97 | 96 | 96 | 97 | 96 | 0 | 0 | 0 |
| | 6 /5 /2013 | NextGen 18" 3T 2B 9H | 5 | | 5 | 0:20:10 | 17 | 40 | 65 | 85 | 98 | 99 | 0 | 0 | 0 | 0 | 0 | 0 | 0 | 0 | 0 | 0 | 0 | 0 | 0 |
| | 6 /21 /2013 | NextGen 18" 2T 1B 5H | 5 | | | | 20 | 37 | 52 | 68 | 80 | 90 | 97 | 99 | 0 | 0 | 0 | 0 | 0 | 0 | 0 | 0 | 0 | 0 | 0 |
| | 6 /21 /2013 | NextGen 18" 3T 1B 5H | 5 | | | | 20 | 36 | 53 | 67 | 80 | 91 | 96 | 99 | 0 | 0 | 0 | 0 | 0 | 0 | 0 | 0 | 0 | 0 | 0 |
| | 6 /23 /2013 | NextGen 18" 1T 1B 6H | 5 | | | 0:24:40 | 19 | 40 | 51 | 78 | 91 | 99 | 0 | 0 | 0 | 0 | 0 | 0 | 0 | 0 | 0 | 0 | 0 | 0 | 0 |
| | 6 /24 /2013 | NextGen 18" 6T | 3 | | | | 20 | 43 | 68 | 89 | 99 | 0 | 0 | 0 | 0 | 0 | 0 | 0 | 0 | 0 | 0 | 0 | 0 | 0 | 0 |
| | 6 /24 /2013 | NextGen 18" 3T 0.5B 6H | 2 | | | | 21 | 44 | 68 | 86 | 100 | 0 | 0 | 0 | 0 | 0 | 0 | 0 | 0 | 0 | 0 | 0 | 0 | 0 | 0 |
| | 6 /24 /2013 | NextGen 18" 6T 0.5B 6H | 4 | | | | 20 | 44 | 68 | 88 | 99 | 0 | 0 | 0 | 0 | 0 | 0 | 0 | 0 | 0 | 0 | 0 | 0 | 0 | 0 |
| | 6 /24 /2013 | NextGen 18" 1T 2B 6H 3" RS blocked | 5 | | 5 | 0:24:50 | 20 | 40 | 61 | 78 | 91 | 99 | 0 | 0 | 0 | 0 | 0 | 0 | 0 | 0 | 0 | 0 | 0 | 0 | 0 |
| | 6 /24 /2013 | NextGen 18" 4T 2B 8H | 4 | | 3 | 0:19:20 | 20 | 43 | 68 | 88 | 99 | 0 | 0 | 0 | 0 | 0 | 0 | 0 | 0 | 0 | 0 | 0 | 0 | 0 | 0 |
| | 6 /26 /2013 | NextGen 18" 4T 1.5B 8H | 4 | | 4 | | 20 | 43 | 68 | 86 | 99 | 0 | 0 | 0 | 0 | 0 | 0 | 0 | 0 | 0 | 0 | 0 | 0 | 0 | 0 |
| | 6 /26 /2013 | NextGen 18" 4T 1B 8H | 4 | | 4 | 0:20:50 | 21 | 44 | 67 | 86 | 98 | 99 | 0 | 0 | 0 | 0 | 0 | 0 | 0 | 0 | 0 | 0 | 0 | 0 | 0 |
| | 6 /27 /2013 | NextGen 18" 3T 2.2B 6H | 4 | | 5 | | 21 | 43 | 67 | 86 | 99 | 0 | 0 | 0 | 0 | 0 | 0 | 0 | 0 | 0 | 0 | 0 | 0 | 0 | 0 |
| | 6 /27 /2013 | NextGen 18" 3T 4B 8H | 4 | | 4 | 0:21:30 | 19 | 42 | 66 | 84 | 97 | 99 | 0 | 0 | 0 | 0 | 0 | 0 | 0 | 0 | 0 | 0 | 0 | 0 | 0 |

FIG. 39B

DOWNDRAFT SYSTEM

CROSS-REFERENCE TO RELATED APPLICATIONS

This application is a continuation in-part of U.S. patent application Ser. No. 13/887,028, filed May 3, 2013; and claims the benefit of U.S. Provisional Application No. 61/642,060, filed May 3, 2012. The contents of the above-noted applications are each expressly incorporated herein by reference.

BACKGROUND

The desire for ventilation solutions that do not significantly interfere with kitchen sight-lines drives consumer purchasing of many conventional downdraft ventilation systems. Many consumers for example desire a smaller kitchen footprint with products that do not obstruct, block, or close-off spaces within the smaller kitchen. At least some of these conventional downdraft systems can be disposed in a kitchen island or peninsula and can raise and lower from a position under a kitchen counter, which can result in significant portions of the hood being hidden when not in use

SUMMARY

Some embodiments of the invention provide a downdraft assembly capable of ventilating a cooktop including housing including a frame, a fluid box, and a movement assembly coupled to the housing. In some embodiments, the movement assembly can include a vertically moveable chimney coupled to the fluid box and the movement assembly.

In some embodiments, the chimney can include an upper horizontal member and lower horizontal member. In some embodiments the chimney includes dual fluid inlets comprising an upper inlet and lower inlet.

In some embodiments, a first control panel can be coupled to the housing and configured and arranged to activate at least one function of the downdraft assembly while remaining substantially stationary when the chimney is moved by the movement assembly.

Some embodiments include at least one illumination source configured and arranged to at least partially illuminate the cooktop. In some embodiments, a visor can be coupled to the downdraft assembly. In some embodiments, the visor can include at least one illumination source capable of at least partially illuminating the cooktop.

Some embodiments include a visor with an articulating top capable of articulation about a pivot point on the chimney. In some embodiments, an articulation of the articulating top of the visor about the pivot point can at least partially alter the illumination of the cooktop. In some other embodiments, an articulation of the articulating top of the visor about the pivot point can at least partially control the flow of a cooking effluent into at least one fluid inlet.

Some embodiments include a second control panel coupled to the chimney. In some embodiments, the second control panel is coupled to at least one of the substantially horizontal member and the first vertical region and the second vertical region. In some embodiments, the second control panel is vertically moveable with respect to the cooktop.

Some embodiments of the downdraft assembly include a movement assembly with a belt-lift configuration. In some embodiments, the belt-lift configuration can include at least one linear guide coupled to the frame, a motor including a gear box coupled to a drive shaft, and at least one drive pulley coupled to the drive shaft. Some embodiments provide a drive belt coupled to the drive pulley and at least one idler pulley. In some embodiments, the at least one drive pulley and the at least one idler pulley are coupled to a lateral side of the housing, and configured and arranged to at least partially move the chimney within the fluid box at least partially guided on the at least one linear guide.

In some embodiments, the downdraft assembly includes a pivotable bezel configured and arranged to pivot open to allow movement of the chimney out of the fluid box and to pivot shut when substantially all of the chimney is within the fluid box. Some embodiments of the downdraft assembly comprise at least one ambient light illumination source, which in some embodiments, is a night light coupled to the bezel.

In some embodiments, the downdraft assembly includes a fluid box with inner walls including at least one curved wall including a substantially non-linear transition. In some embodiments, the fluid box is configured and arranged to at least partially guide fluid into the fluid box from at least one of the fluid inlets. In some further embodiments, the at least one curved wall is configured and arranged to at least partially guide fluid into the fluid box from substantially the width of the chimney. In some embodiments, the either one of the fluid inlets includes a chimney intake opening of a size of about one to about two inches in vertical length.

Some embodiments include a downdraft system in which the vertical height of the lower inlet and the vertical height of the upper inlet are independently adjustable based at least in part on effluent emitted from the cooktop. In some other embodiments, the vertical height of the lower inlet and the vertical height of the upper inlet are independently adjustable based at least in part on effluent drawn into either of the lower inlet or the upper inlet.

DESCRIPTION OF THE DRAWINGS

FIGS. 39A-B provides a table including a 'time to boil' study for variations configurations of downdraft system 10 including dual inlets as shown in FIG. 37 in accordance with some embodiments of the invention.

DETAILED DESCRIPTION

Figure 1:
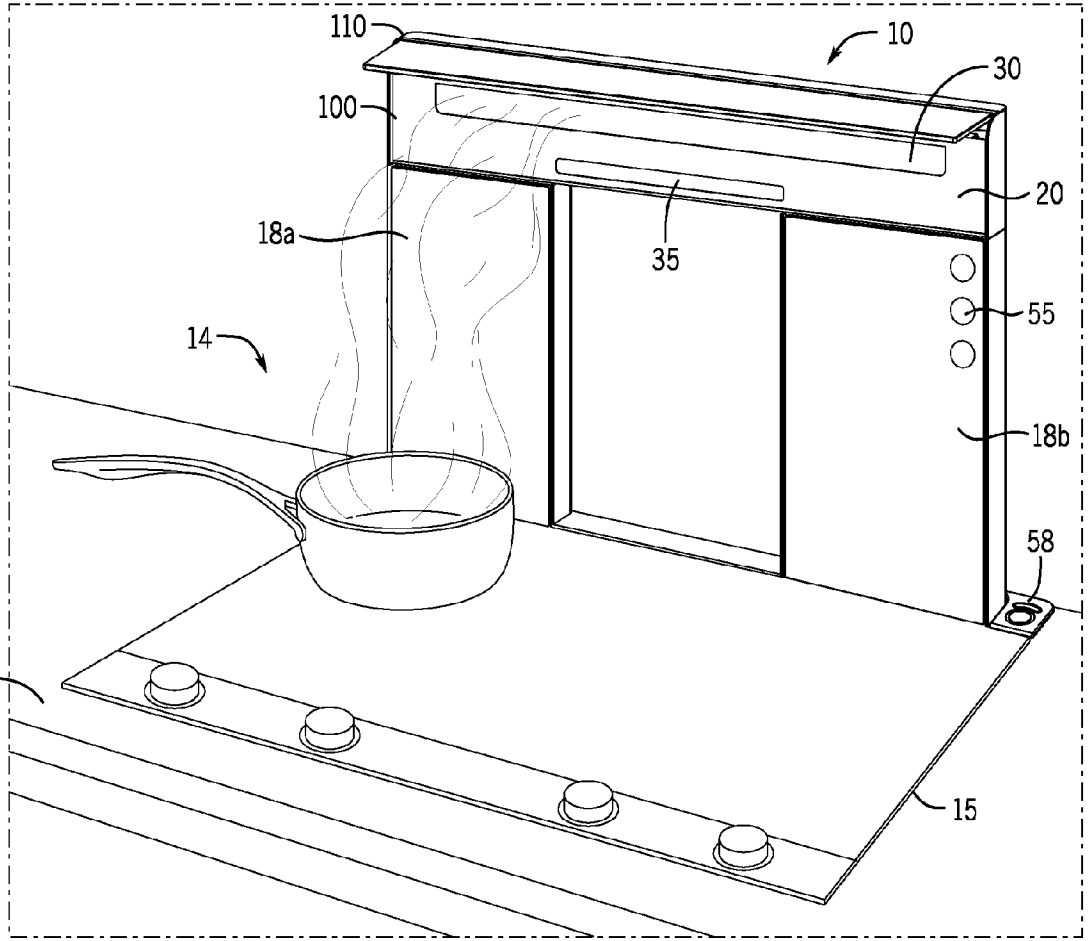
FIG. 1 is a perspective view of a portion of a downdraft system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

FIG. 1 illustrates a portion of downdraft system 10 according to one embodiment of the invention. The downdraft system 10 can include a vertically moveable chimney 100 comprising a substantially horizontal member 20 coupled to a first vertical region 18*a* and a second vertical region 18*b*. In some embodiments, the downdraft system 10 can also include a fluid box 150 (see for example FIG. 2A), a movement assembly (not shown in FIG. 1, but shown as 400 in FIG. 4), and one or more fluid outlets 30. As shown in FIG. 1, in some embodiments of the invention, the downdraft system 10 can be installed adjacent to a cooking area 14 (e.g., in a kitchen) and positioned adjacent to and/or coupled with a cooktop 15. For example, in some embodiments, the downdraft system 10 can be installed immediately adjacent to a cooktop 15, as shown in FIG. 1. Furthermore, in some embodiments, as discussed in greater detail below, at least some portions of the downdraft system 10 (e.g., the fluid box 150, the movement assembly 400, and/or the fluid outlets 30, etc.) can be installed substantially or completely under a counter surface 17, and coupled to the fluid box housing 152. In other embodiments, the downdraft system 10 can be installed and/or used in other portions of a home or other structure. For example, in some embodiments, the downdraft system 10 can be used in a workshop or any other area that could require ventilation (e.g., a laundry, a basement, a bathroom, etc.). Accordingly, although future description includes details of the downdraft system 10 installed in a kitchen area (e.g., adjacent to a cooktop 15), this description is not intended to limit the scope of this disclosure to kitchen or cooking-related applications.

Figure 3:
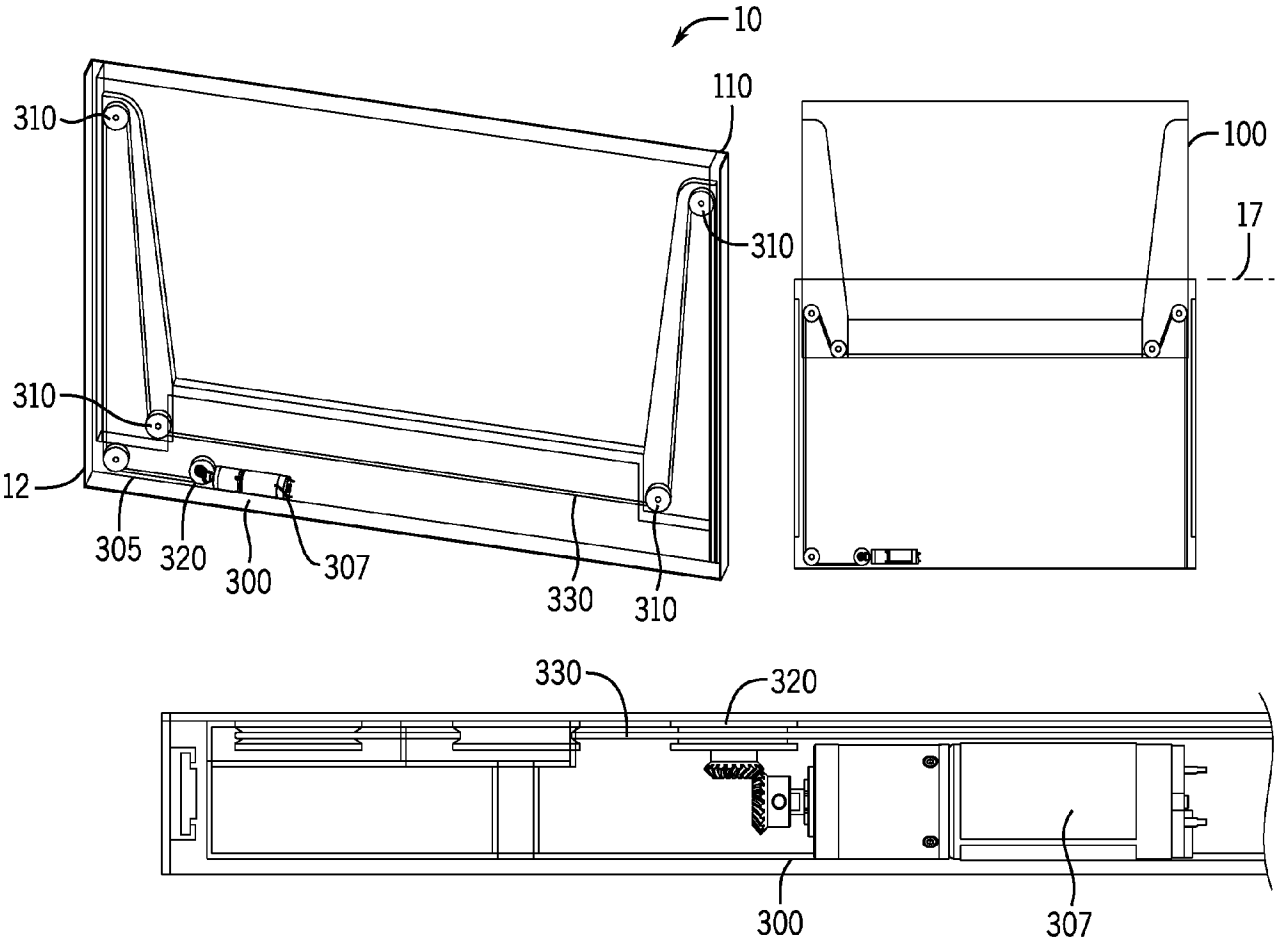
FIG. 3 is a series of diagrams depicting a movement assembly according to some embodiments of the invention.

In some embodiments, the downdraft system 10 can operate in a manner at least partially similar to a conventional downdraft system 11. In some embodiments, when the downdraft system 10 is in an inactive state, the chimney 100 can be in a substantially or completely lowered position. For example, as shown in FIG. 3, the chimney 100 can be lowered so that a top portion 110 of the chimney 100 is substantially flush with or lower than the counter surface 17 (shown in FIG. 1). As a result, when in an inactive state, most or substantially all the chimney 100 can be located under the counter surface 17 and not visible or less visible to a user (i.e., providing a pleasant aesthetic experience).

In some embodiments, in order to exhaust at least a portion of cooking effluent and other fluids produced during a cooking episode, the movement assembly (shown as 300 in FIGS. 3 and 400 in FIG. 4 for example) can be activated (e.g., manually or automatically) to move the chimney 100. For example, upon activation of the movement assembly 300, 400, the chimney can be raised above the counter surface 17 so that an inlet 30 of the chimney 100 can be in fluid communication with the local environment. In some embodiments, the fluid box 150 can comprise one or more conventional ventilation assemblies (for example, conventional fans or other devices configured to move fluids, such as air). Moreover, in some embodiments, the downdraft system 10 can comprise a fluid path leading from the inlet 30, through the fluid box 150 and the ventilation assembly, and out of the downdraft system 10 via conventional fluid outlets (not shown). In some further embodiments, the downdraft system 10 can include one ore more flexible ventilation assemblies (such as for example cube-like module 13 shown in FIG. 27, and described in more detail below).

In some embodiments, a ventilation assembly (including for example one or more modules 13) can be activated (e.g., manually or automatically) to generate a fluid flow to exhaust cooking effluent or other fluids. For example, in some embodiments, the ventilation assembly 13 can generate fluid flow from the inlet 30 (i.e., leading to fluid entering the fluid path) through portions of the downdraft system 10 (for example, the fluid box 150). At least a portion of the fluid can exit the downdraft system 10 via the one or more conventional fluid outlets. For example, the fluid outlets can be in fluid communication with a conventional ventilation network of the structure into which the downdraft system 10 is installed or can be directly coupled to an exhaust that can direct the exhausted effluent to a desired location (e.g., out of structure, out of the local environment, through a toe-kick of the counter, etc.). Moreover, in some embodiments, the downdraft system 10 can comprise one or more conventional filters disposed along the fluid path to remove at least some portions of the effluent that may be desirable not to exhaust through the fluid outlets.

In some further embodiments, the downdraft system 10 can include more than one inlet 30. For example, in some embodiments, the downdraft system 10 can include an upper inlet 29*a* and a lower inlet 29*b*. In some other embodiments, the inlet 30 can comprise more than one inlet. For example, in some embodiments, the inlet 30 can comprise an upper inlet 29*a* and a lower inlet 29*b*.

Figure 2A:
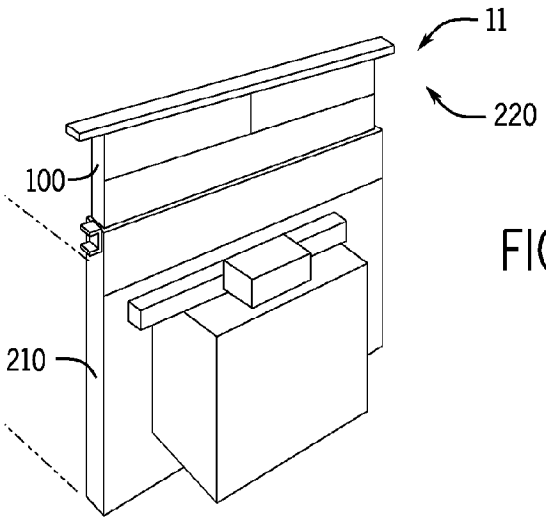
FIGS. 2A and 2B are diagrams depicting a conventional downdraft system.
Figure 2B:
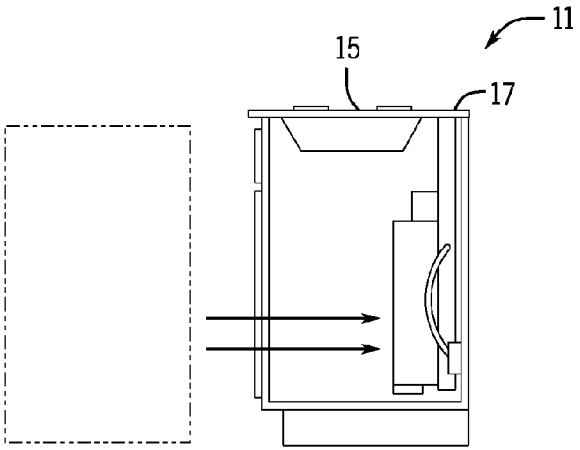

As shown in FIGS. 1 and 2, and as previously mentioned, some portions of both conventional downdraft systems 11 and downdraft systems 10 according to some embodiments of the invention can be installed under a counter surface 17 and adjacent to a cooktop 15 and/or a conventional range oven. As shown in FIGS. 2A and 2B however, configurations of some conventional downdraft systems 11 can create limitations on areas and/or spaces into which users can install conventional downdraft systems 11. For example, some conventional downdraft systems can comprise a chimney 220 including a relatively small depth (e.g., approximately two to three inches), as shown in FIG. 2A. However, other elements of the conventional downdraft system 11 that can be installed under the counter surface 17 can comprise a greater depth. For example, as shown in FIG. 2B, after installation of the conventional downdraft system 11, the conventional fluid box 210 and the conventional movement assembly 200 can comprise a greater depth than the chimney 220. As a result, the conventional downdraft system 11 can occupy a significant amount of space under the counter surface 17, which can prevent the installation of some or all conventionally-sized under-cabinet and/or slide-in range ovens. Moreover, as shown in FIG. 2B, a height value of some of the conventional downdraft system 11 components can also limit the installation of some conventional cooktops 15 because of the downward space requirements of the cooktops 15 and the upward height requirement of some of the conventional downdraft systems 11.

In some embodiments, the downdraft system 10 can comprise a lesser depth relative to at least some conventional downdraft systems 11. As shown in FIG. 3 (with some missing components for illustrative purposes), in some embodiments, the downdraft system 10 can comprise a substantially or completely uniform depth (e.g., about two inches). For example, in some embodiments, the downdraft system 10 can comprise a substantially uniform two-inch profile depth (e.g., the depth value of assembled elements of the downdraft system 10 comprises about two inches) so that the system 10 does not interfere with under-cabinet and/or slide-in range oven installation. Moreover, because conventional range ovens can be installed immediately adjacent to the downdraft system 10, the auditory output of the movement assembly 300, 400 can be at least partially insulated by the range oven (e.g., the conventionally sized range oven can function as a sound absorber), which does not occur with some conventional downdraft systems 11. For example, the movement assembly in many conventional downdraft systems 11 can be generally exposed so that during operations of the conventional downdraft assembly 11, the auditory output can be significant so that some users would find it objectionable. Accordingly, by insulating the movement assembly 300, 400 in the downdraft system 10, the user's experience with the downdraft system 10 can be more enjoyable because of the decreased auditory output.

As shown in FIGS. 3-8, in some embodiments, movement assemblies 300, 400, 500, 600, 700, 800 can be configured and arranged to move the chimney 100. In some embodiments, the movement assemblies 300, 400, 500, 600, 700, 800 can operate in a manner substantially similar to a conventional downdraft system 11. For example, in some embodiments, the movement assemblies 300, 400, 500, 600, 700, 800 can be activated (e.g., automatically or manually) to move the chimney 100. In some embodiments, at least one of the movement assemblies 300, 400, 500, 600, 700, 800 can be configured and arranged to raise and/or lower the chimney (e.g., function as a telescoping mechanism). For example, as shown in FIG. 3, when activated, during operation of the downdraft system 10, the movement assembly 300 can raise the chimney 100 so that the chimney 100 can exhaust at least a portion of cooking effluent created by a cooking episode. In some embodiments, at or near an end of the cooking episode, the movement assembly 300 can be activated to lower the chimney 100 so that a top of the chimney 110 is at or below the surface of the counter surface 17 (e.g., substantially flush with, or below the counter surface level). In other embodiments, the movement assembly 300, 400 can be configured and arranged to move the chimney in other directions (e.g., side-to-side, diagonally, etc.). Moreover, as described in further detail below, the movement assembly 400 can comprise a plurality of different configurations.

In some embodiments, the movement assembly 300 can comprise a pulley-lift configuration 305. As shown in FIG. 3, in some embodiments, the movement assembly 300 can comprise a motor 307 (e.g., a direct current brushed gear motor), a plurality of pulleys 310, and at least one spool pulley 320 coupled to the motor 307. Moreover, in some embodiments, the movement assembly 300 can comprise one or more cables 330, as shown in FIG. 3. Additionally, in some embodiments, the downdraft system 10 can comprise one or more guides (for example, linear guides 460 as shown in FIG. 4) that can be configured and arranged to assist in positioning (guiding) of the chimney 100 during movement assembly 400 activity.

In some embodiments, the pulley-lift configuration 305 of the movement assembly 300 can enable the chimney 100 to move during operations of the downdraft system 10. For example, as shown in FIG. 3, the motor 307 can be disposed in a generally lower portion of the downdraft system 10 (e.g., under the counter surface level adjacent to the one or more conventional fluid outlets) and can be immediately adjacent and/or coupled to the spool pulley 320. Although depicted as generally central with respect to the flow path, the motor 307 can be positioned elsewhere within the downdraft system 10 to reduce any impact of fluid flow through the fluid path. In some embodiments, one or more pulleys 310, 320 can be coupled to a support structure of the downdraft system 10 (e.g., a downdraft system frame 303) and other pulleys can be coupled to a lower portion of the chimney 100. The spool pulley 320 can be coupled to the support structure 303 adjacent to the motor 307. In some embodiments, a first end of the cable 330 can be coupled to the spool pulley 320 and a second end of the cable 330 can be coupled to a portion of the support structure at an opposite side of the downdraft system 10, as shown in FIG. 3. In some embodiments, the cable can be moveably positioned through the plurality of pulleys 310 and anchored by the spool pulley 320 and the support structure 303.

Moreover, in some embodiments, if the motor 307 is oriented in a substantially horizontal orientation, as shown in FIG. 3, gears 325 (e.g., bevel gears) can be coupled the motor 307 and/or the spool gear 327. As a result, activation of the motor 307 can translate to movement of the spool gear 327 because of the gear-gear (325 and 327) interaction, as shown in FIG. 3. In some embodiments, as the motor 307 moves the spool pulley 320, the spool pulley 320 can rotate. Because the first end of the cable 330 is coupled to the spool pulley 320, as the pulley rotates, the cable 330 can begin to wind on the spool pulley 320. For example, as shown in FIG. 3, because of the cable's positioning through the plurality of pulleys 310 and being positioned along a lower portion of the chimney 100, as the spool pulley 320 winds greater amounts of cable 330 (i.e., because of the motor 307 moving the spool pulley 320), the cable 330 can comprise greater amounts of tension and a shorter length. As a result, as the cable 330 comprises a shorter length, the chimney 100 can be driven upward, as shown in FIG. 3. In some embodiments, once the chimney 100 is fully extended from the counter surface 17, the motor 307 can be locked or otherwise fixed in position to retain the chimney 100 in a raised position. When the user no longer needs the downdraft system 10, the motor 307 can move the pulley 320 in a reverse direction, can become deactivated so that the weight of the chimney 100 causes the cable 330 to unwind from the spool pulley 320, and/or the motor 307 can output a lesser amount of torque so that the cable 330 slowly unwinds to lower the chimney 100. Moreover, in some embodiments, guides (for example guides 460 in FIG. 4) can aid in preventing racking or other damage to the chimney 100 as it is raised and lowered (i.e., the guides 460 can function to direct the chimney 100 as it moves).

Figure 4:
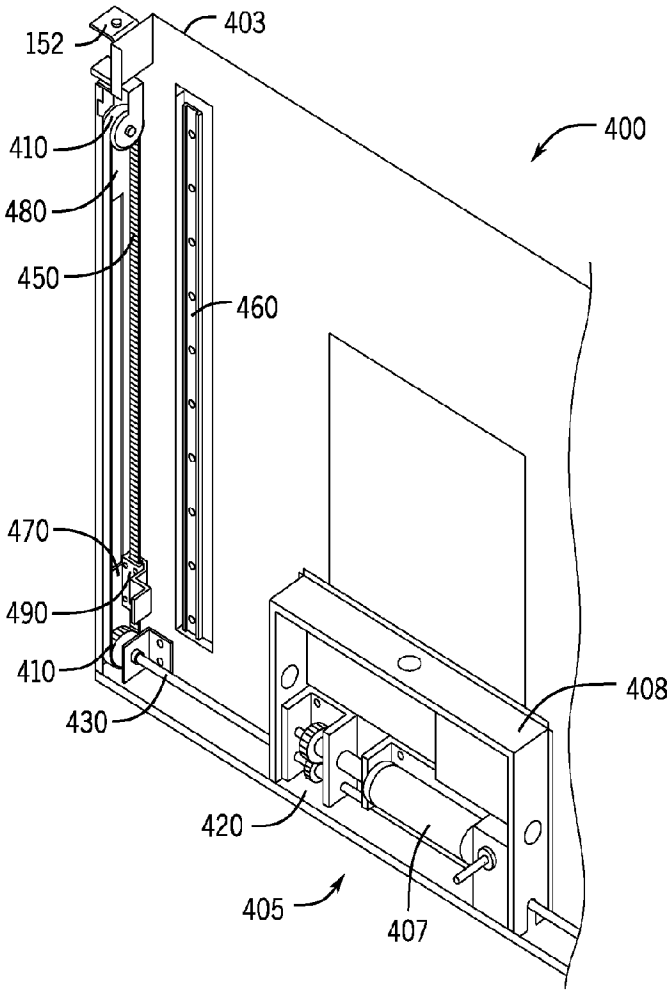
FIG. 4 is a series of diagrams depicting a movement assembly according to some embodiments of the invention.

In some embodiments, the movement assembly 400 can comprise a belt-lift configuration 405 installed within a fluid box housing 152, as shown in FIG. 4. For example, in some embodiments, the movement assembly 400 can comprise a motor 407 (e.g., a direct current brushed gear motor), a plurality of pulleys 410, one or more guides (e.g., linear guides 460), and a drive shaft 430 coupled to the motor 407 and/or one or more of the pulleys 410. In some embodiments, as shown in FIG. 4, one or more belts 450 can be coupled to and/or supported by the pulleys 410. In some embodiments, one or more belt clamps 490 can be coupled to the chimney 100 and the belts 450. In some embodiments, the chimney 100 can be at least partially moved within the fluid box 150. In some embodiments, a conventional control system can control the motor 407 to rotate the drive shaft 430 to drive the belts 450 causing at least partial movement of the chimney 100 via the coupling of the one or more belt clamps 490. In some embodiments, the movement of the chimney 100 is guided substantially by the one or more guides 460.

Further, as shown in FIG. 4, in some embodiments, one or more of the pulleys 410 can be positioned at or adjacent to corners of the support structure 403 under the counter surface 17. By way of example only, pulleys 410 can be positioned immediately adjacent to the two bottom corners of the downdraft system 400 and two pulleys 410 can be positioned substantially adjacent to upper corners of the downdraft system 400 (FIG. 4 shows a partial view of the downdraft system 400 showing upper and lower corners on one side, including a first lateral side 404, and it can be appreciated by one of ordinary skill in the art that the upper and lower corners on the other lateral side can each house a pulley 410 substantially identical to the pulleys 410 shown on the first lateral side 404). In some embodiments, the belts 450 can be coupled to pulleys 410 on the same side of the downdraft system 400. By way of example, in some embodiments, a first belt 450 can be coupled to and disposed between the pulleys 410 on a first lateral side 404 of the downdraft system 400, and a second substantially identical belt 450 (not shown in the partial perspective view of FIG. 4) can be coupled to and disposed between substantially identical pulleys 410 on a second lateral side of the downdraft system 400 (i.e. the opposite side to the first lateral side 404). Moreover, in some embodiments, by placing the pulleys 410 at the lateral edges of the downdraft system 400, the pulleys 410 can be positioned outside of the fluid path so that the fluid flow is not disturbed by the presence of the pulleys 410.

In some embodiments, movement of the motor 407 can be used to at least partially move (e.g., raise and/or lower) the chimney 100. As shown in FIG. 4, the motor 407 can be coupled to the downdraft system 400 in a position substantially adjacent to the drive shaft 430. For example, in some embodiments, the motor 407 and the drive shaft 430 can each comprise a gear (e.g., a spur gear, as shown in FIG. 4) so that motor 407 output (e.g., torque) is transferred from the motor 407 to the gear on the drive shaft. In some embodiments, in lieu of gear, the motor 407 and drive shaft 430 can be coupled together via a belt drive 450 to reduce auditory output. The drive shaft 430 can transfer the motor 407 output to the pulleys 410 to which the drive shaft 430 is coupled. For example, in some embodiments, the movement of the drive shaft 430 can cause movement of the pulleys 410, leading to movement of the belts 450 and the belt clamps supporting the chimney 100.

As shown in FIG. 4, the belt clamps 490 can be positioned so that lower portions of the chimney 100 (e.g., lower corners of the chimney) are received within and supported by the belt clamps 490. In some embodiments, the chimney 100 can be attached to the belt clamps 490, and in other embodiments, the chimney 100 can rest on or float on the belt clamps 490. For example, by floating or resting on the belt clamps 490, the chimney 100 can avoid being pulled downward directly when it is being lowered (i.e., the belt clamps 490 are pulled and the chimney 100 moves with the belt clamps 490). Accordingly, in some embodiments, motor 407 movement can be translated to the pulleys 410 via the drive shaft 430. Moreover, in some embodiments, pulley 410 movement can cause the belt clamps 490 to move (e.g., raise or lower), which can cause raising and lowering of the chimney 100. Additionally, the guides 460 can be coupled to the lateral walls (first lateral wall 404 and the opposite lateral wall) of the downdraft system 10 and the chimney 100 so that they can aid in preventing racking or other damage to the chimney 100 as it is raised and lowered (i.e., the guides 460 can function to direct the chimney 100 as it moves). When the user no longer needs the downdraft system 10, the motor 407 can move the drive shaft 430 in a reverse direction, can become deactivated so that the weight of the chimney 100 causes the belt clamps 490 and belts 450 to move downward, and/or the motor 407 can output a lesser amount of torque so that the belts 450 slowly move to lower the chimney 100.

As mentioned earlier, because conventional range ovens can be installed immediately adjacent to the downdraft system 10, the auditory output of the movement assembly 400 can be at least partially insulated by the range oven (e.g., the conventionally sized range oven can function as a sound absorber). Accordingly, by insulating the movement assembly 400 in the downdraft system 10, the user's experience with the downdraft system 10 can be more enjoyable because of the decreased auditory output. For example, in some embodiments, the downdraft system 10 can comprise a movement assembly 400 that includes a shroud 408 at least partially enclosing one or more moving components of the movement assembly 400. For example, as shown in FIG. 4, the movement assembly 400 can includes a shroud 408 at least partially enclosing at least the motor 407 and the gearbox 420 (i.e. components that may cause a substantial portion of the noise emitted by the movement assembly 400). In some embodiments the shroud 408 can reduce the sound emanating from the motor 407. In some other embodiments, further conventional sound insulation can be added to the shroud 408 to further reduce the sound emanating from the motor 407. For example, in some embodiments, a conventional sound insulation material can be added to the inside of the shroud 408, the outside of the shroud 408, or both. In some other embodiments, a conventional sound insulation material can be added to the inside of the frame support 403 of the fluid box housing 152. For example, in some embodiments, a conventional sound insulation material can be added to a region of the drive belt 450 and pulleys 410. In some other embodiments, a conventional sound insulation material can be added to substantially the entire inner surfaces of the fluid box housing 152 including the frame support 403 and lateral sides (404 and opposite lateral side) of the movement assembly 400.

Figure 5:
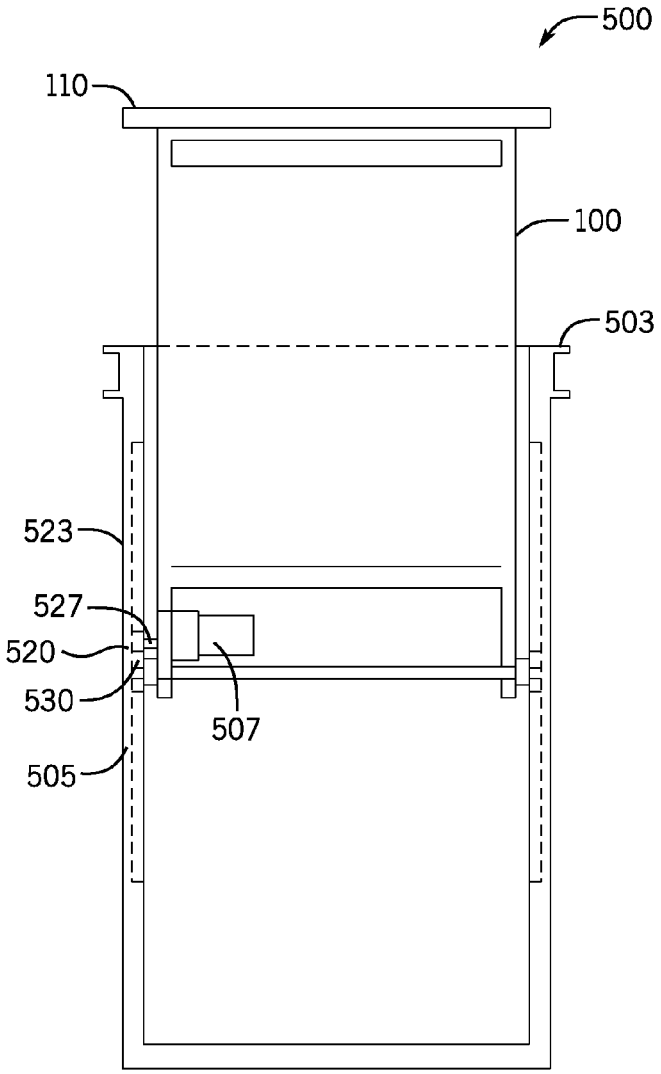
FIG. 5 is a series of diagrams depicting a movement assembly according to some embodiments of the invention.

In some embodiments, the movement assembly 500 can comprise a rack-and-pinion configuration 505 (as shown for example in FIG. 5). For example, in some embodiments, the rack-and-pinion configured movement assembly 500 can operate as a substantially conventional rack and pinion drive system. As shown in FIG. 5, in some embodiments, the rack-and-pinion configured movement assembly 500 can comprise a motor 507 (e.g., a direct current brushed gear motor), at least one rack 523 comprising a plurality of teeth 530, and at least one pinion 525. For example, in some embodiments, the motor 507 can be coupled to the chimney 100 and upon activation, can transfer output to one or more pinions 525. In some embodiments, the motor 507 can be oriented in a substantially horizontal manner, as shown in FIG. 5. In some embodiments, the motor 507 can be oriented in any other manner (e.g., vertical, diagonal, etc.). As shown in FIG. 5, in some embodiments, the racks 523 can be coupled to lateral sides of the downdraft system support structure (i.e., the frame 503) and can each comprise a plurality of teeth 530. The motor 507 and pinions 525 can be positioned so that the teeth 530 of the racks 523 can engage a plurality of teeth 527 on the pinions 525. As a result, upon activation of the motor 507, torque can be transferred to the pinions (e.g., two pinions 525 engaging two racks 523 at the lateral edges of the downdraft system support structure 503), which can begin to rotate. Moreover, because of the engagement of the pinion teeth 527 and the rack teeth 530 and the motor 507 being coupled to the chimney 100, the motor 507 output can drive movement of the chimney 100 (e.g., raising and lowering the chimney). In some embodiments, the downdraft system 10 can comprise a single, substantially medially positioned rack 523 to reduce the materials necessary for operation of the downdraft system 10.

Figure 6:
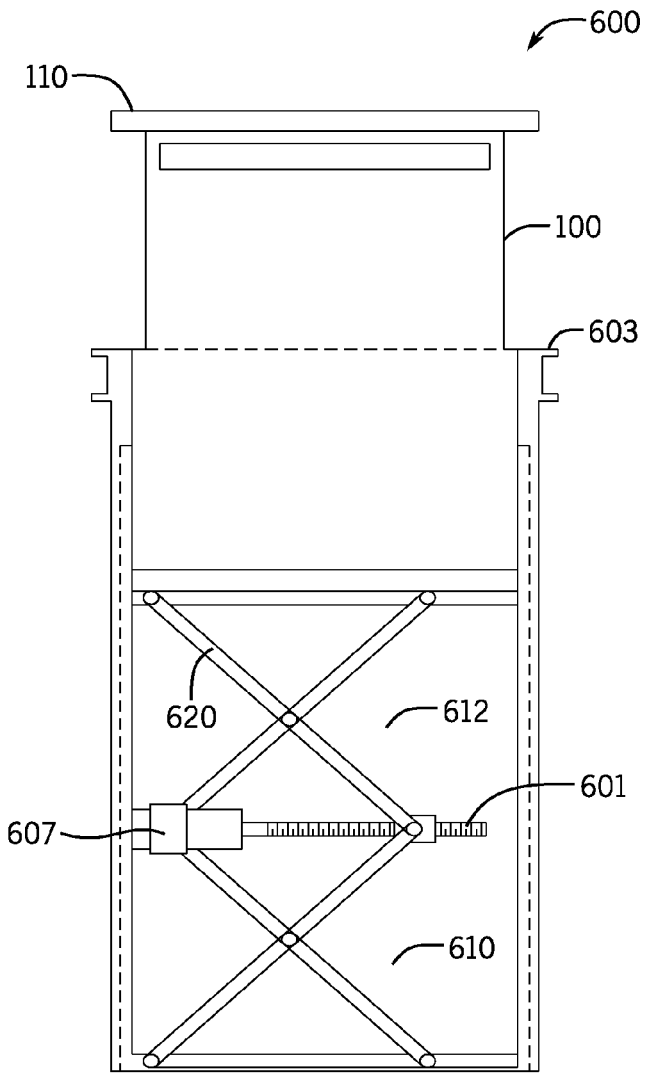
FIG. 6 is a series of diagrams depicting a movement assembly according to some embodiments of the invention.

In some embodiments, the movement assembly 600 can comprise a scissor-lift configuration 605, as shown in FIG. 6. In some embodiments, the movement assembly 600 can comprise a motor 607 (e.g., a direct current brushed gear motor), a conventional lead screw, and a conventional scissor mechanism. For example, the lower portion of the chimney 100 can be coupled to and/or supported by a first scissor lift support 610 and a second scissor lift support 612 can be coupled to a lower portion of the downdraft assembly support structure 603. In some embodiments, the scissor mechanism 605 can be positioned to provide as little to no blockage of the fluid flow path (e.g., positioned against a wall of the support structure 603).

In some embodiments, the scissor-lift configured movement assembly 600 can operate in a manner substantially similar to a conventional scissor lift assembly. For example, activation of the motor 607 (e.g., manually or automatically) can transfer motor 607 output to the lead screw 601. As a result, the rotational movement of the lead screw 601 can be translated to linear movement of the scissor mechanism 605 to raise and lower the chimney 100 (e.g., in a manner substantially similar to a conventional scissor lift assembly). As a result, the chimney 100 can move to enable use of the downdraft system 10 and the scissor-lift configuration 605 can enable relatively minimal interruption of fluid flow in the fluid path. Moreover, in some embodiments, obstruction of fluid flow can be further minimized by positioning the motor 607 in a relatively central position.

Figure 7:
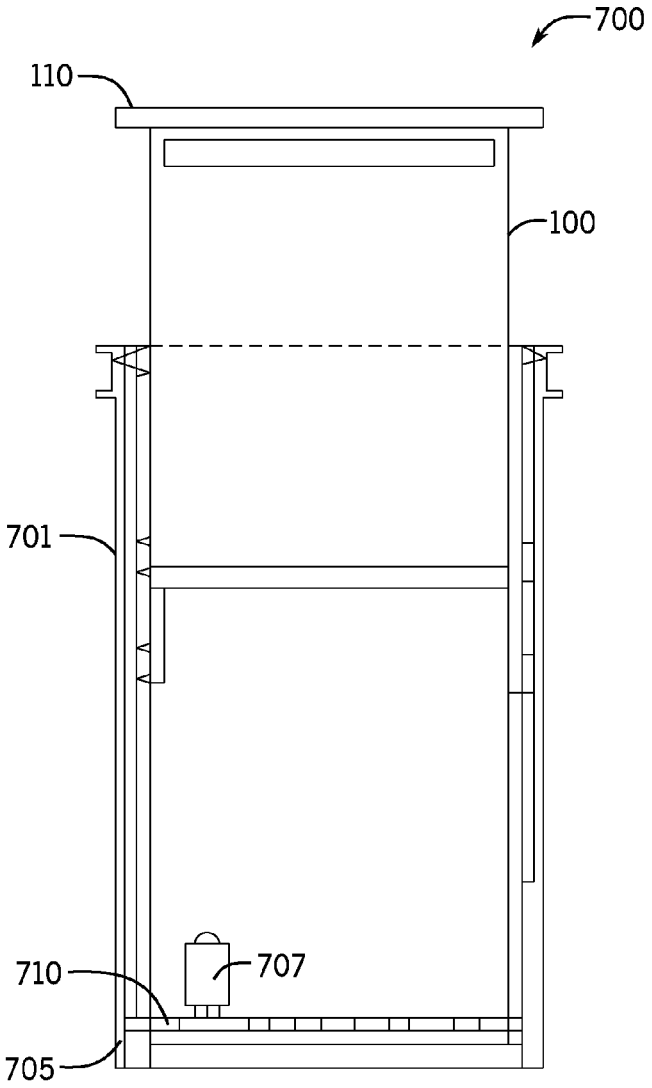
FIG. 7 is a series of diagrams depicting a movement assembly according to some embodiments of the invention.

As shown in FIG. 7, in some embodiments, the movement assembly 700 can comprise a different lead-screw configuration 705. In some embodiments, the movement assembly 700 can comprise a motor 707 (e.g., a direct current brushed gear motor), at least one lead screw 701, and a timing belt 710 being coupled to the motor 707 and configured to transfer motor output from the motor 707 to the lead screws 701, as shown in FIG. 7. In some embodiments, the lead screws 701 can be coupled to the chimney 100 at a position substantially adjacent to the lateral edges of the chimney 100. As a result, in some embodiments, activation of the motor 707 can lead to motor 707 output being transferred to the timing belt 710. In some embodiments, the timing belt 710 can be coupled to the lead screws 701 coupled to the chimney 100. Accordingly, the rotational movement of the timing belt 710 can be translated to linear movement of the lead screws 701 and the chimney 100. In some embodiments, the translation of the movement of the timing belt 705 can be translated to telescoping movement of the chimney 100 resulting in raising and lowering of the chimney 100, as desired by the user.

Figure 8:
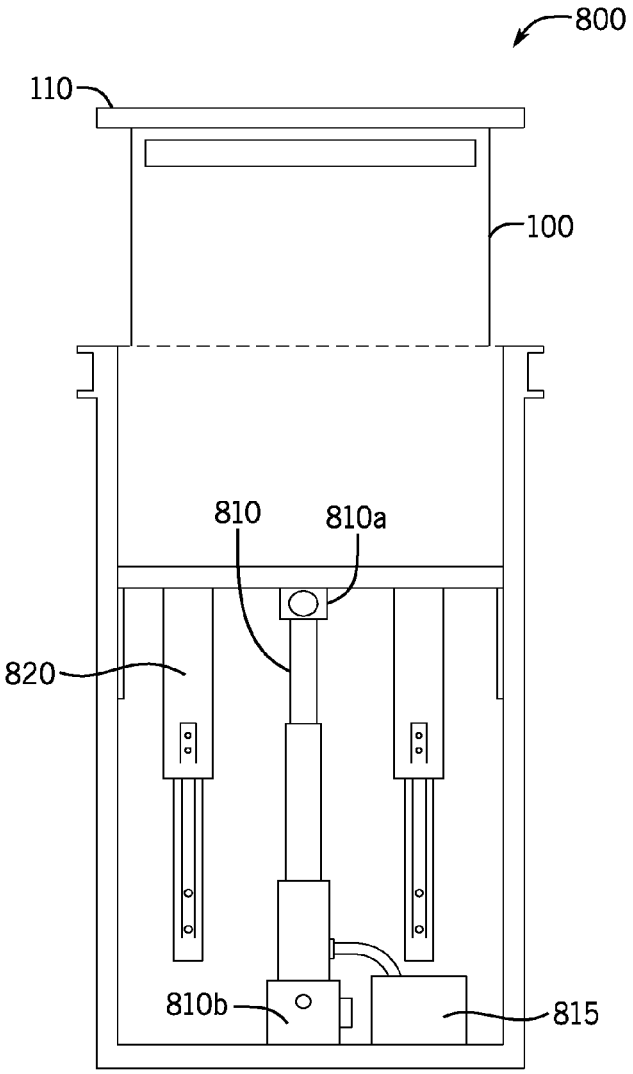
FIG. 8 is a series of diagrams depicting a movement assembly according to some embodiments of the invention.

In some embodiments, the movement assembly 800 can comprise a hydraulic-lift configuration 805. As shown in FIG. 8, in some embodiments, the movement assembly 800 can comprise a lift piston 810, at least one pump 815, and a plurality of slides 820. In some embodiments, the pump 815 can be positioned substantially adjacent to the lift piston 810, as shown in FIG. 8. In some embodiments, the pump 815 can be positioned elsewhere remote from the lift piston 810, but still in fluid communication with the lift piston 810. For example, the pump 815 can circulate a hydraulic fluid (e.g., air, oil, point-of-use water, etc.) to and from the lift piston 810 in order to provide movement. Moreover, in some embodiments, the lift piston 810 can comprise a conventional dual-stage configuration, and in other embodiments, the lift piston 810 can comprise other configurations (e.g., single stage). In some embodiments, the hydraulic-lift configured movement assembly 800 can operate in a manner substantially similar to a conventional hydraulic lift. For example, in some embodiments, a first end 810*a* of the lift piston 810 can be coupled to the lower portion of the chimney 100 and a second end 810*b* of the lift piston 810 can be coupled to a secure location (e.g., a floor of a cabinet, a floor of the kitchen or other room, etc.). Moreover, in some embodiments, the slides 820 can be coupled to the chimney 100 and engaged with guide features (for example, guides 460 shown in FIG. 4) that can be coupled to a wall of the downdraft system support structure 803. As a result, the user can activate the pump 815 (e.g., manually or automatically) so that the pump 815 can move at least a portion of a conventional hydraulic fluid into the lift piston 810 from the pump 815. The hydraulic fluid can cause the lift piston 810 to linearly expand, which can cause vertical movement of the chimney 100. In some embodiments, the user can deactivate the pump 815 when the downdraft system 10 is no longer needed so that at least a portion of the hydraulic fluid returns to the pump 815 or another location (e.g., a bladder, a tank, etc.) so that the chimney 100 can be lowered. In some embodiments, the slides 820 can function to retain the chimney 100 along a substantially linear path as it moves.

Although multiple movement assembly configurations have been mentioned above, the movement assembly can comprise other configurations. For example, the movement assembly can comprise a conventional electromagnetic configuration (e.g., substantially similar to a solenoid-like configuration), or any other configuration that can function to move the chimney 100.

Figure 9A:
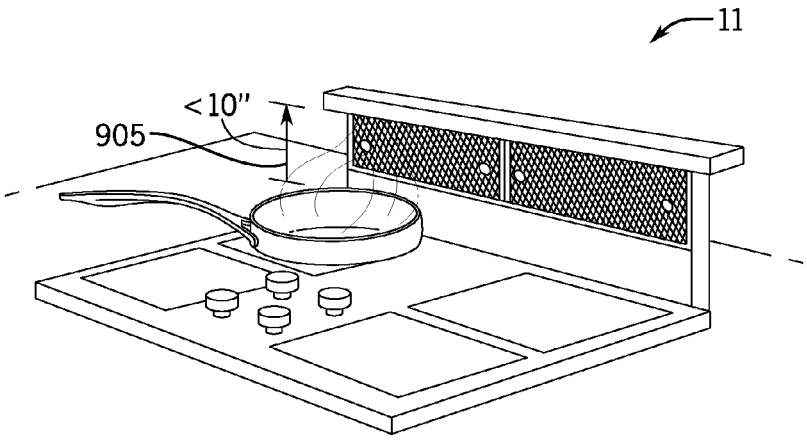
FIG. 9A is an image of a conventional downdraft system in accordance with some embodiments of the invention.
Figure 36A:
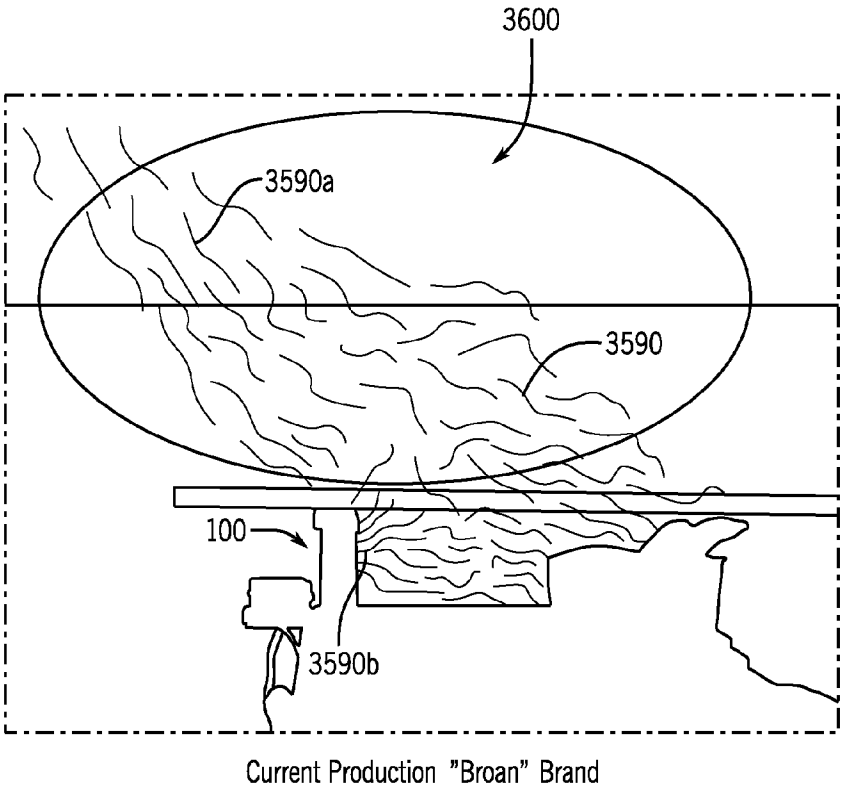
FIG. 36A illustrates a side shadowgraph of a Broan® brand downdraft system.
Figure 36C:
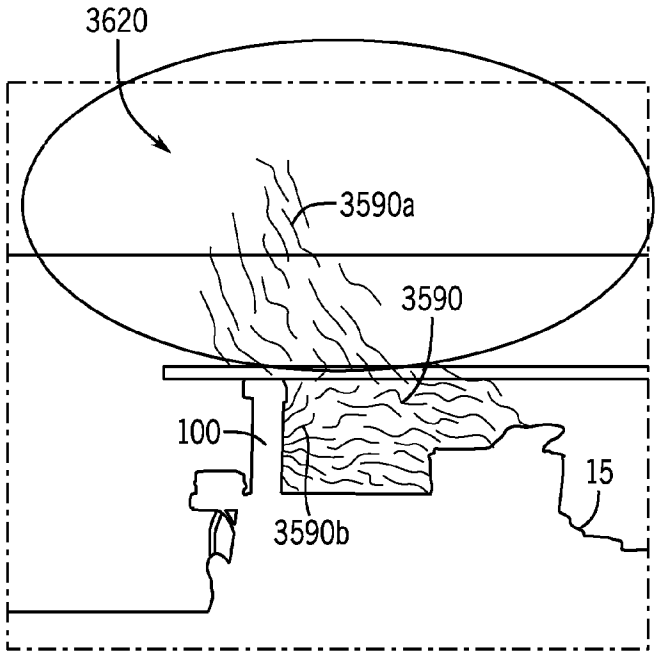
FIG. 36C illustrates a side shadowgraph of a Broan®-Best brand downdraft system.
Figure 36B:
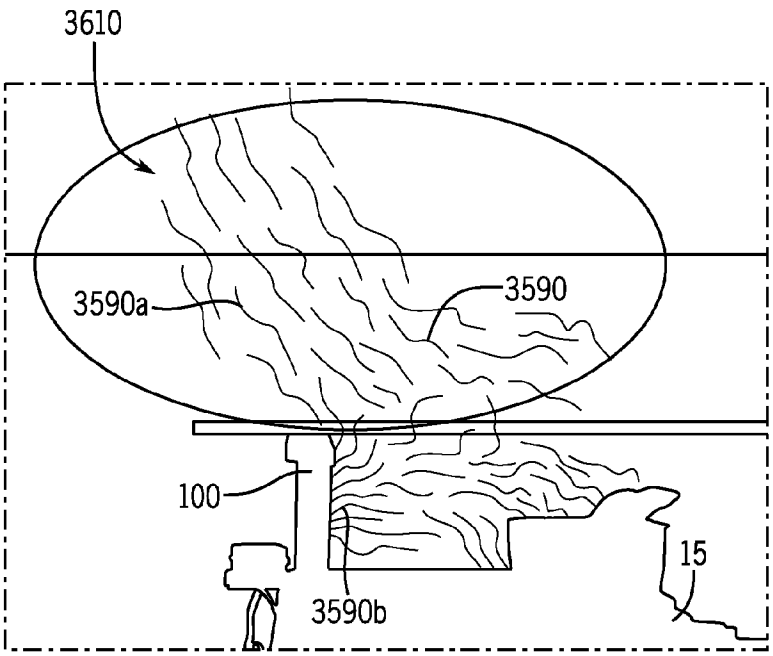
FIG. 36B illustrates a side shadowgraph of a Broan®-Elite brand downdraft system.

FIG. 9A shows an image of a conventional downdraft system with a downdraft systems that can vertically extend from a counter surface level adjacent to a cooktop a distance of less than about ten inches (shown as 905 in FIG. 9A). As a result of this vertical height, many conventional downdraft systems can only capture an average amount of effluent from lower-profile cooking vessels immediately adjacent to the conventional system's inlet (i.e., the conventional system can only capture effluent from lower-profile pans on back cooktop burners and will not adequately exhaust effluent from higher-profile pots and pans or effluent generated from more distal cooktop burners). Further, as shown in FIGS. 35A-E illustrating side shadowgraphs of various prior-art downdraft systems 3500, 3510, 3520, 3530 and 3540, an effluent 3590 can include an effluent flow region 3590*b*, influenced by an air-draw into a fluid inlet, however the effluent 3590 also includes an effluent flow region 3590*a* comprising effluent 3590 moving away from the conventional downdraft system, no longer capable of being drawn into a fluid inlet (i.e. moving to region 3590*b*). Similarly, FIG. 36A illustrates a side shadowgraph of a Broan® brand downdraft system 3600, FIG. 36B illustrates a side shadowgraph of a Broan®-Elite brand downdraft system 3610, and FIG. 36C illustrates a side shadowgraph of a Broan®-Best brand downdraft system 3620. As shown in the shadowgraphs of FIGS. 36A-C, the downdraft systems 3600, 3610, and 3620 demonstrate effluent regions 3590*a* and 3590*b*, indicative of a failure to fully capture the effluent 3590.

BROAN® and BROAN® BEST® are registered trademarks of Broan-NuTone LLC, 926 West State Street, Hartford, Wis. 53027.

Figure 9B:
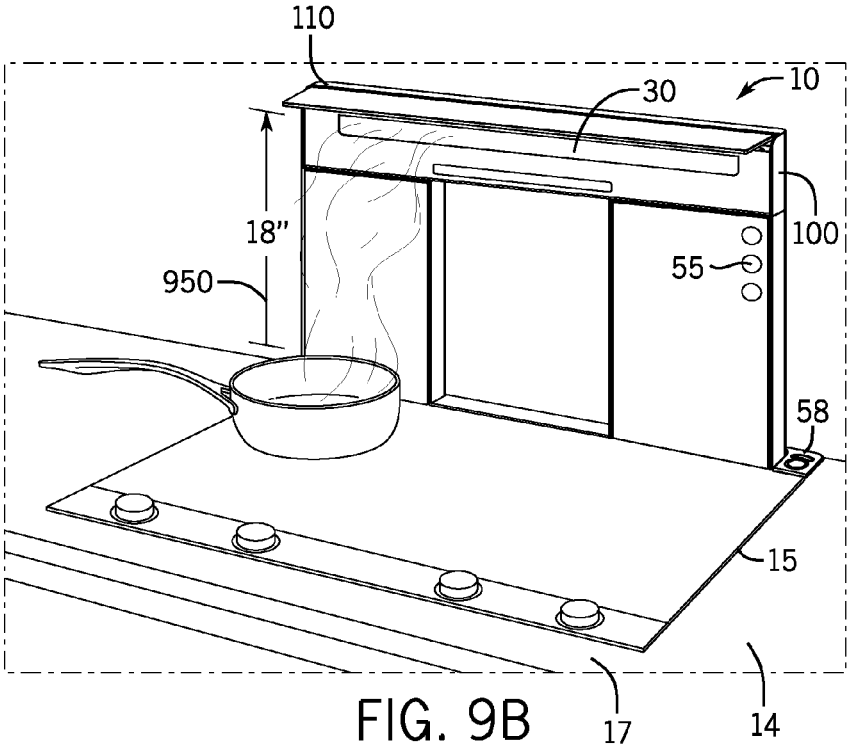
FIG. 9B is an image of a downdraft system according to some embodiments of the invention.

In some embodiments, the downdraft system 10 can be configured and arranged to more successfully capture cooking effluent and other fluids relative to some conventional downdraft systems. For example, in some embodiments, as shown in FIG. 9B, the chimney 100 can vertically extend a greater distance (shown as 950) than the chimney of at least some conventional systems. As a result, the downdraft system 10 can exhaust effluent and other fluids from cooking vessels adjacent to and/or distal from the chimney 100, leading to an improved cooking episode experience.

Figure 37:
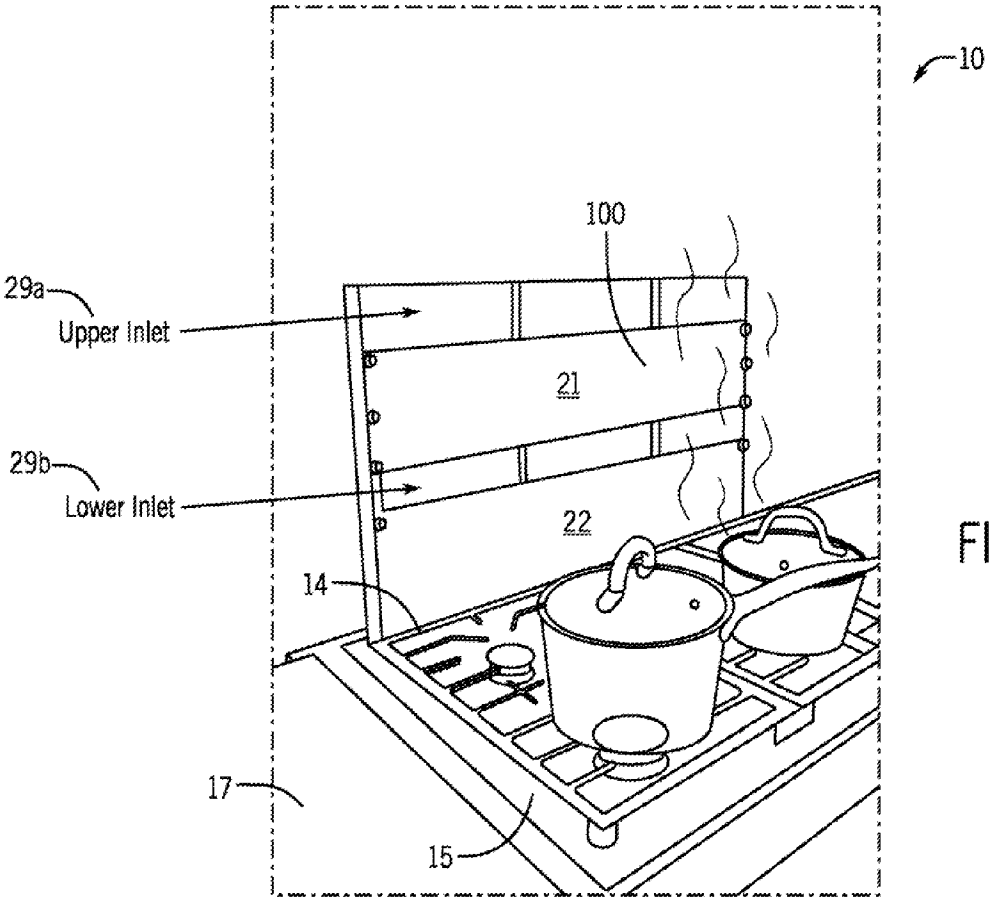
FIG. 37 illustrates front perspective view of a dual inlet downdraft system according to some embodiments of the invention.

In some further embodiments, effluent capture efficiency can be further improved using multiple fluid inlets. As discussed earlier, in some embodiments, the downdraft system can include dual inlets comprising an upper inlet 29*a* and a lower inlet 29*b*. In some other embodiments, the inlet 30 can comprise an upper inlet 29*a* and a lower inlet 29*b*. For example, FIG. 37 illustrates front perspective view of a dual inlet downdraft system 10 according to some embodiments of the invention. As shown, in some embodiments, the downdraft system 10 includes dual inlets 29*a*, 29*b*. The chimney 100 includes an upper horizontal member 21 coupled to an upper inlet 29*a* and a lower inlet 29*b*. The chimney 100 also includes a lower horizontal member 22 coupled to the lower inlet 29*b* and the cooktop 15.

In some embodiments, the dimensions of either the upper horizontal member 21 or lower horizontal member 22 can be varied to comprise a smaller or greater total vertical dimension. Moreover, in some embodiments, the total vertical dimension of the either of the upper inlet 29*a* or the lower inlet 29*b* can be varied to be smaller or greater than that illustrated in FIG. 37. For example, in some embodiments, the upper horizontal member 21 and the lower horizontal member 22 can be varied to comprise a smaller or greater total vertical dimension than shown in FIG. 37. In some embodiments, the total vertical dimension of the upper inlet 29*a* and the lower inlet 29*b* can be varied to be smaller or greater than that illustrated in FIG. 37. In some other embodiments, the total vertical dimension of the upper horizontal member 21, the lower horizontal member 22, the upper inlet 29*a* and the lower inlet 29*b* can be varied to be smaller or greater can be varied to comprise a smaller or greater total vertical dimension than shown in FIG. 37.

In some embodiments, either one or both of the upper and lower horizontal members 21, 22 can be independently vertically moveable with respect to the chimney 100. For example, in some embodiments, the upper horizontal member 21 can be moved vertically upwards or vertically downwards. Further, in some embodiments, the lower horizontal member 22 can be moved vertically upwards or vertically downwards.

In some embodiments, the total vertical dimension of the upper inlet 29*a* can be modified by moving the upper horizontal member 21 upwards (i.e., away from the cooktop 15) or downwards (i.e., towards the cooktop 15). In some further embodiments, the total vertical dimension of the lower inlet 29*b* can be modified by moving either or both of the upper horizontal member 21 and lower horizontal member 22 upwards (i.e., away from the cooktop 15) or downwards (i.e., towards the cooktop 15). In some embodiments, when modifying the total vertical height of the upper inlet 29*a* through the movement of the upper horizontal member 21, the lower horizontal member 22 can be moved to maintain the total vertical height of the lower inlet 29*b*. In other embodiments, the lower horizontal member 22 can remain stationary, and the total vertical height of the lower inlet 29*b* can be increased as the total vertical height of the upper inlet 29*a* decreases.

In some embodiments, either the upper horizontal member 21 or the lower horizontal member 22 or both may be actuated together or independently by any one of the movement assemblies 300, 400, 500, 600, 700, 800 depicted in FIGS. 3-8.

Figure 38:
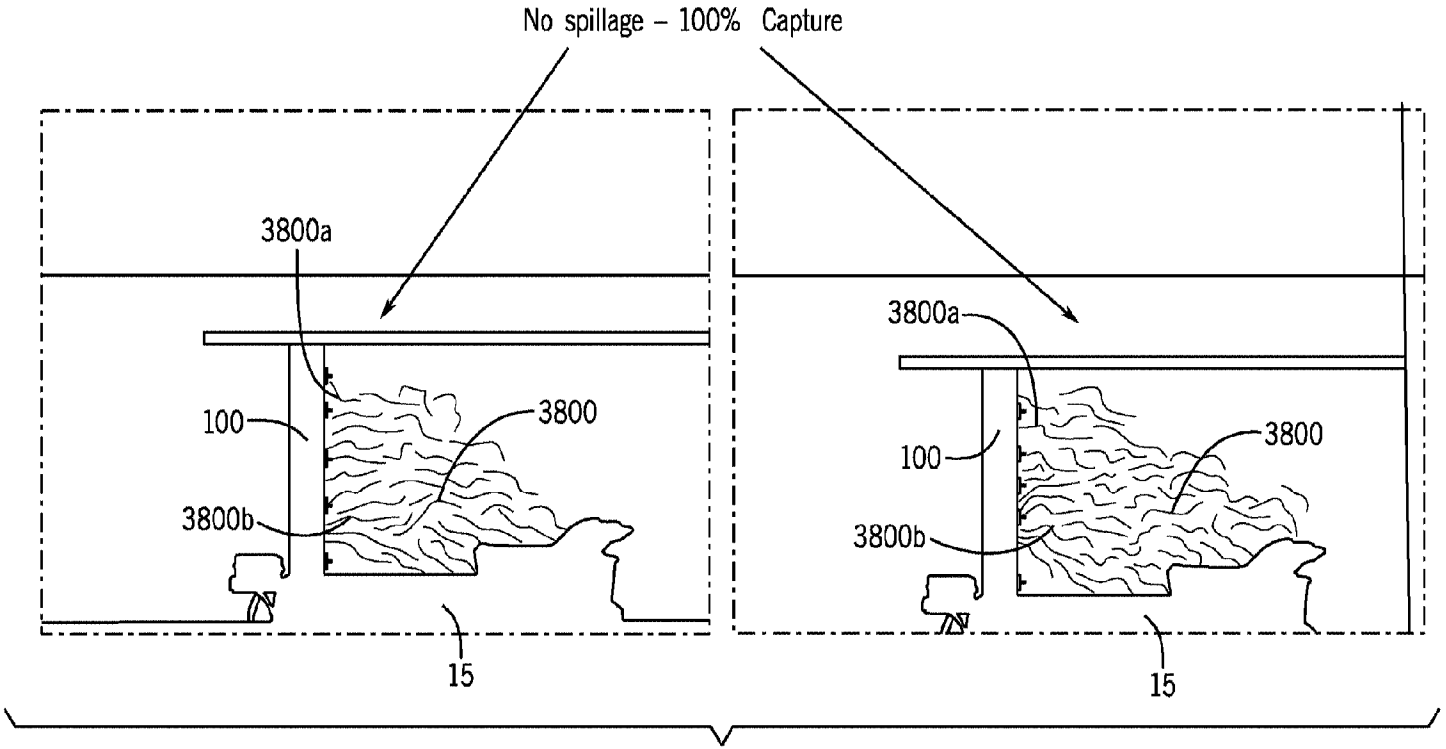
FIG. 38 illustrates two side shadowgraphs of a dual inlet downdraft system according to some embodiments of the invention.

FIG. 38 illustrates two side shadowgraphs of a dual inlet downdraft system 10 according to some embodiments of the invention. As shown, an effluent 3800 can comprise effluent flow regions 3800*a* corresponding to the effluent 3800 being drawn into the upper inlet 29*a*, and an effluent flow region 3800*b*, corresponding to the effluent 3800 being drawn into the lower inlet 29*b*. As shown, the use of dual inlets 29*a*, 29*b* enables substantially all the effluent 3800 to be captured.

The embodiments shown and described in FIGS. 37 and 38 can comprise upper and lower horizontal members 21, 22 and upper and lower inlets 29*a*, 29*b* within an eighteen inch chimney 100. In some other embodiments, the chimney 100 can be taller or smaller. For example, in some embodiments, the chimney 100 height can be fifteen inches, whereas in other embodiments, the chimney 100 can be twelve inches. Furthermore, in some embodiments as shown and described, one or more of the upper and lower inlet 29*a*, 29*b* configurations can capture substantially all effluent 3800 while maintaining a cooking efficiency substantially unaffected by the effluent 3800 flowing into either of the inlets 29*a*, 29*b*. FIGS. 39A-B provides a table 3900 including a 'time to boil' study for various configurations of downdraft system 10 including dual inlets as shown in FIG. 37 in accordance with some embodiments of the invention. As shown, for downdraft system 10 including dual inlets 29*a* and 29*b*, the time to boil water is substantially unaffected.

In some embodiments, the distance that the chimney 100 can extend from the counter surface 17 (i.e., vertical height) can vary. In some embodiments, the chimney 100 can extend a maximum vertical height (e.g., about eighteen inches for example as described earlier), however, the user can also select a vertical height less than the maximum distance. For example, the movement assembly 400 and/or other portions of the downdraft system 10 can be configured so that the chimney 100 can extend a pre-defined set of vertical heights from the counter surface 17 (e.g., the downdraft system 10 can comprise one or more settings that reflect the desired vertical height from the counter surface level 17, such as, six inches, ten inches, twelve inches, fifteen inches, etc.). In some embodiments, the user can select the predefined vertical height so that the chimney 100 extends from the counter surface 17 by the predetermined vertical height rather than the maximum vertical height. Furthermore, in some embodiments, the downdraft system 10 can be configured so that the vertical height can be continuously variable (i.e. the vertical height as an infinite range of settings between the fully extended height and the starting position where the chimney is substantially fully enclosed by the fluid box 150, and not extended above the counter 17). For example, the user can activate the movement assembly 400 to begin raising the chimney 100 and the user can deactivate the movement assembly 400 when the chimney 100 reaches a desired vertical height (e.g., any vertical height less than or equal to the maximum vertical height).

In some embodiments, at least some portions of the downdraft system 10 can be configured for use with conventional residential cooktops 15. For example, in some embodiments, the height of the chimney 100 can be optimized to improve and/or maximize capture of cooking effluent originating from cooking vessels on a conventional residential cooktop (e.g., a cooktop 15 comprising a conventional depth). Moreover, in some embodiments, the height of the chimney 100 can also be configured to account for a conventional distance between an upper portion of the cooktop 15 (for instance the cooking surface) and one or more cabinets disposed substantially adjacent to the chimney 100 (for example, above an upper portion of the chimney 100).

Figure 10A:
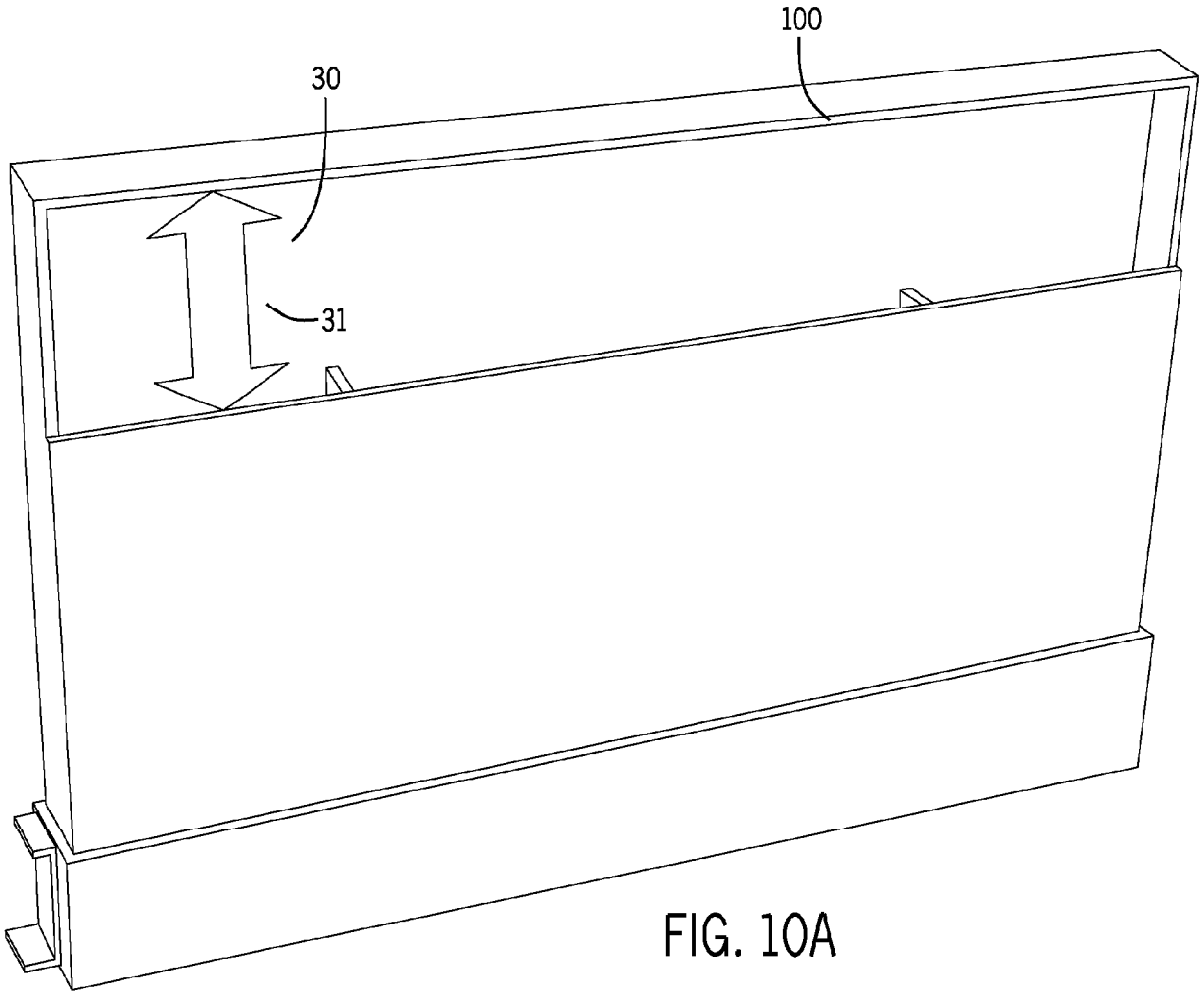
FIG. 10A is a diagram depicting varying chimney intake openings to assess intake velocity.
Figure 10B:
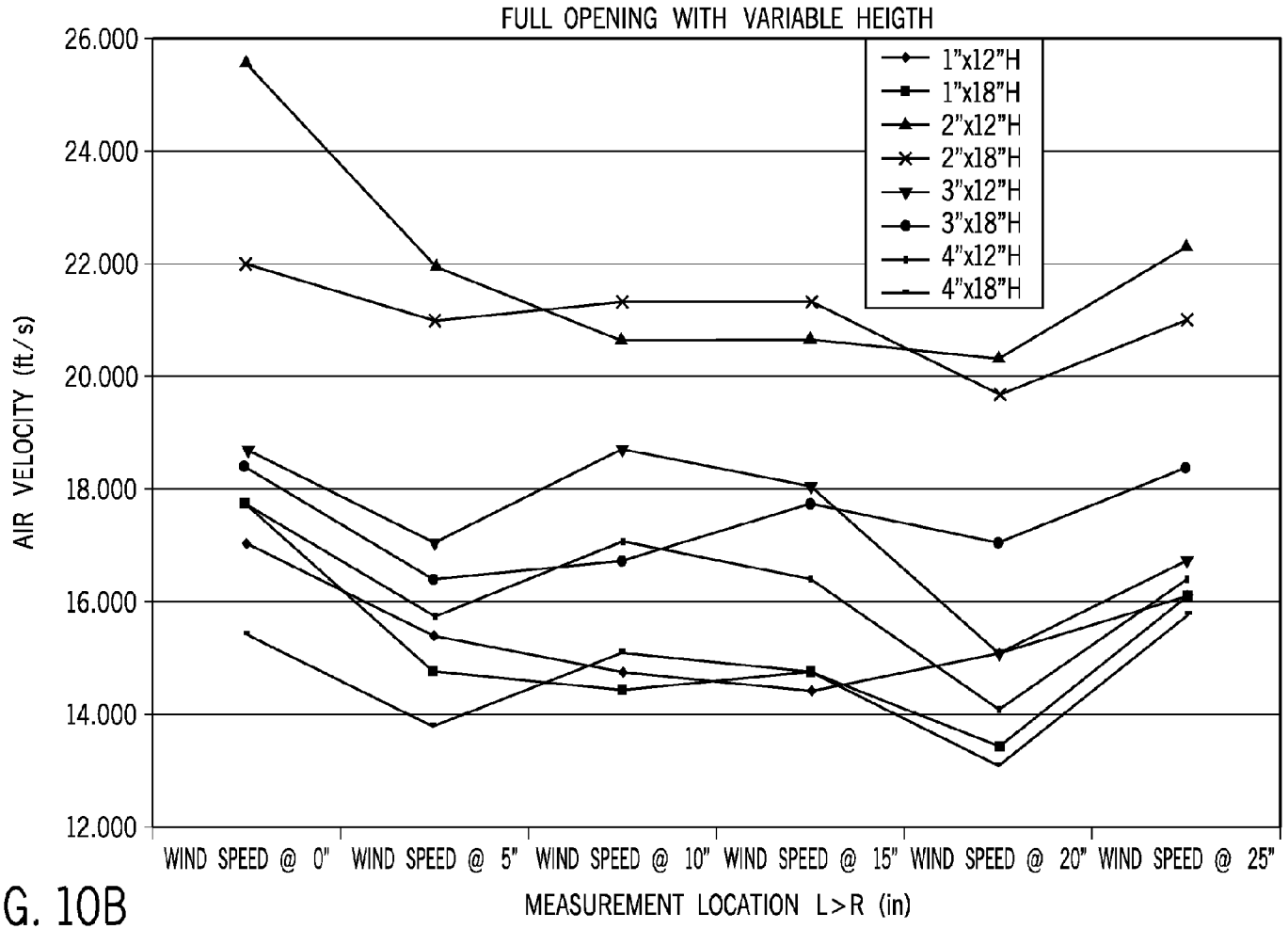
FIG. 10B is a graph showing intake velocity with different chimney intake openings.
Figure 11:
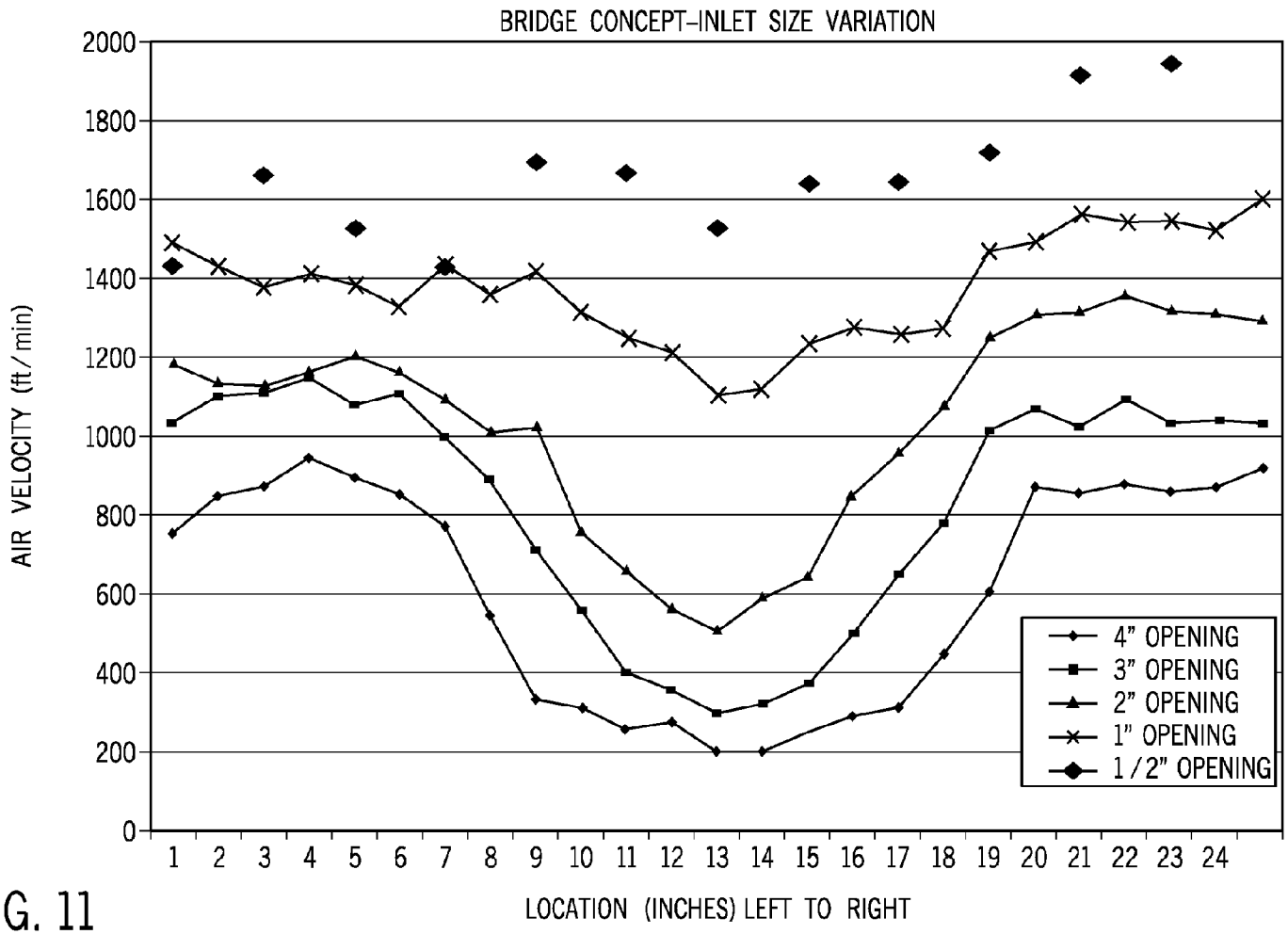
FIG. 11 is a graph depicting fluid intake velocity testing results.
Figure 12:
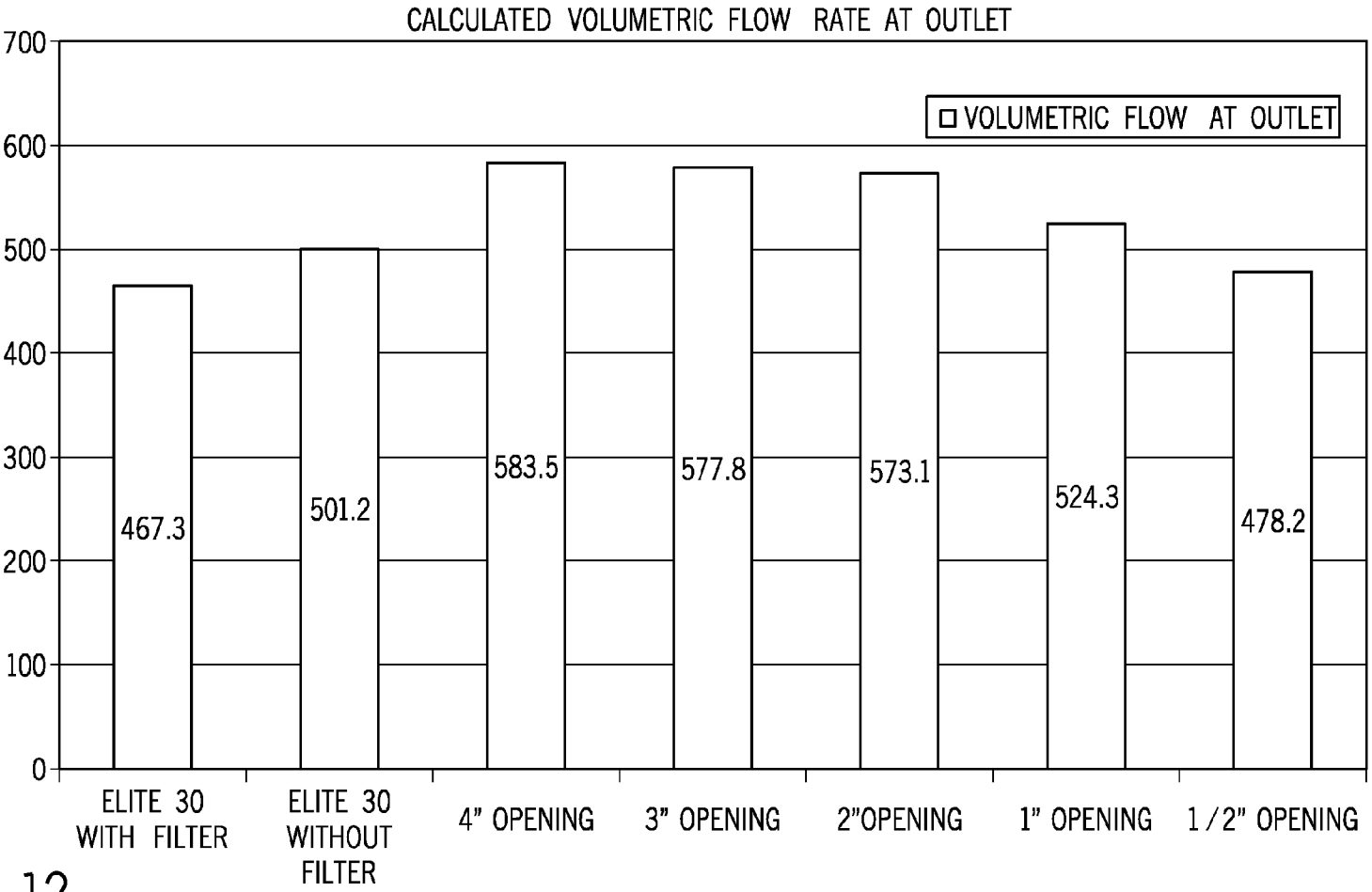
FIG. 12 is a graph depicting fluid flow rate testing results.
Figure 13:
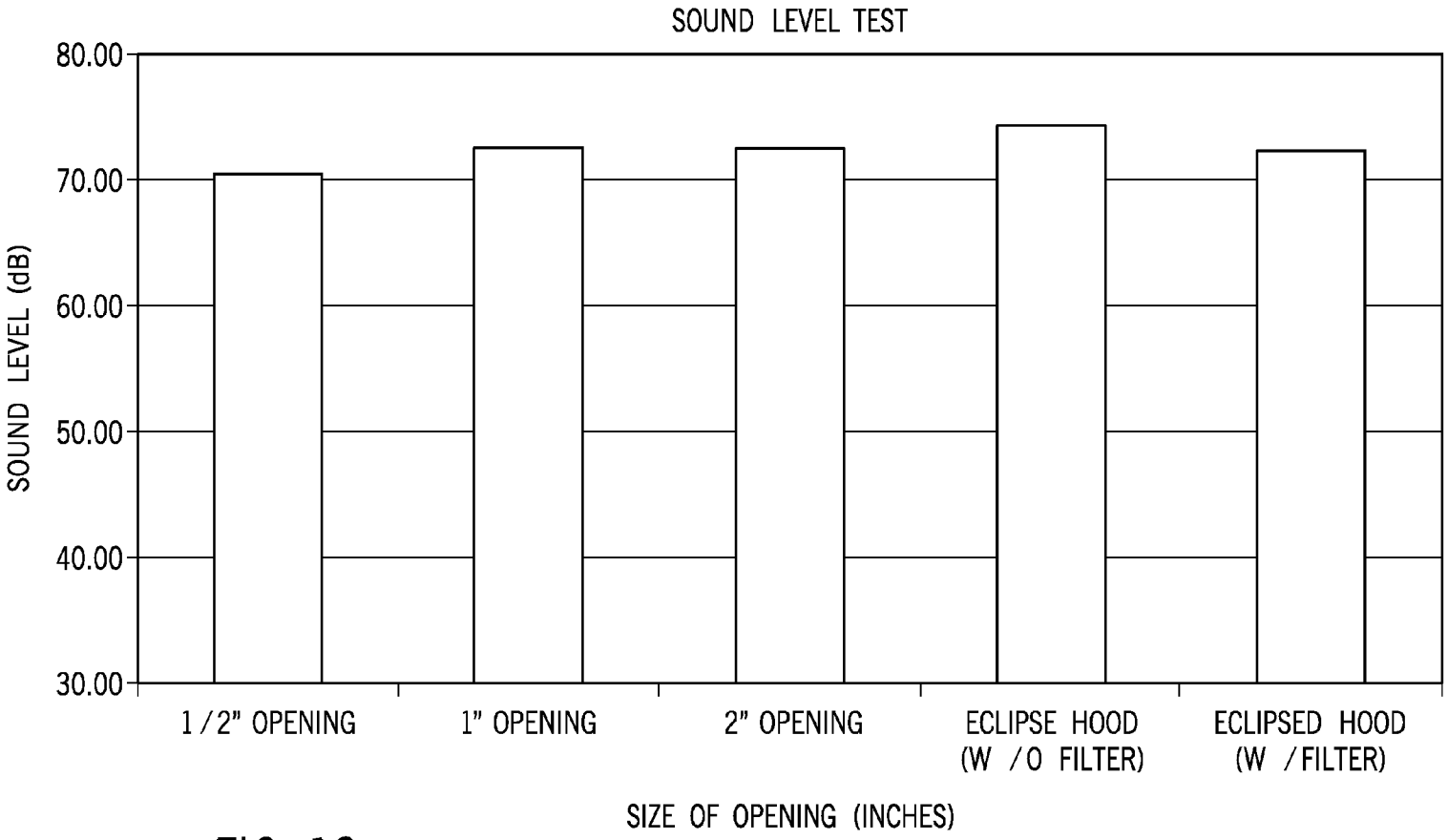
FIG. 13 is a graph depicting auditory output testing results.

Moreover, in some embodiments, the one or more fluid inlets 30 can be optimized to provide the greatest possible fluid intake velocity, while not significantly affecting fluid flow rate. By way of example only, as shown in FIG. 10A, downdraft systems 10 comprising a fluid inlet 30 and chimney intake opening 31 with a vertical length of four inches, three inches, two inches, one inch, and one-half inch were tested to assess fluid intake velocity relative to fluid flow rate (e.g., to ensure a maximum fluid intake velocity while not significantly impacting fluid flow rate). The downdraft systems 10 were tested relative to some conventional downdraft systems (for example, see the data in FIG. 10B as well as the data in FIGS. 11-12 comparing the Kenmore Elite® 30 in FIGS. 11 and 12). Kenmore Elite® is a registered trademark of KCD IP, LLC. For example, as shown in FIGS. 10A, 10B, and 11, the results indicate that the greater the vertical length of the chimney intake opening 31 of the fluid inlet 30, the lesser the fluid flow rate through the inlet 30, and vice versa. Moreover, as shown by the results in FIG. 12, although the fluid flow rate does not fluctuate as much as the fluid intake velocity based on inlet length of the chimney intake opening 31, the graph illustrates that, generally, the greater the inlet 31 length, the greater the fluid flow rate. Moreover, as shown in FIG. 13, the sound output by the downdraft system 10 can also increase with greater fluid inlet length of the chimney intake opening 31. Accordingly, based on an analysis of the results, a chimney intake opening 31 of a size of about one to two inches in vertical length was selected because of the maximized fluid intake velocity with no significant impact on the fluid flow rate.

Figure 14A:
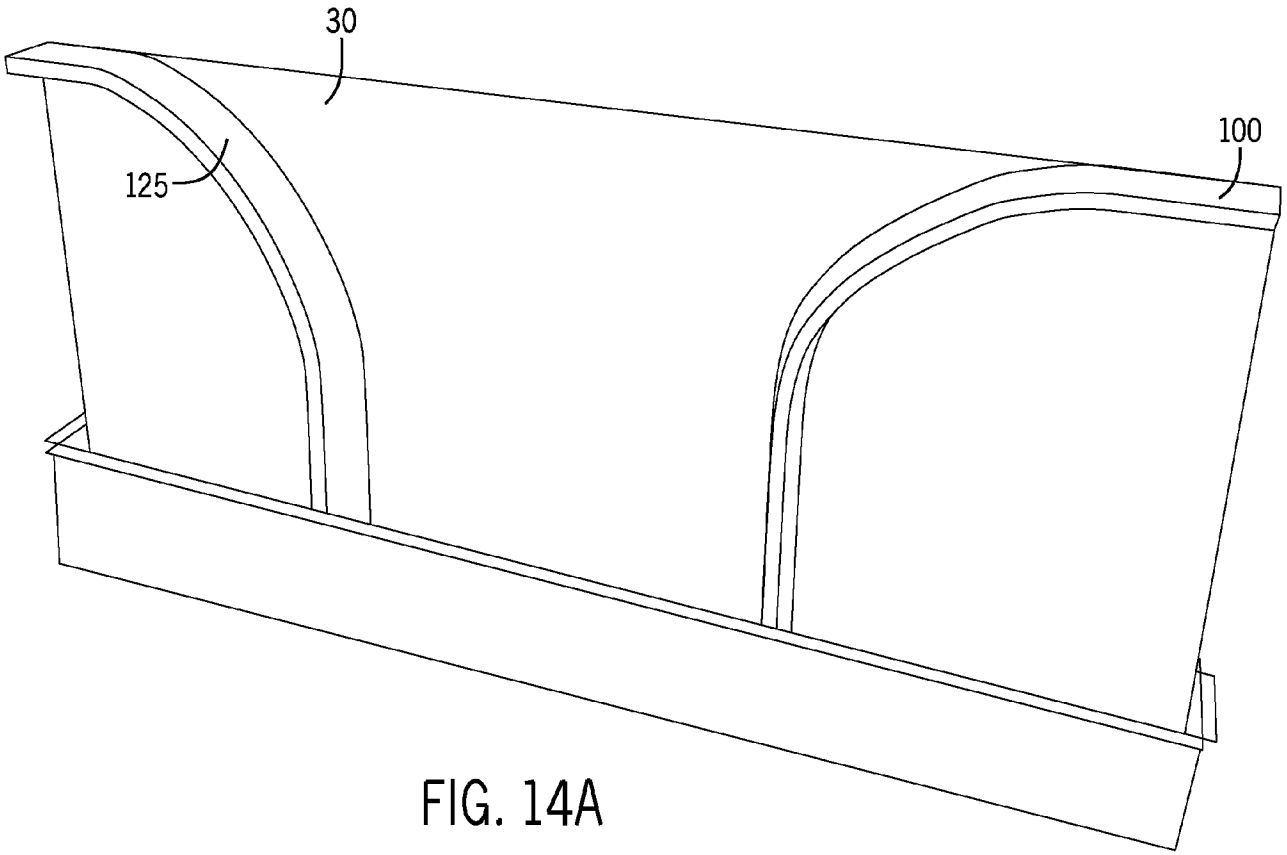
FIG. 14A is a diagram of inner walls of a chimney according to some embodiments of the invention.
Figure 14B:
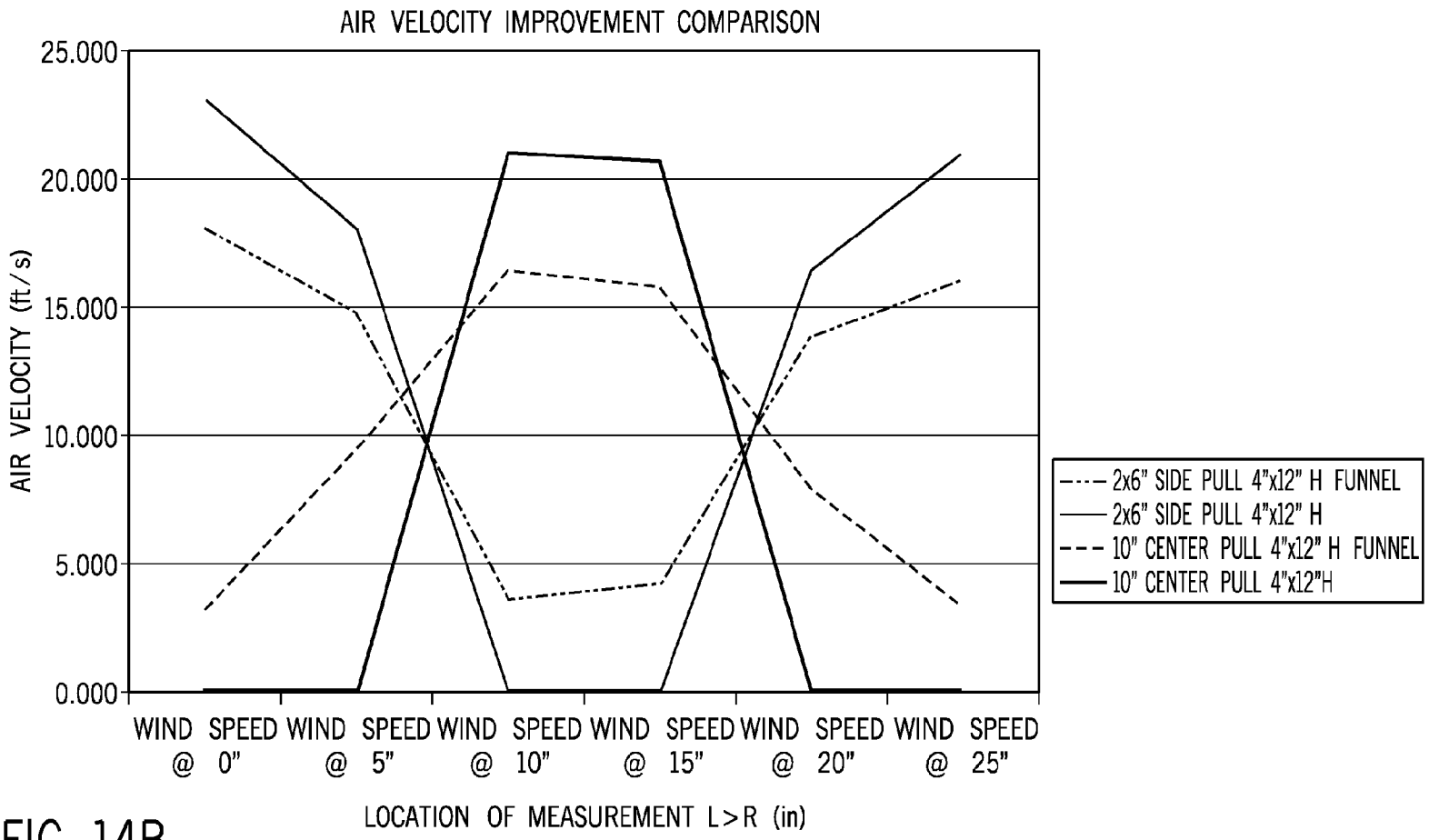
FIG. 14B is a graph of air velocity improvement according to some embodiments of the invention.
Figure 15:
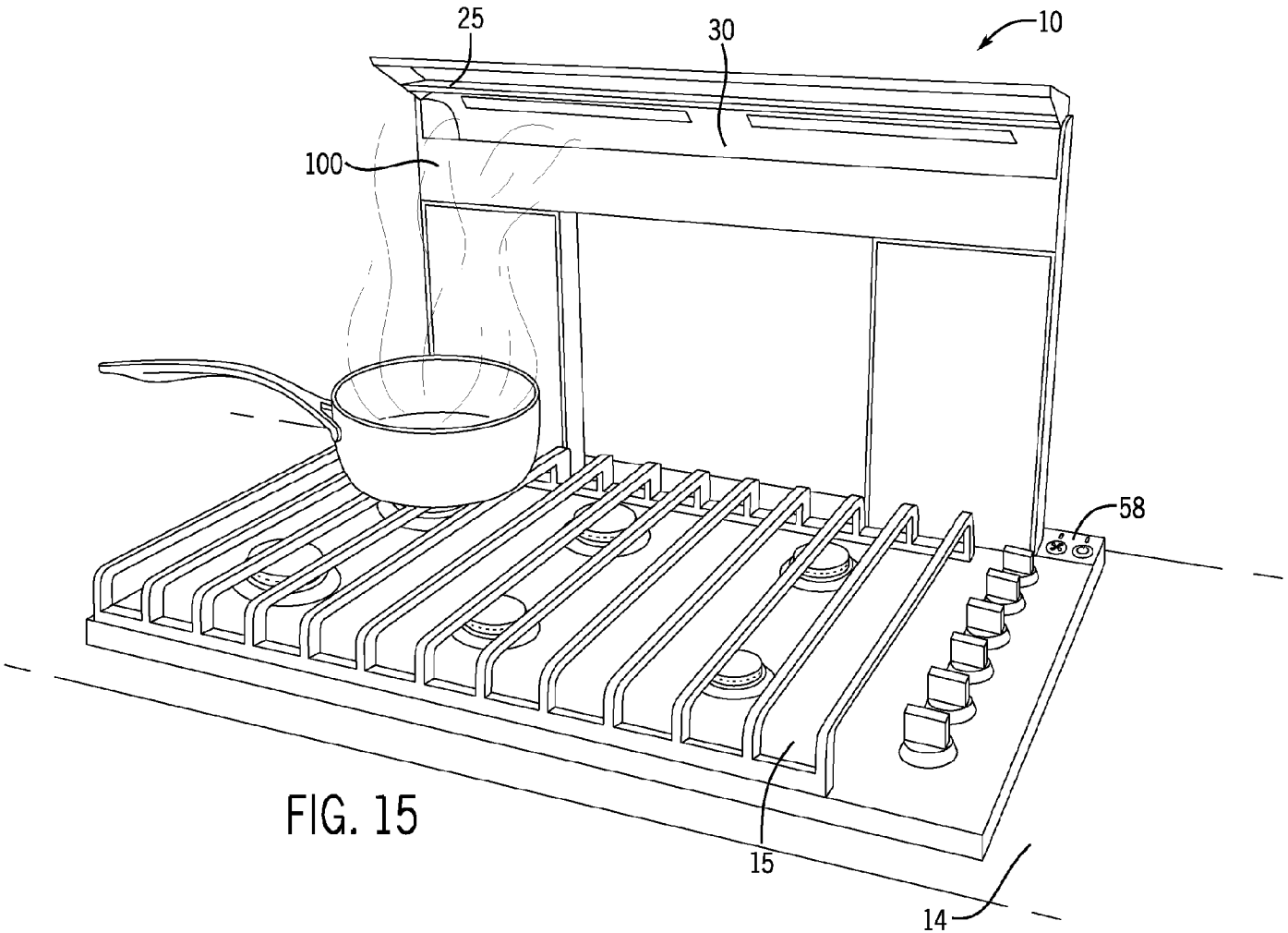
FIG. 15 is multiple views of downdraft systems comprising a visor according to some embodiments of the invention.

In some embodiments, the downdraft system 10 can comprise other elements that can enable improved fluid flow through the chimney 100 and other portions of the system. For example, as shown in FIG. 14A, at least a portion of one or more internal walls 125 that define some portions of the fluid path of the fluid inlet 30 can be configured to improve or optimize fluid flow rate and fluid intake velocity. For example, FIG. 14B is a graph of air velocity improvement using a various configurations of the internal walls 125 shown in FIG. 14A. As shown, in some embodiments, the internal walls 125 (e.g., positioned inside of the chimney 100 and substantially adjacent to the fluid inlet 30) can comprise one or more angled, curved, and/or otherwise substantially non-linear transitions 125*a*. For example, as shown in FIG. 14A, by configuring areas of the inner walls 125 (e.g., configuring the walls with non-linear features) where fluid entering the inlets 30 transitions from a substantially horizontal flow to a substantially non-horizontal or vertical flow, the flow profile of the downdraft system 10 can comprise a more laminar flow profile, which can lead to fluids being pulled from an entire length and/or width of the inlet (i.e., relative to some downdraft systems that comprise linear inner wall transitions 125*a*). As shown, in some embodiments, the entire length and/or width of the inlet can be substantially equal to the width of the chimney 100.

In some embodiments, the downdraft system 10 can comprise one or more visors 25, as shown in FIGS. 15 and 16A-D. As shown, in some embodiments, the visor 25 can be coupled to the chimney 100 so that when the visor 25 comprises a closed or substantially close position, the visor 25 can partially or completely obstruct the fluid inlet 30. In some embodiments, the visor 25 can substantially control the flow of a cooking effluent. For example, in some embodiments, the visor 25 can substantially guide the flow of a cooking effluent into one or more fluid inlets 30. Some embodiments include different size, shape and position with respect to the cooktop 15 and the cooking area 14. Some embodiments include a visor 25 with an angle with respect to the cooktop 15 and the cooking area 14. Some embodiments include a visor 25 with a shape and position and angle to guide substantially all the cooking effluent from a cooking area into the downdraft system 10.

Figure 16B:
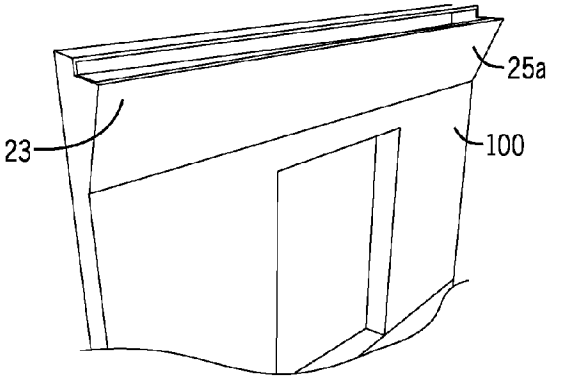
FIGS. 16A-D show various perspective views of downdraft systems according to some embodiments of the invention.
Figure 16A:
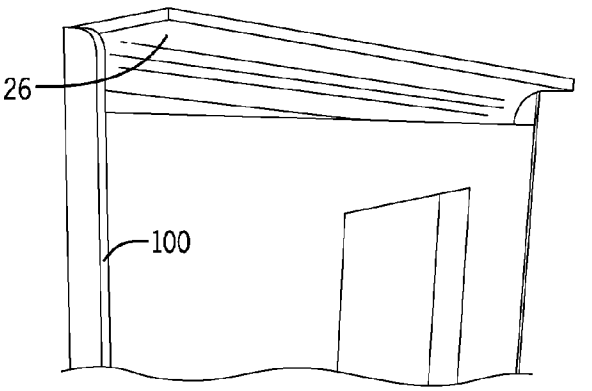
Figure 16D:
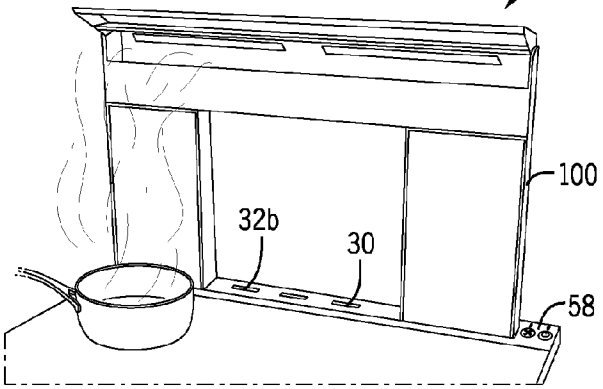

In some embodiments, before and/or after the chimney 100 arrives at a fully raised position, the visor 25 can move from a substantially or completely closed position to an open position (e.g., the visor 25 can comprise an articulating top 26, as shown in FIG. 16A). For example, in some embodiments, the visor 25 can pivot about a point so that at least a portion of the visor 25 moves from a position substantially parallel to a vertical axis of the chimney 100 to a position substantially perpendicular to the vertical axis of the chimney 100 (shown in FIG. 16A). Moreover, in some embodiments, the visor 25 can automatically move as a result of the chimney 100 reaching its maximum height and/or the visor 25 can be manually moved as a result of a user inputting instructions for the visor 25 to move. In some embodiments, the visor 25 can comprise multiple pivot points or articulations so that the visor 25 can move to the open position through multiple steps. In some embodiments, the visor 25 can be configured and arranged so that when the visor 25 comprises the open configuration, the visor 25 can aid in guiding cooking effluent and other fluids into the inlet 30 (e.g., the visor 25 can operate as a capture ledge), which can at least partially enhance fluid intake and exhaust.

In some embodiments, the visor can comprise alternative configurations. As shown in FIG. 16B, the visor 25 can pivot about a point below the top of the chimney (shown as pivot point 25*a*). For example, in some embodiments, the visor 25 can comprise an articulating front panel configuration 23. The visor can move so that an upper portion of the visor (the articulating front panel configuration 23) moves outward from the chimney 100 to allow fluid to enter the fluid inlet 30 (e.g., the visor 25 can move so that it pivots in a generally forward direction toward the cooktop). In other embodiments, the visor 25 can be configured so that it pivots, articulates, or otherwise moves in any direction (e.g., a combination of the top articulating visor and the articulating front panel configuration). Moreover, in some embodiments, the distance that the visor 25 moves while pivoting between a substantially open and closed position can be variable. For example, in some embodiments, the user can open the visor 25 a distance less than a maximum distance to provide a more-directed fluid intake flow (e.g., the visor 25 can be moved to any position between the open and closed positions).

Figure 16C:
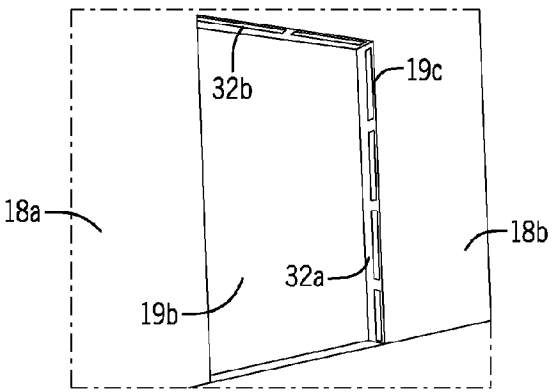

As shown in FIG. 16C, in addition to, or in lieu of comprising a visor 25, in some embodiments, the chimney 100 can comprise a plurality of substantially vertically arranged fluid inlets 30. In some embodiments, the downdraft system 10 including the chimney 100 can comprise a perimeter induction configuration. For example, in some embodiments, the chimney 100 can comprise a central region 19*b* and two central regions (18*a*, 18*b*) disposed on lateral sides of the central region 19*b*. Moreover, as shown in FIG. 16C, in some embodiments, a perimeter of an area (a perimeter region 19*c*) where the central region 19*b* transitions to the column regions 18*a*, 18*b* can comprise a plurality of fluid inlets 30. For example, in some embodiments, in addition to or in lieu of a generally horizontally arranged fluid inlet 30 adjacent to a top of the chimney, the chimney 100 can comprise perimeter induction fluid inlets including vertical inlets 32*a* and horizontal inlets 32*b* at the upper region of the fluid box 150. In other embodiments, the perimeter induction fluid inlets 32*a*, 32*b* can comprise any other configuration around the perimeter of an area 19*c*.

Figure 17:
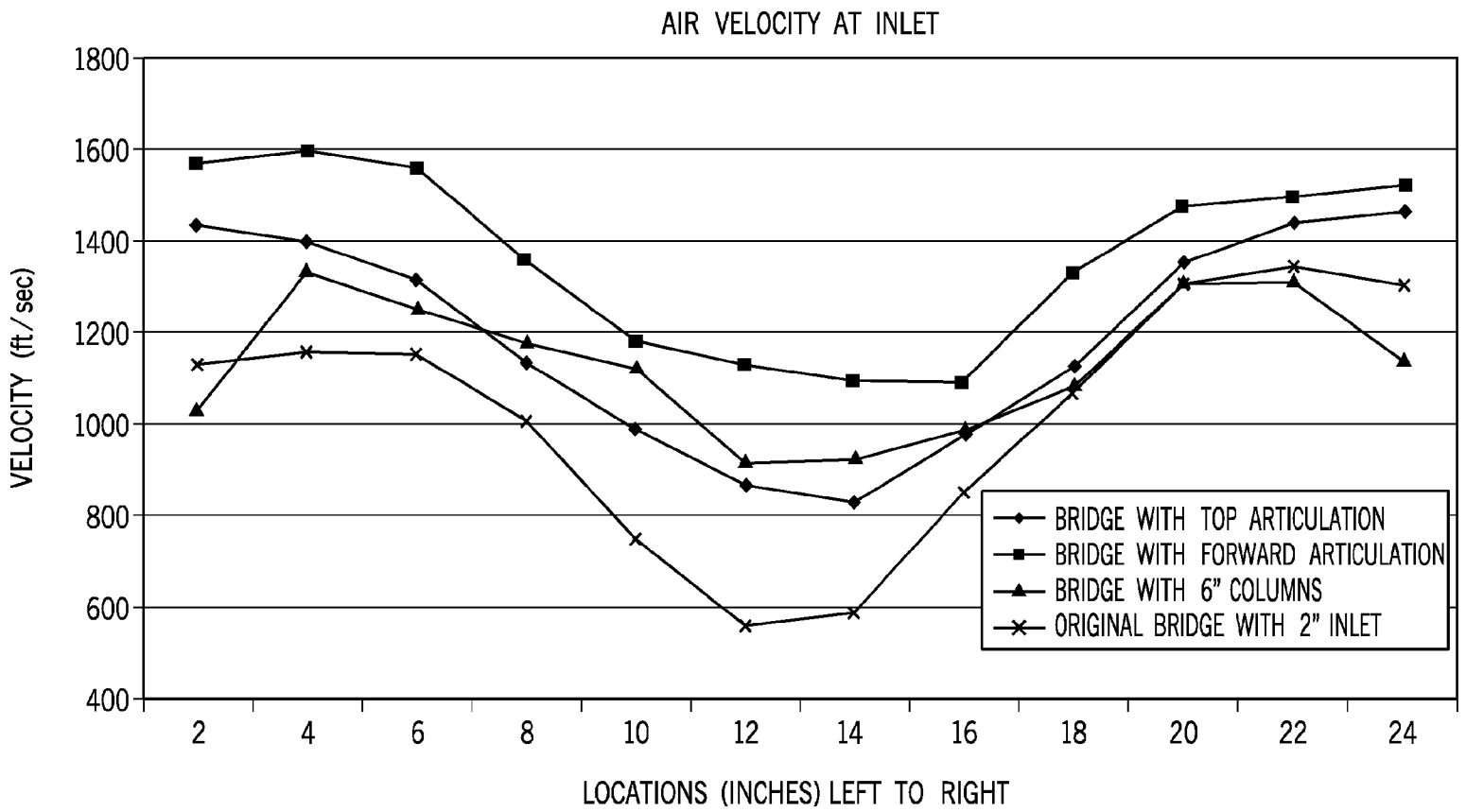
FIG. 17 is a graph depicting fluid intake velocity testing results.
Figure 18:
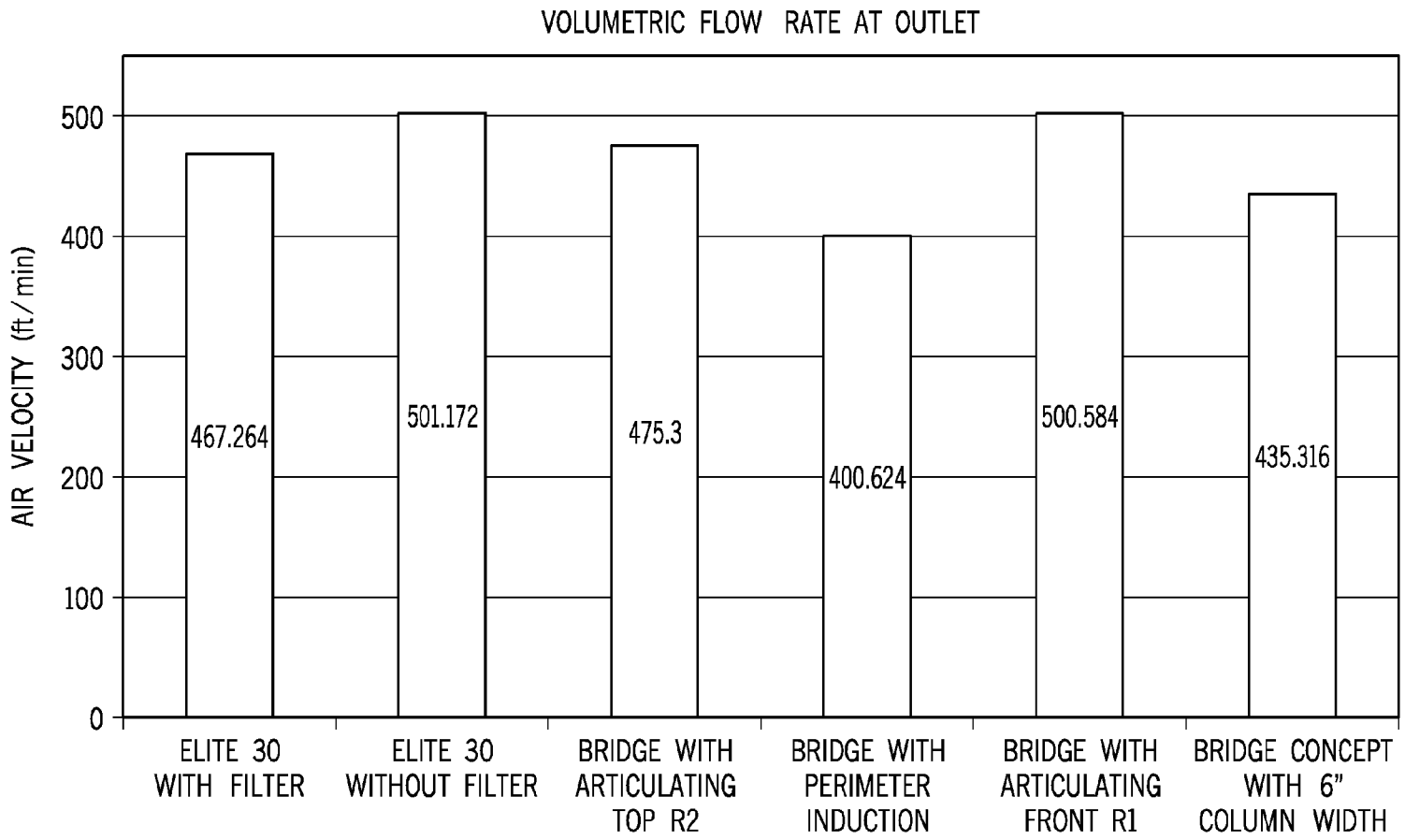
FIG. 18 is a graph depicting fluid flow rate testing results.
Figure 19:
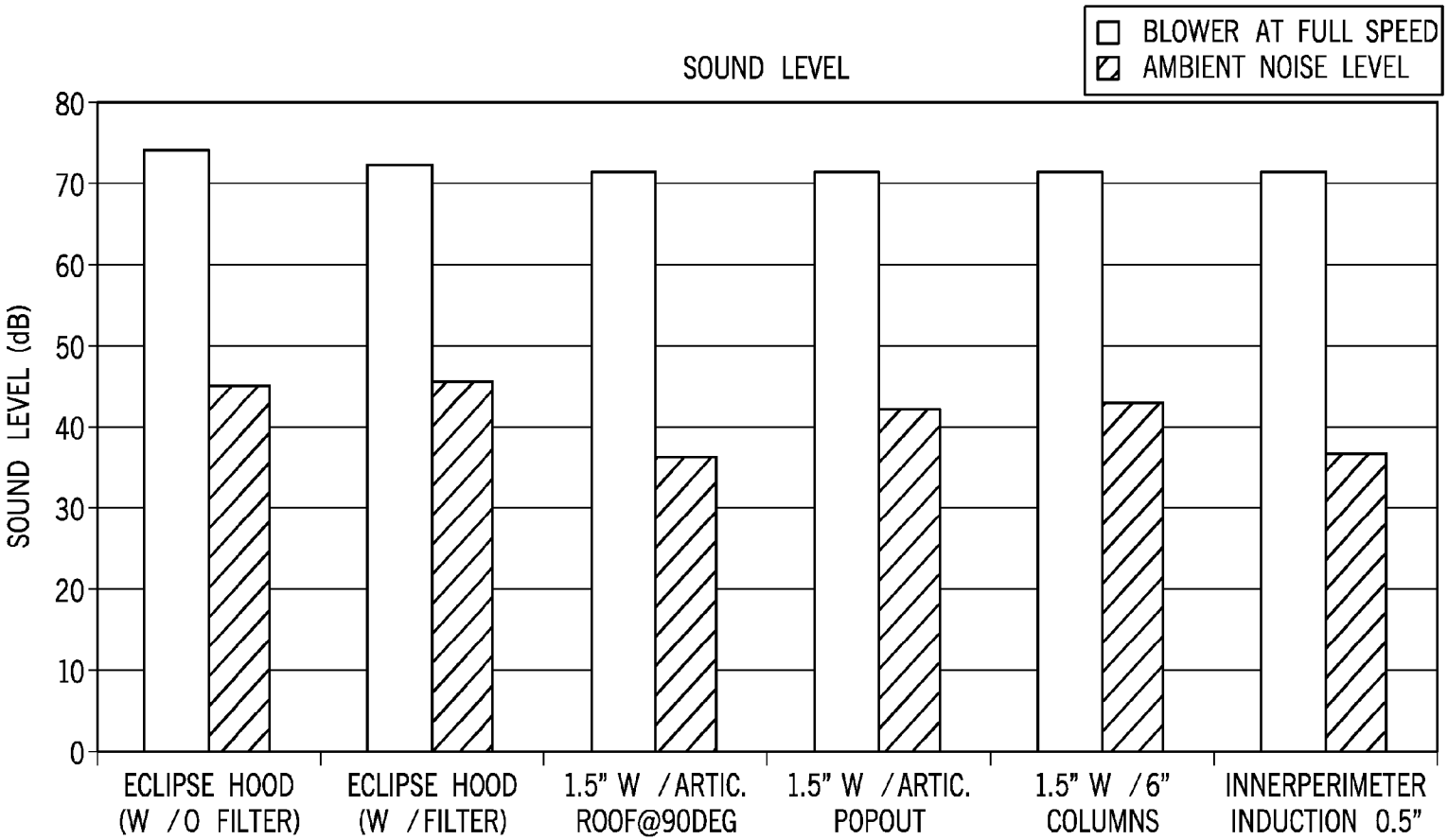
FIG. 19 is a graph depicting auditory output testing results.

Further, in some embodiments, the configuration of the visor 25 can be optimized to provide the greatest possible fluid intake velocity, while not significantly affecting fluid flow rate. As shown in FIG. 17, the downdraft system 10 comprising different configurations of the visor 25 can exhibit different fluid intake velocities. For example, downdraft systems 10 comprising a visor 25 that generally pivots in a forward direction can intake fluids at a greater velocity than downdraft systems 10 without that configuration, as shown in FIG. 17. Moreover, as shown in FIG. 18, fluid flow rates for downdraft systems 10 comprising a visor 25 can exceed the rates of other configurations. Furthermore, as shown in FIG. 19, the auditory output can be substantially similar among the different conditions. Accordingly, differently configured downdraft systems 10, including different visor 25 configurations, can be used to meet different end user needs.

Figure 20A:
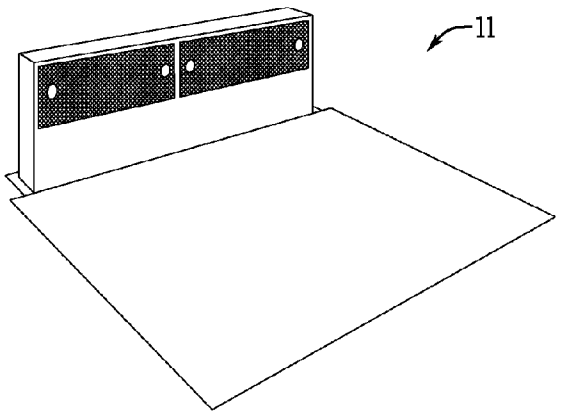
FIG. 20A is an image of portions of a conventional downdraft system in accordance with some embodiments of the invention.
Figure 20B:
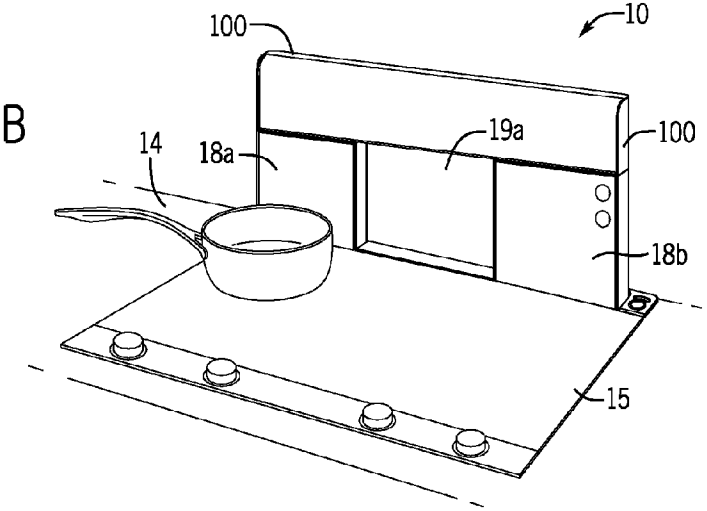
FIG. 20B is an image of portions of a downdraft system according to some embodiments of the invention.

In some embodiments, the chimney 100 can comprise multiple configurations. For example, as shown in FIG. 20B, relative to a conventional downdraft system shown in FIG. 20A, some embodiments of the invention can provide for an improved functional structural configuration. For example, as shown in FIG. 20A, some conventional configurations can comprise configurations that can impede lines of sight when the chimney is fully extended.

In some embodiments of the invention, the central region of the chimney 100 can comprise an open configuration. For example, as shown in FIG. 20B, in some embodiments, the central region 19*a* can comprise an aperture or other void or structure that can be substantially or completely transparent. As a result, some lines of sight are not completely blocked, which can be an improvement over some conventional configurations (as depicted in FIG. 20A for example). In some embodiments, the central region 19*a* can comprise multiple configurations. For example, in some embodiments, the central region 19*a* can comprise a material that is substantially translucent or transparent (e.g., glass or frosted glass) or can comprise an opaque material (e.g., stainless steel). Moreover, in some embodiments, the central region 19*a* can comprise the material covering only a portion of the central region 19*a* (e.g., a piece of glass positioned between the column regions 18*a*, 18*b* that only extends a portion of a length of the central region 19*a* and couples to only a partial length of the perimeter region 19*c*).

Figure 21A:
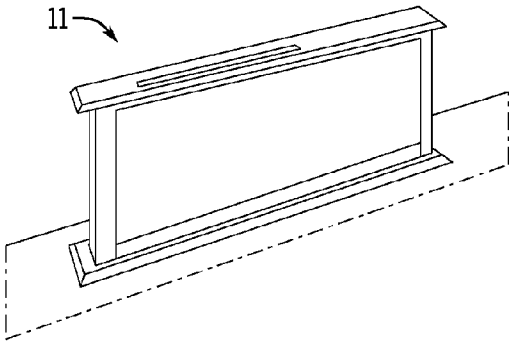
FIG. 21A is an image of portions of a conventional downdraft system.

In some embodiments, the chimney 100 can comprise an illumination device 35. In some embodiments, the illumination device 35 can be configured as a cooking surface task lighting device 35. In some embodiments, the illumination device 35 can be function as a more effective illumination system relative to some conventional downdraft systems. As shown in FIG. 21A, some conventional downdraft systems can comprise illumination devices 35 positioned at a top of the chimney. The conventional illumination devices can provide limited lighting for the adjacent cooking areas because of their positioning at the chimney 100 and because the illumination devices are generally directed upward, away from the cooking area.

In some embodiments, a downdraft system 10 can include the one or more illumination devices 35 configured and arranged to provide lighting to a at least partially illuminate a cooktop 15. In some embodiments, the one or more illumination devices 35 can be configured and arranged to provide lighting to an area immediately adjacent to a cooktop 15. In some embodiments, at least one illumination device 35 is coupled to a conventional control system (not shown), and at least one user interface 50 and at least one control panel 55, 58. In some embodiments, one or more illumination devices 35 provide fixed illumination intensity to a cooktop 15. In some other embodiments, the illumination intensity of the illumination devices 35 can be varied to provide variable illumination intensity to a cooktop 15. In some embodiments, the illumination devices 35 can comprise one or more incandescent lamps. In other embodiments, the illumination devices 35 can comprise at least one fluorescent lighting source, or one or more light-emitting diodes. In some embodiments, other lighting sources can be used.

Figure 21B:
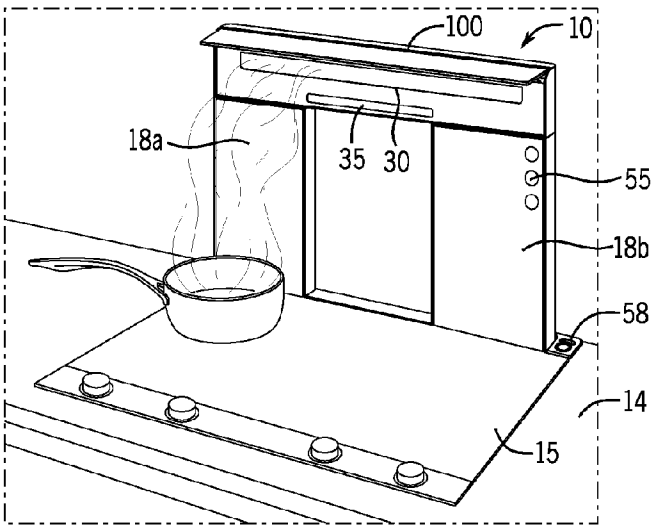
FIG. 21B is an image of portions of a downdraft system according to some embodiments of the invention.
Figure 21C:
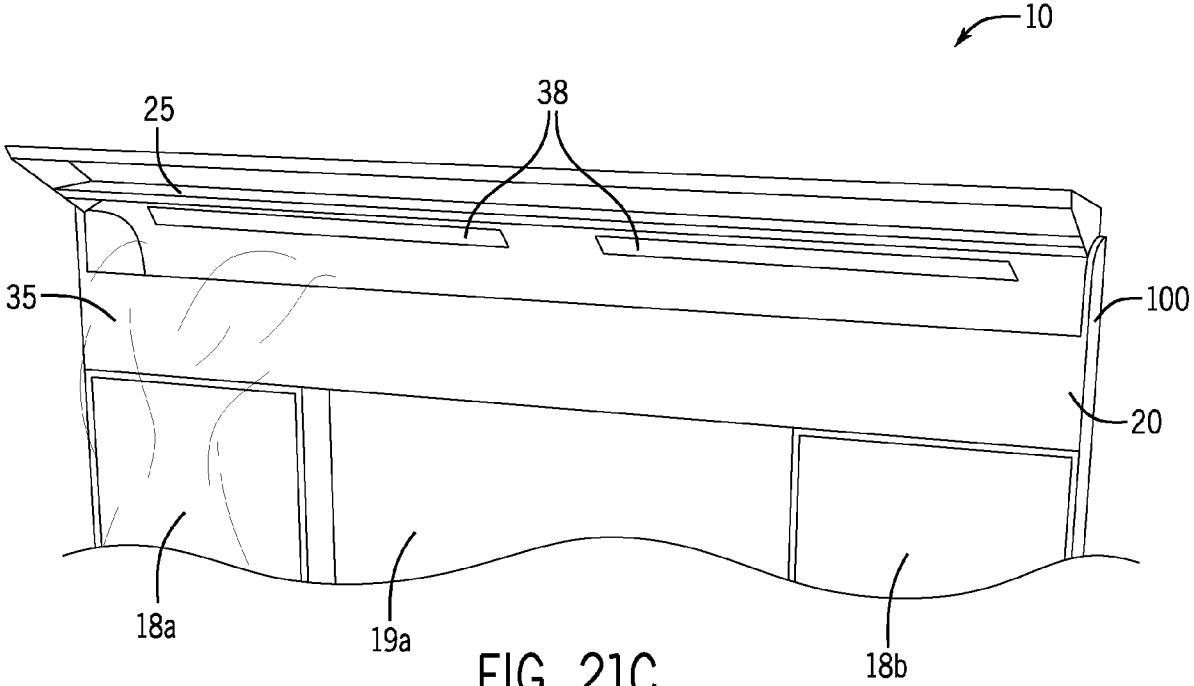
FIG. 21C is an image of portions of a downdraft system showing an illumination system according to some embodiments of the invention.

Some embodiments of the invention can provide improved illumination capabilities relative to the conventional systems. As shown in FIG. 21B, in some embodiments, the illumination device 35 can be positioned at an upper portion of the central region 19*a* (substantially coupled at the perimeter region 19*c*) so that at least a portion of the illumination radiated by the illumination device 35 can be directed toward the cooking area 14. Moreover, as previously mentioned, the illumination provided by some embodiments of the invention can be further enhanced because of the greater height of the downdraft system 10 (i.e. greater amounts of illumination can reach the cooking area 14 because of the greater height of the chimney 100). As shown in FIG. 21C which illustrates an image of portions of a downdraft system 10 showing an illumination system, in some embodiments, the illumination device 35 can be positioned at an upper portion of the substantially horizontal member 20 (adjacent to the visor 25) so that at least a portion of the illumination radiated by the illumination device 35 can be directed toward the cooking area 14. Here again, as previously mentioned, the illumination provided by some embodiments of the invention can be further enhanced because of the greater height of the downdraft system 10. Furthermore, as illustrated in FIG. 21C, in some embodiments, the one or more illumination devices 35 can be angled so as to direct a greater proportion of the emitted light to the cooktop 15. Moreover, in some embodiments, one or more of the illumination devices 35 can include a lens 38 configured and arranged to focus a greater proportion of the emitted light to the cooktop 15. In some embodiments, one or more of the illumination devices 35 can include a plurality of lenses 38. In some embodiments, one or more of the illumination devices 35 can include a plurality of lenses 38 configured and arranged to focus a greater proportion of the emitted light in substantially one direction. In some embodiments, one or more of the illumination devices 35 can include a plurality of lenses 38 configured and arranged to focus a greater proportion of the emitted light in a plurality of directions. In some other embodiments, one or more of the illumination devices 35 can include a plurality of lenses 38 configured and arranged to focus a greater proportion of the emitted light to substantially one region of the cooktop 15. In some further embodiments, one or more of the illumination devices 35 can include a plurality of lenses 38 configured and arranged to focus a greater proportion of the emitted light in a plurality of regions of the cooktop 15. Moreover, in some embodiments, the central region 19*a* can comprise one or more illumination devices 35 that can illuminate the material positioned in the central region 19*a*. For example, in some embodiments, one or more glass members can be positioned within or coupled to the central region 19*a* and the illumination devices 35 (e.g., light-emitting diodes or any other conventional illumination sources) can disperse at least some illumination toward the glass so that the glass is at least partially illuminated by the devices 35. Moreover, in some embodiments, the illumination devices 35 can be coupled to a portion of the glass and/or the central region 19*a* (e.g., disposed around at least a portion of a periphery or edges of the glass). As a result, the illuminated glass pieces can provide task lighting and/or decorative lighting for the user. Moreover, in some embodiments, the glass can comprise a brand or logo marking that has been positioned to be illuminated by the illumination provided by the illumination device 35 (e.g., the brand or logo can be etched into a surface of the glass).

Figure 21E:
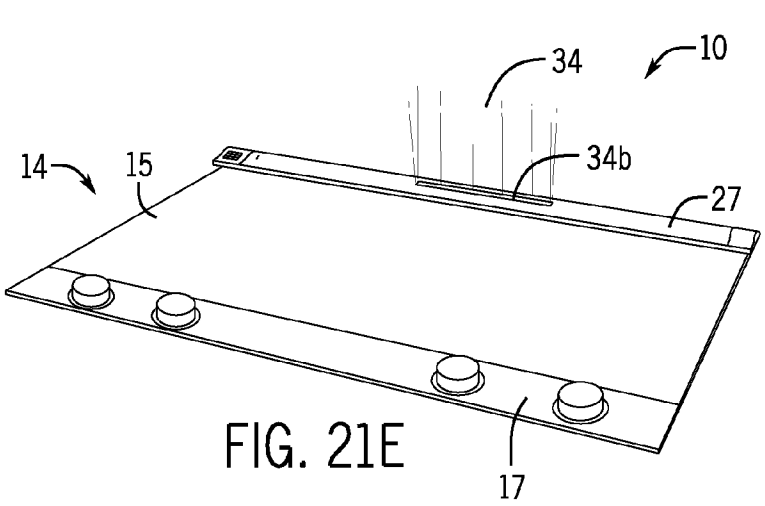
FIGS. 21D-F show images of a lowered downdraft system showing various embodiments of an ambient light illumination source according to some embodiments of the invention.
Figure 21D:
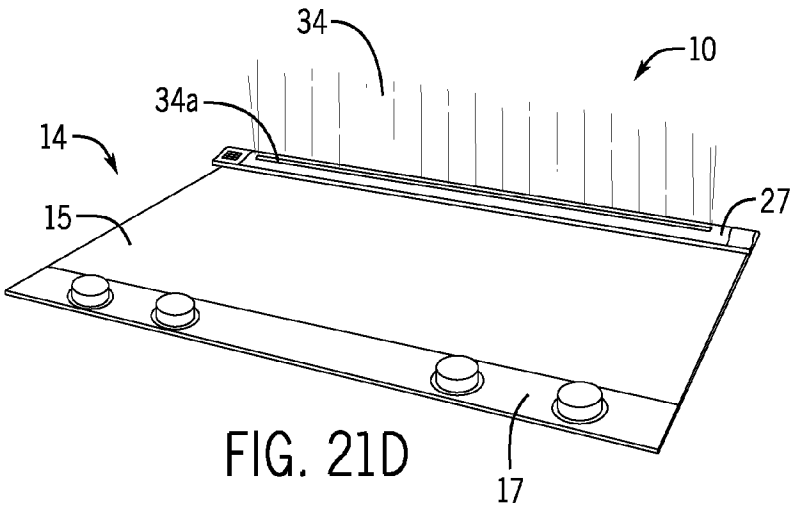
Figure 21F:
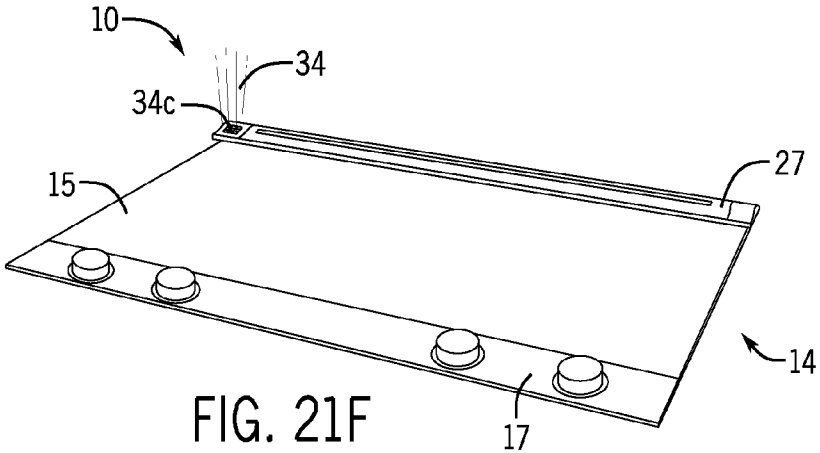

FIGS. 21D-F shows images of a lowered downdraft system 10 showing various embodiments of an ambient light illumination source 34 according to some embodiments of the invention. As shown, in some embodiments, the downdraft system 10 can provide an ambient illumination 34 to at least some portion of the cooktop 15 and a least some portion of the cooking area 14. FIG. 21D for example shows a lowered downdraft system 10 showing an ambient light 34*a* configured and arranged to at least partially illuminate a wall 16. FIG. 21E for example shows a lowered downdraft system 10 showing an ambient light 34*b* configured and arranged to at least partially illuminate the cooktop 15. FIG. 21F for example shows a lowered downdraft system 10 showing an ambient light 34*c* that is configured and arranged as a night light coupled with the bezel 27. In some other embodiments, the downdraft system 10 can include various alternative embodiments of an ambient light illumination source 34. For example, some embodiments may include a combination of one or more of the ambient light illumination source 34 embodiments illustrated in FIGS. 21D-F.

Figure 22B:
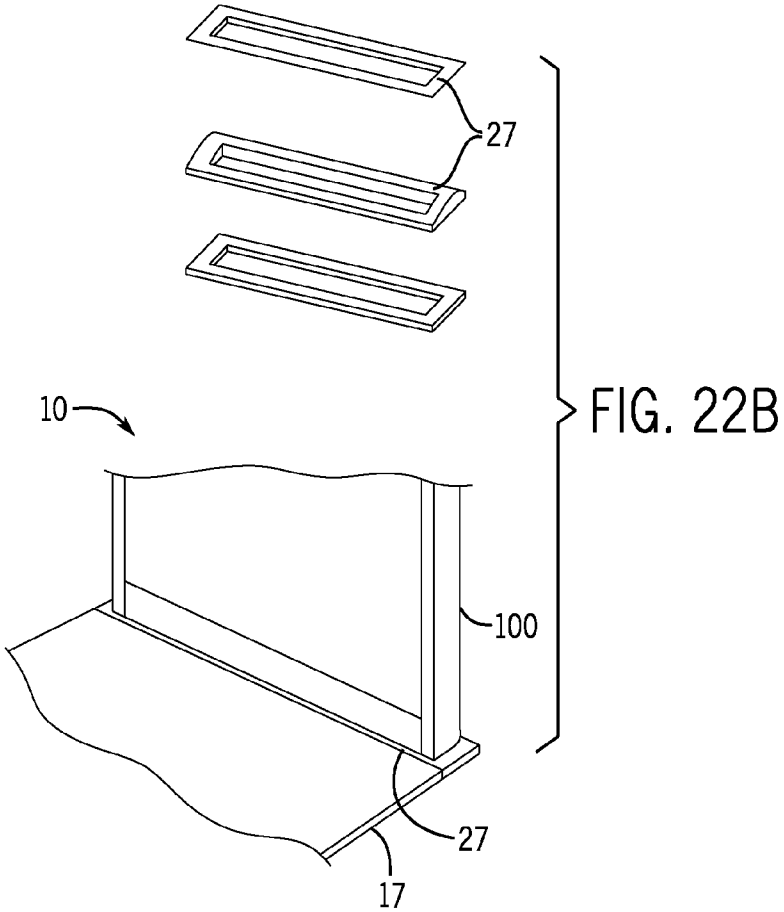
FIG. 22B is an image of portions of a downdraft system according to some embodiments of the invention.
Figure 22A:
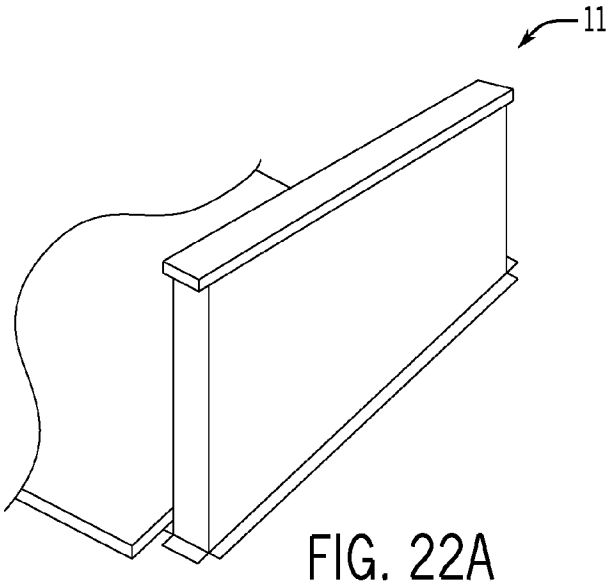
FIG. 22A is an image of portions of a conventional downdraft system.
Figure 22C:
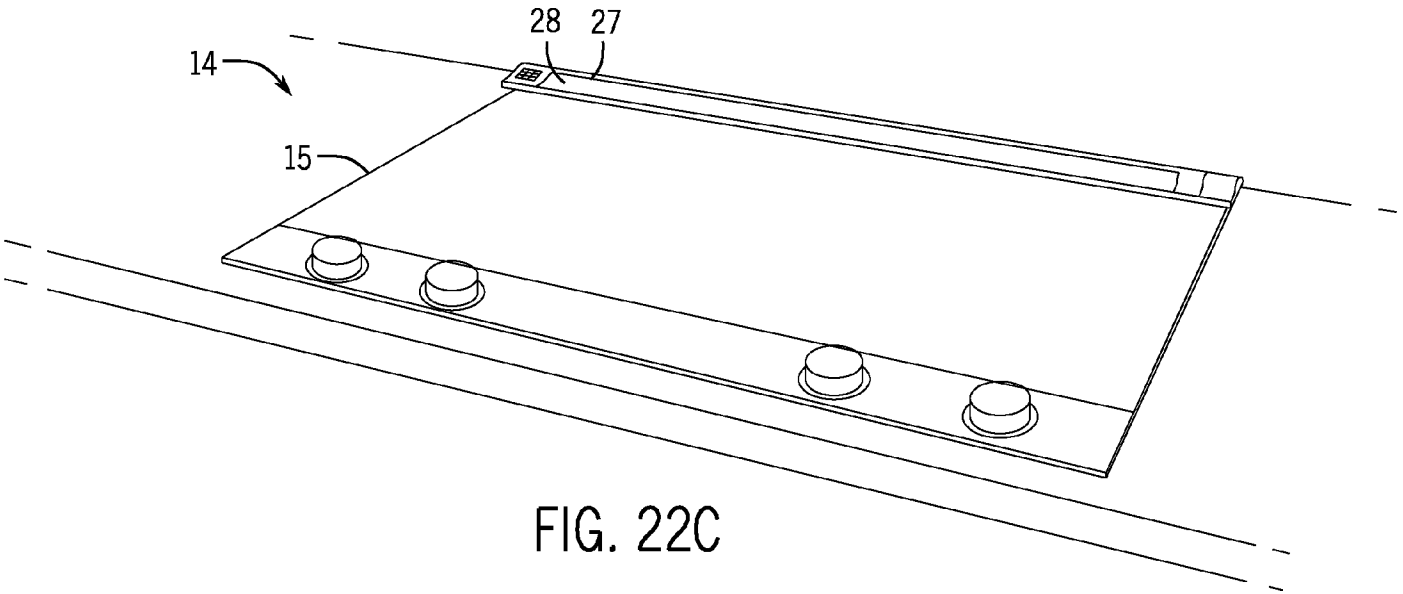
FIG. 22C is an image of a downdraft system with trap door in the down position in accordance with some embodiments of the invention.
Figure 22D:
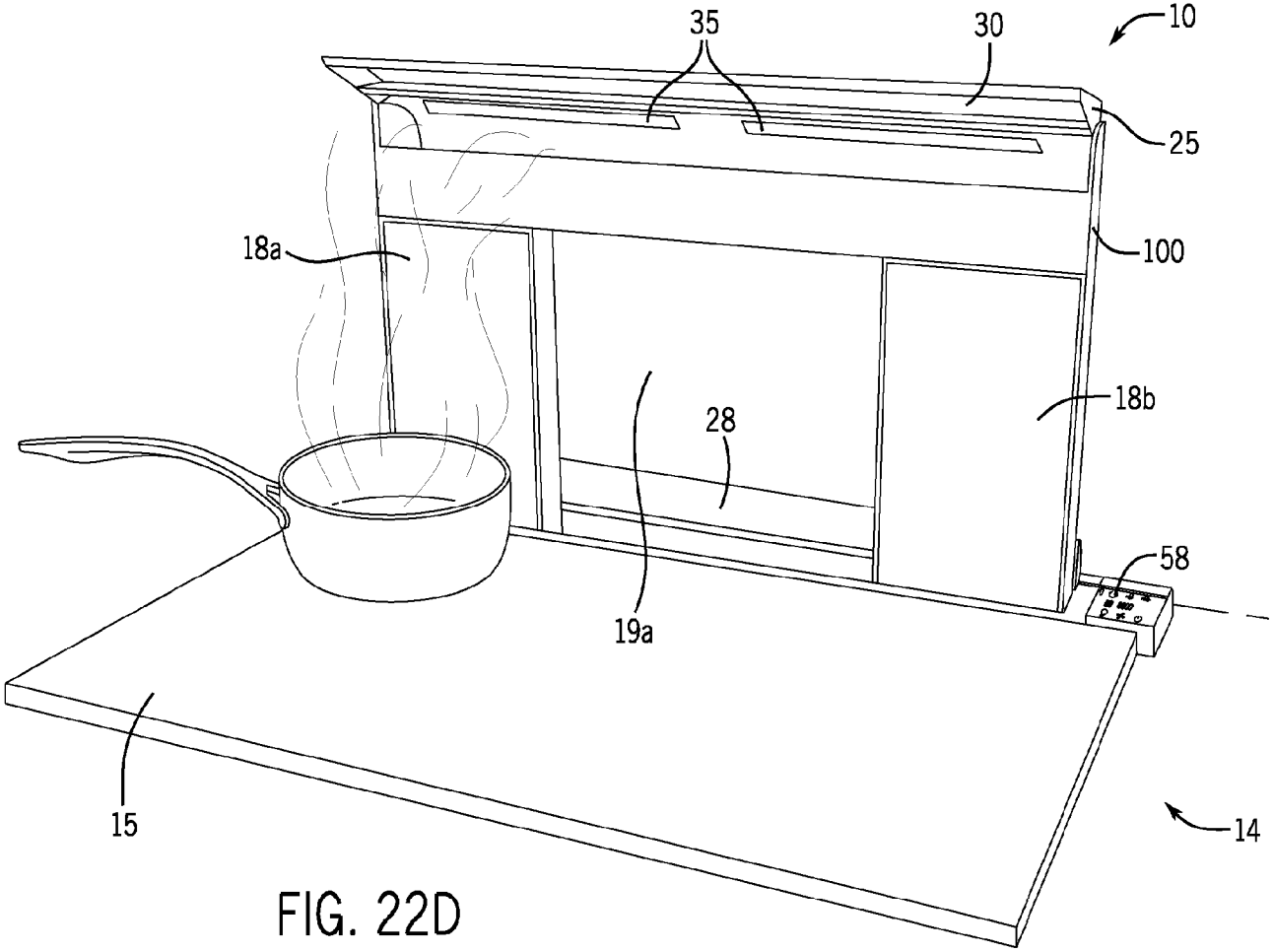
FIG. 22D is an image of a downdraft system with trap door in the up position in accordance with some embodiments of the invention.

In some embodiments, the downdraft system 10 can comprise other improvements relative to some conventional downdraft systems. As shown in FIG. 22A, some conventional downdraft systems can comprise mounting brackets that extend into the cooking area. These mounting brackets can be important to retain the conventional downdraft system in position before, during, and after operations. By extending into the cooking area 14, the conventional brackets can reduce available useful space and can be generally unsightly. Conversely, in some embodiments of the invention, the downdraft system 10 can comprise a bezel 27 that can be configured and arranged to couple to the downdraft system 10 on the counter surface level 17. As shown in FIG. 22B and FIG. 22C, the bezel 27 can be coupled to the counter 17 so that when the chimney 100 is not in use and is at least partially disposed under the counter surface level 17, the bezel 27 can be pivoted, functioning as a "trap door" that can substantially or completely cover the top of the chimney 100 so that chimney 100 is hidden from sight (see FIG. 22C). As shown in FIG. 22B, the bezel 27 can comprise multiple configurations and can comprise a trap door 28 that can pivot in any one of a plurality of directions. FIG. 22D is an image of a downdraft system 10 with trap door 28 in the up position in accordance with some embodiments of the invention. In some embodiments, the trap door 28 (bezel 27) can comprise stainless steel. In some further embodiments, the trap door 28 (bezel 27) can comprise a painted metal. In some other embodiments, the trap door 28 (bezel 27) can comprise a non-metal such as a glass. In some other embodiments, trap door 28 (bezel 27) can comprise a material substantially identical to the cooktop 15.

Figure 23A:
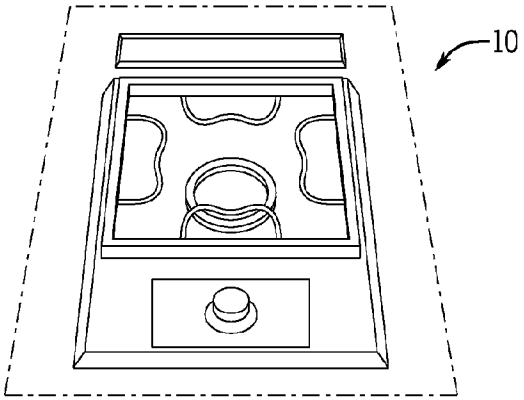
FIGS. 23A-B show images of cooktop areas and downdraft systems according to some embodiments of the invention.
Figure 23B:
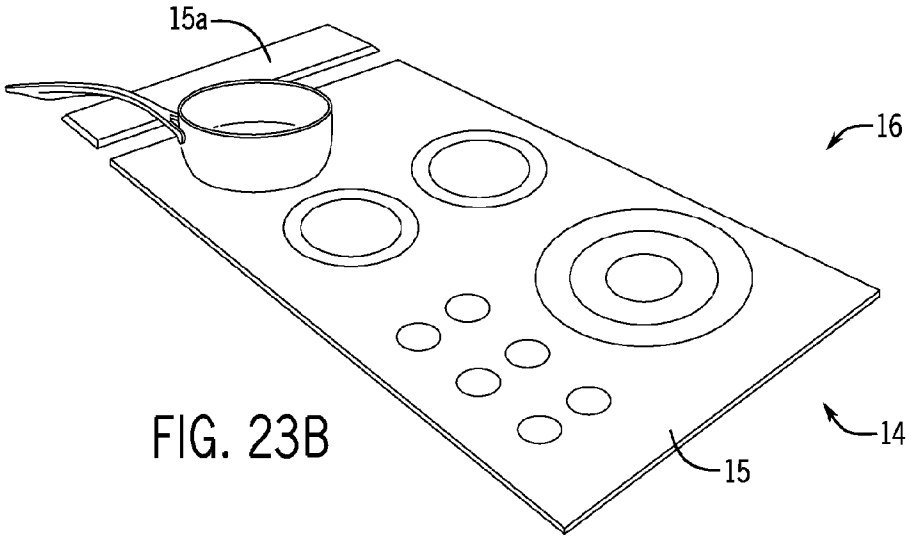

According to some embodiments of the invention, the downdraft system 10 can be used with different cooking arrangements. As shown in FIG. 23A, some cooking areas can be configured for a single cooking vessel, such as a fifteen inch cooking module. In some embodiments, the downdraft system can comprise a width (e.g., about fifteen inches wide) so that the downdraft system 10 can be installed for use with cooking areas of different sizes. As a result, the downdraft system 10 of the appropriate size can be selected based on the cooking area that needs ventilation. Moreover, in some embodiments, a pre-existing cooking area can comprise a configuration that can preclude the use of some conventionally-sized downdraft systems. As shown in FIG. 23B, some cooktops 15 can be installed immediately adjacent to a wall 16 or other structure so that a conventional downdraft system cannot fit in the space between the wall and the cooktop 15. In some embodiments, a downdraft system 10 comprising a non-conventionally sized chimney (e.g., approximately eighteen to twenty inches wide) can be installed immediately adjacent to a lateral side (shown as the region 15*a* of the cooktop 15) so that the cooktop 15 can be properly ventilated, without the need for the downdraft system 10 to be installed between the cooktop 15 and the wall 16. As a result, downdraft systems of multiple widths can enable use under multiple circumstances.

Figure 24:
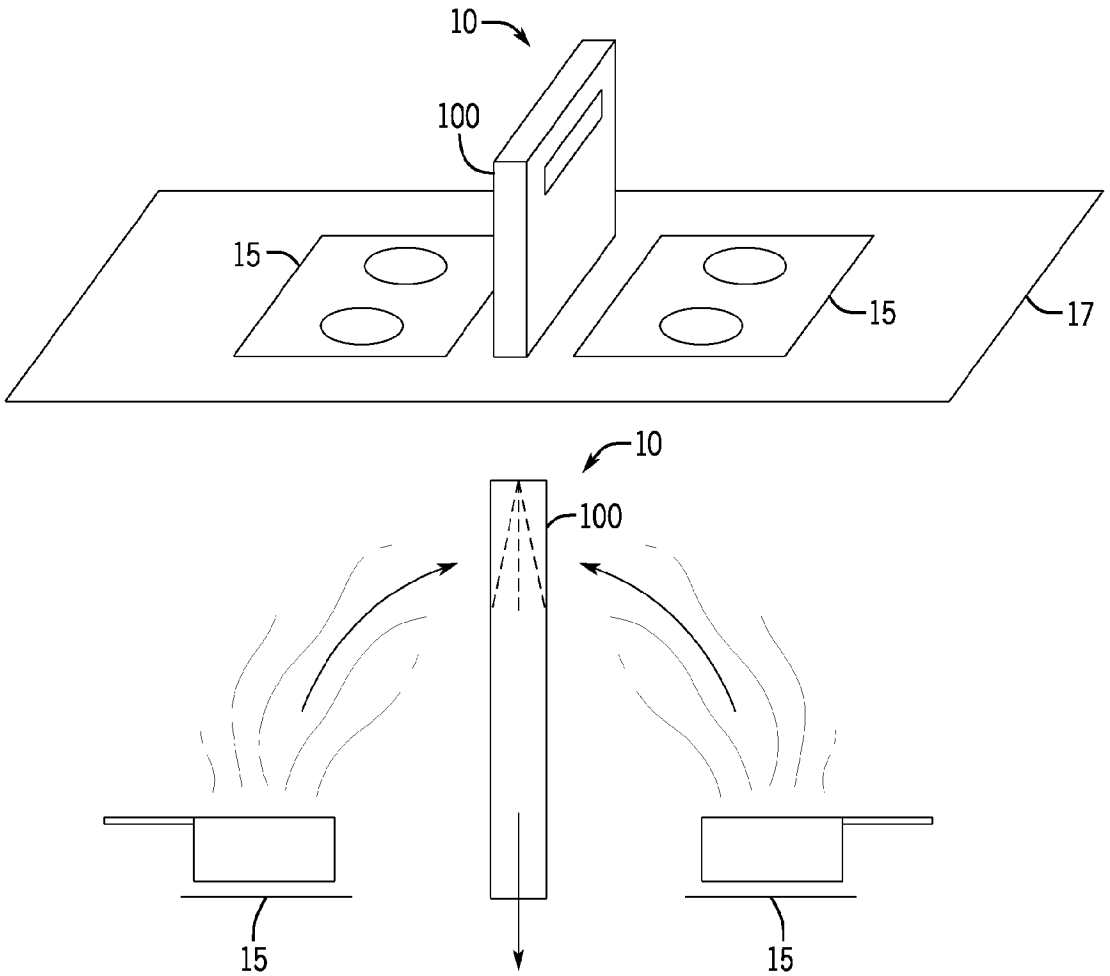
FIG. 24 is a series of diagrams illustrating installation of a downdraft system according to some embodiments of the invention.

Moreover, as shown in FIG. 24, in some embodiments, the downdraft system 10 can be installed between two or more cooktops 15. By way of example only, in some embodiments, the downdraft system 10 can be installed so that the chimney 100 can extend from the counter surface 17 at a position between at least two cooking modules 15 (e.g., fifteen inch cooking modules). In some embodiments, the chimney 100 can comprise two or more visors 25 disposed on each side of the chimney 100 adjacent to the cooking modules 15 disposed on opposite sides of the downdraft system 10. As a result, in some embodiments, the visor 25 can be moved so that cooking effluent or other fluids can be exhausted from one or both of the cooking modules 15. For example, if a user is employing one of the cooking modules 15, the visor 25 on the side of the chimney 100 adjacent to the active cooking module 15 can be at least partially moved to enable intake of some or all cooking effluent. Moreover, in some embodiments, if both cooking modules 15 are being used, the visors 25 on the sides of the chimney 100 can be at least partially opened to enable intake of some or all cooking effluent.

As previously mentioned, in some embodiments, the chimney 100 can operate without a visor 25. Accordingly, in some embodiments, the chimney 100 can comprise an internal shutter or visor 25 within the fluid flow path substantially adjacent to the one or more inlets 30. In some embodiments, the internal shutter or visor can operate in a manner substantially similar to the visor 25 (e.g., moving to enable fluid flow through the one or more inlets. For example, if a user is employing one of the cooking modules 15, the internal shutter or visor 25 on the side of the chimney 100 adjacent to the active cooking module 15 can be at least partially moved to enable intake of some or all cooking effluent. Moreover, in some embodiments, if both cooking modules 15 are being used, the internal shutter or visors 25 can be at least partially opened to enable intake of some or all cooking effluent.

Figure 25:
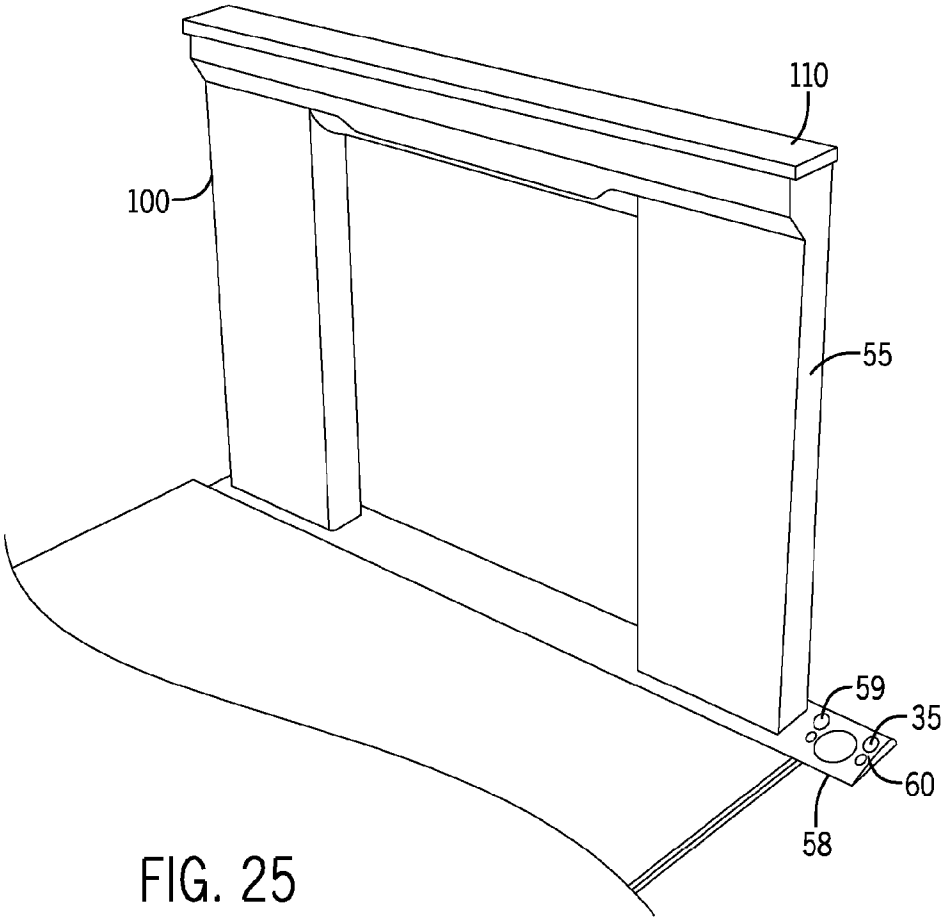
FIG. 25 is a perspective view of a downdraft system according to some embodiments of the invention.
Figure 26A:
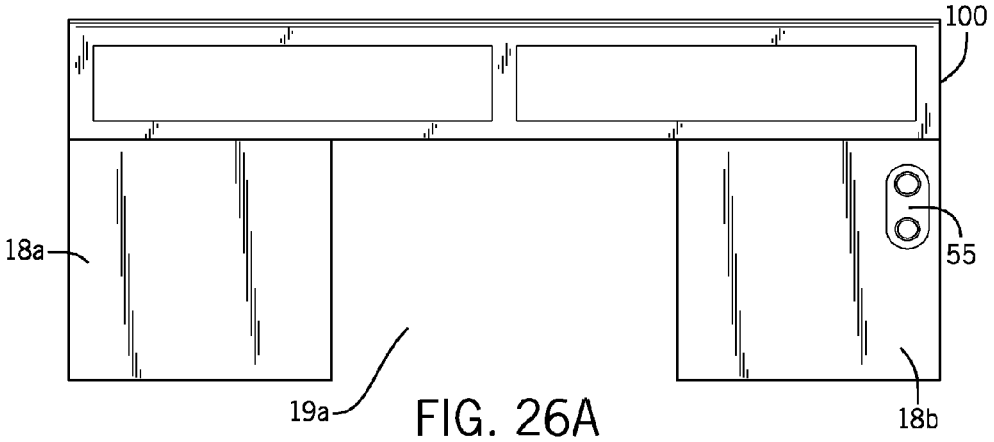
FIGS. 26A-26I illustrates a series of images of differently configured chimneys according to some embodiments of the invention.
Figure 26B:
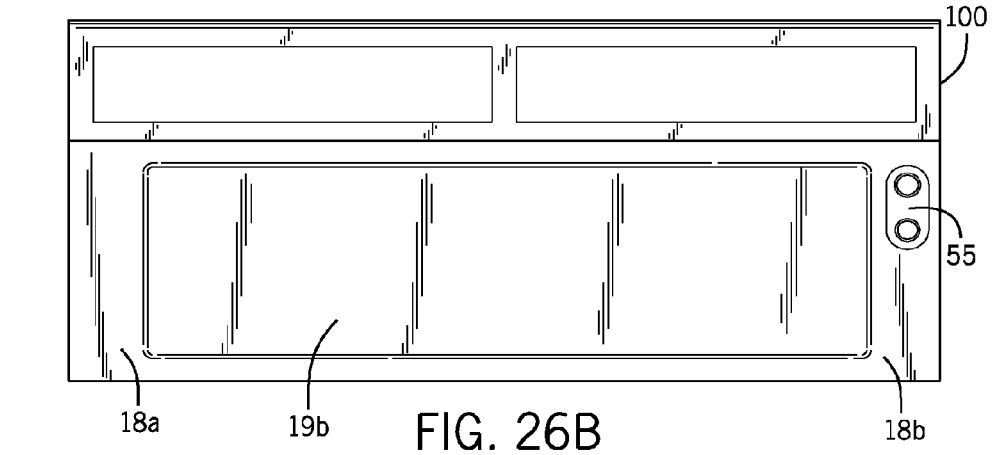
Figure 26C:
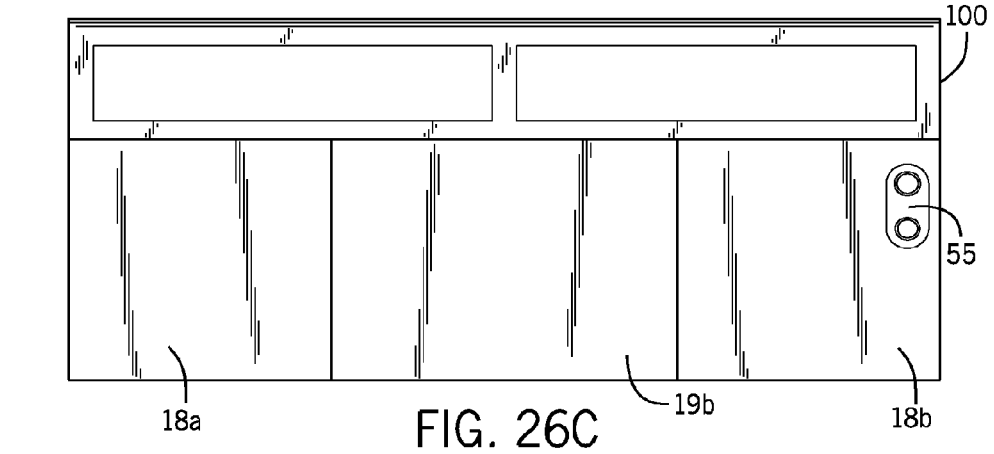
Figure 26D:
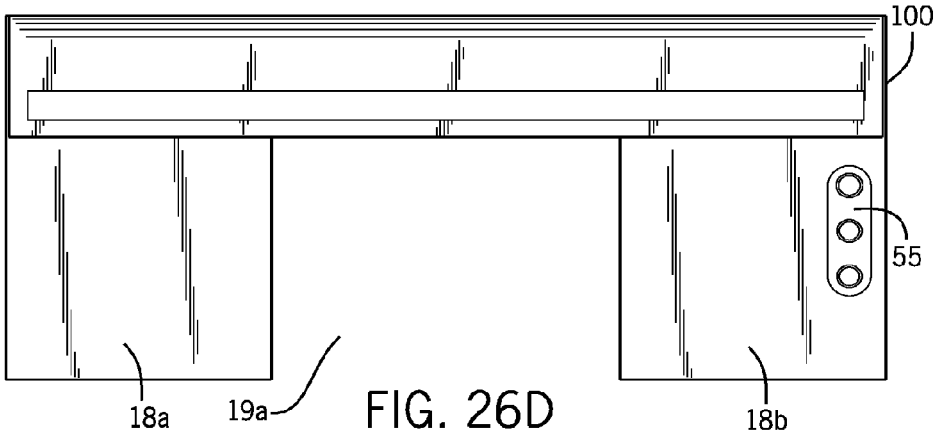
Figure 26E:
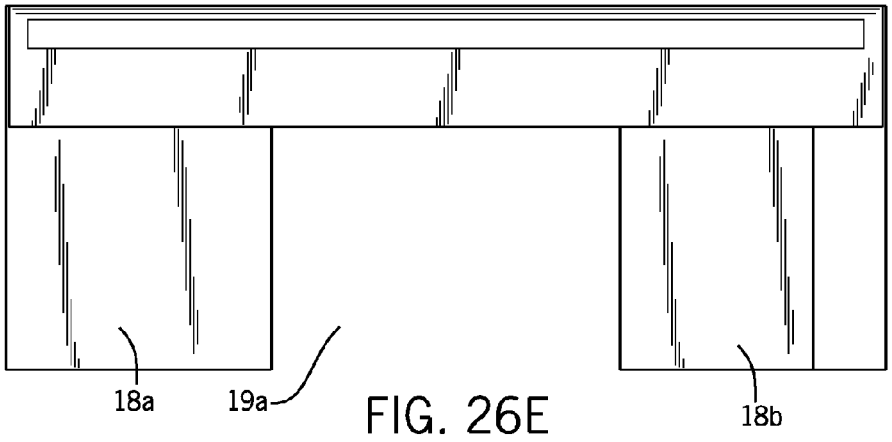
Figure 26F:
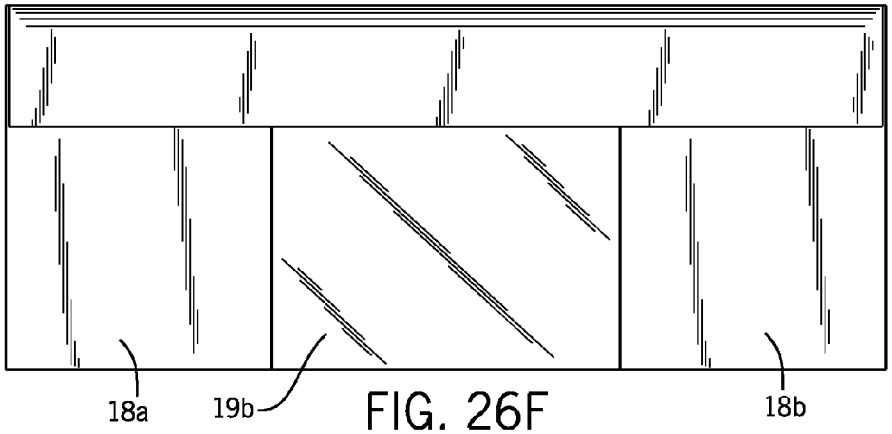
Figure 26G:
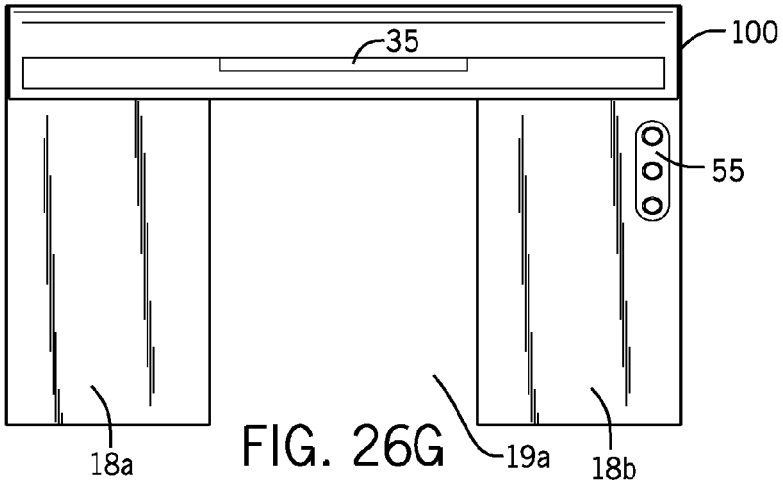
Figure 26H:
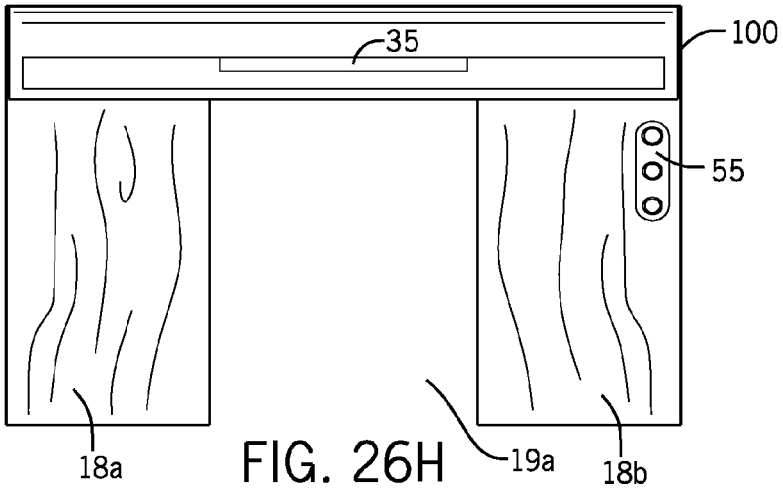
Figure 26I:
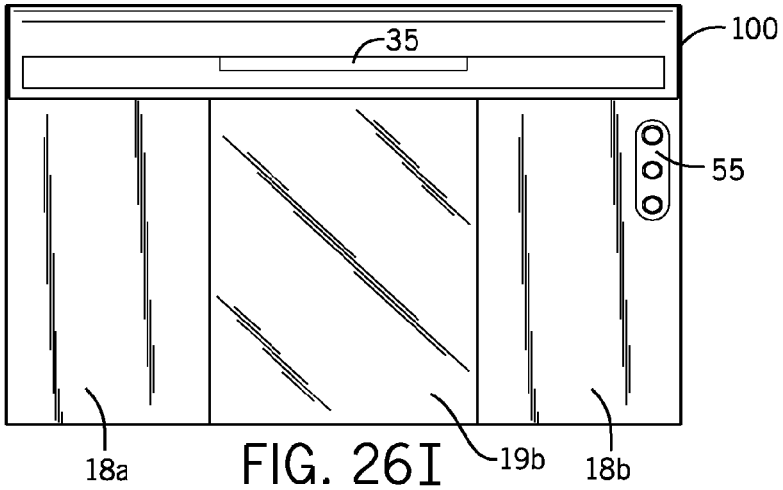

In some embodiments, the downdraft system 10 can comprise one or more control panels 55, 58. For example, as shown in FIG. 25, in some embodiments, the chimney 100 can comprise a second control panel 55 (capable of vertical movement with the chimney) and a first control panel 58 that can be coupled to or integral with the fluid box housing and with the bezel 27, and which remains substantially stationary when the chimney is move vertically. In some embodiments, the first control panel 58 can comprise one or more buttons or other control features 60 that a user can employ to raise and lower the chimney 100, and in some embodiments, can include one or more indicators 59. For example, before, after, or during a cooking episode, a user can actuate the button 60 to raise or lower the chimney 100 to ventilate some or all of the effluent generated by the cooking episode. Also, in some embodiments, the first control panel 58 can comprise one or more illumination devices 35 that can operate (e.g., automatically or manually) when the local area is devoid of some or all light (e.g., the illumination device of the first control panel 58 can operate as a night light). In some embodiments, the control panels 55, 58 can be positioned to enable ease of use. For example, in some embodiments, the control panels 55, 58 can be positioned so that the user does not have to reach across some or all of the cooktop 15 so that the risk potential injury to the user (e.g., burns from cooking episodes) can be reduced or eliminated. Moreover, in some embodiments, one of or both of the control panels 55, 58 can be voice activated and/or capable of communicating with a remote control unit (e.g., mobile or stationary remote control unit) capable of being used by the user to control downdraft system 10 operations.

In some embodiments, the second control panel 55 can comprise buttons, dials, or other elements 60 coupled or integrated with the at least some portion of the chimney (for example, coupled to or integrated with the first vertical region 18*a*, the second vertical region 18*b*, or the central region 19*b*). In some embodiments, the second control panel 55 can comprise buttons, dials, or other elements 60 that are configured and arranged to control the ventilation and illumination capabilities of the downdraft system 10. For example, in some embodiments, the buttons 60 can comprise the ability to control the raising or lowering of the chimney 100, the ventilation assembly (i.e., control activation and deactivation and/or multiple operational speeds of the ventilation assembly), the illumination systems 35, and can also provide feedback to the user. For example, in some embodiments where the downdraft system 10 comprises a conventional filter, the second control panel 55 can comprise one or more indicators 56 that can provide an indication of whether the filter needs to be cleaned and/or replaced. Moreover, in some embodiments, the second control panel 55 can also include an indicator 56 reflecting the thermal conditions adjacent to the chimney 100 (e.g., the indicator 56 can provide an indication of when too much thermal energy is detected). In some embodiments, the buttons 60 can comprise electromechanical switches, and in other embodiments, the buttons, dials, or other elements can comprise rear-mounted capacitive controls that can be touch activated.

As shown in FIGS. 26A-I, in some embodiments, the downdraft system 10 can comprise multiple exteriors and one or more common internal components (e.g., fluid box, ventilation assembly, etc.). In some embodiments, the downdraft system 10 including the chimney 100 can comprise a substantially similar configuration internally (for example, the chimney housing 120 and internal walls 125, 125*a* can be the same), whereas at least some external components can be differently configured (including at least regions 18*a*, 18*b*, 19*a* or 19*b*) to provide chimneys to appeal to a wider group of end users. For example, as shown in FIG. 26A-I, the chimney 100 can comprise one of a plurality of configurations that can be configured to appeal to different end users (e.g., the different chimney 100 configurations can enable downdraft system price points, brand differentiation, and/or price-point differentiation).

Figure 27:
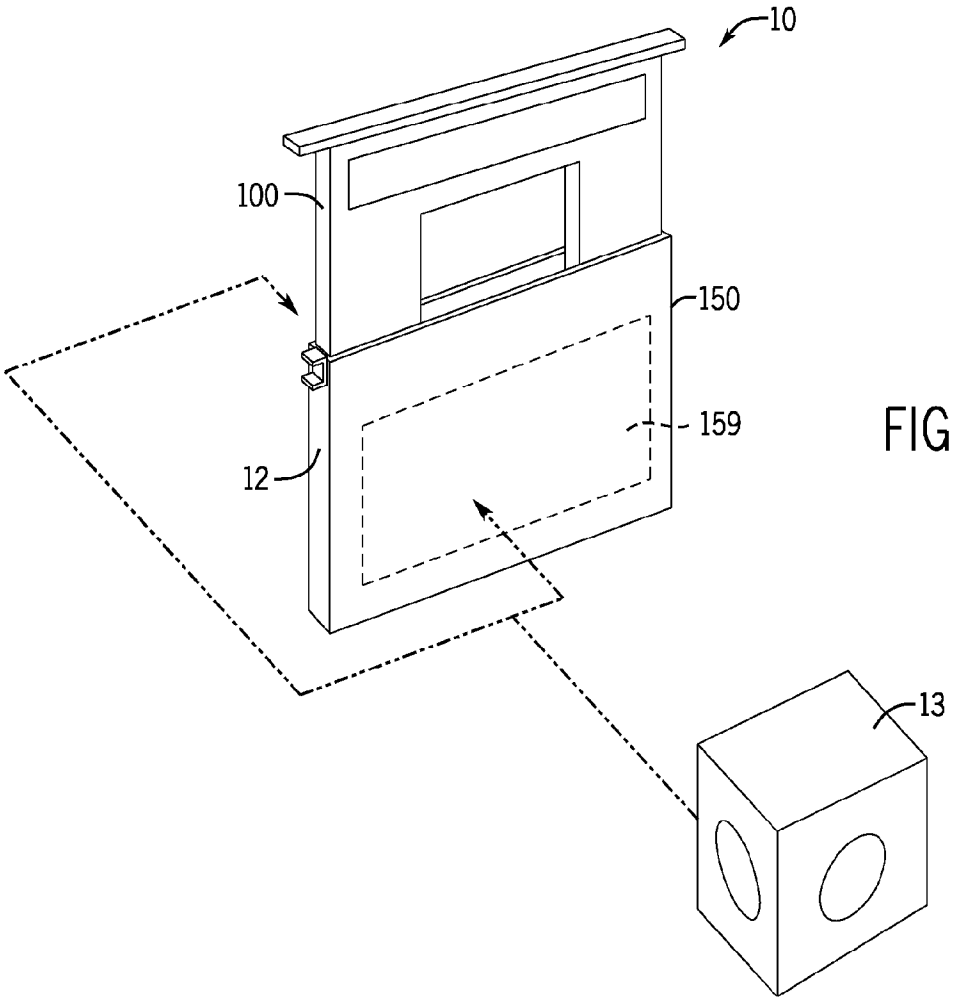
FIG. 27 is a series of images of a flexible ventilation assembly according to some embodiments of the invention.

In some embodiments, the downdraft system 10 can comprise conventional and/or alternative configurations. In some embodiments, the downdraft system 10 can comprise a substantially conventional configuration (for instance including the fluid box 150 and operable to generate fluid flow through the one or more inlets 30), as previously mentioned. In some embodiments, the downdraft system 10 can comprise alternative configurations. For example, as shown in FIG. 27, in some embodiments, the downdraft system 10 can comprise a flexible and/or modular configuration capable of accepting a variety of flexible ventilation systems (cube-like modules 13). In some embodiments, the downdraft system 10 can comprise one or more cube-like modules 13 that can be installed remotely relatively to other portions of the downdraft system 10. For example, in some embodiments, the flexible ventilation assembly modules 13 can be installed at any location within or adjacent to the structure (e.g., an attic, a crawl space, another cabinet, coupled to an outer wall of the structure, etc.) and the modules 13 can be in fluid communication with the other portions of the downdraft system 10. Moreover, in some embodiments, the one or more components of the downdraft system 10 (for example, the flexible ventilation assembly modules 13) can be coupled to an outer wall of the downdraft system support (for example, the fluid box housing 152). Further, although depicted comprising a substantially cube-like configuration that is about twelve inches in length and width, the flexible ventilation assembly modules 13 can comprise other shapes, configurations, and/or sizes that can be accommodated within or adjacent to the structure 12. The flexible ventilation assembly modules 13 can accept many types of conventional blower configurations (internal or external) with different operating parameters. When the conventional blower is attached to the system, a conventional control system will recognize what specific type of blower is attached through a conventional wire harness (pin configuration) or conventional logic on the control board (using for instance, current sensing, etc.). The downdraft system 10 can then adapt and calibrate to the correct operating parameters of the specific blower that is attached.

In some embodiments, at least some portions of the downdraft system 10 (e.g., the fluid box 150 and/or the support structure 12) can comprise one or more duct knock-out panels 159. For example, in some embodiments, some or all side panels of the support structure and/or the fluid box 150 can comprise the duct knock-out panels 159. In some embodiments, the knock-out panels 159 can be configured so that a user or installer can remove one or more of the knock-out panels 159 so that the flexible ventilation assembly module 13 can be fluidly connected to the downdraft system 10, regardless of where it is positioned. As a result, the downdraft system 10 can be installed in a variety of locations and in a variety of configurations, which can enable a user to employ the downdraft system 10 in different ventilating applications.

Figure 28A:
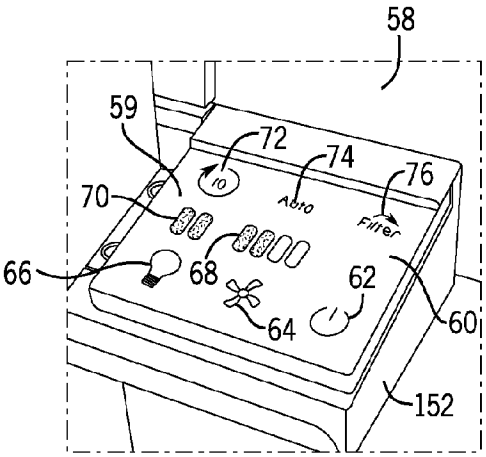
FIGS. 28A-C illustrate various user interface controls according to some embodiments of the invention.
Figure 28B:
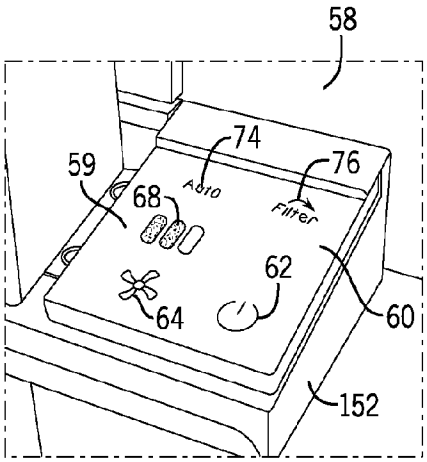
Figure 28C:
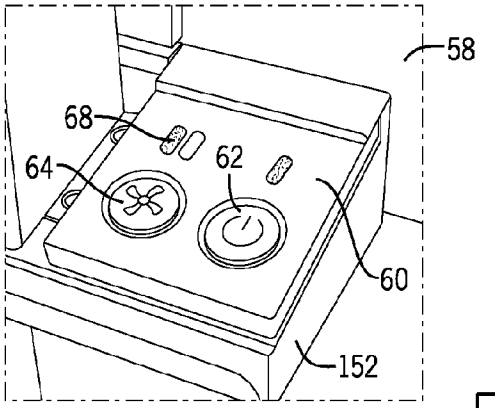

As described earlier, in some embodiments, the downdraft system 10 can comprise one or more control panels 55, 58. FIG. 25 shows for example that a first control panel 58 can be coupled to or integral with the bezel 27. In some embodiments, the first control panel 58 can comprise one or more buttons or other control features 60 that a user can employ to raise and lower the chimney 100. In some embodiments, the first control panel 58 can comprise buttons, dials, or other elements 60 that are configured and arranged to control the ventilation and illumination capabilities of the downdraft system 10. In some embodiments, the one or more control panels 55, 58 can comprise configurations, including various configurations of the buttons 60. For example, FIGS. 28A-C illustrate various user interface controls according to some embodiments of the invention. As shown in FIG. 28A, some embodiments of the invention include at least one user interface 50 including a first control panel 58. In some embodiments, the first control panel 58 can include one or more switches, buttons or other control features 60 located substantially on the user interface 50. In some embodiments, the switches or buttons 60 can comprise the ability to control a conventional ventilation assembly (i.e., control activation and deactivation and/or multiple operational speeds of a conventional ventilation fan within a conventional ventilation assembly). In some embodiments, the switches or buttons 60 can comprise the ability to control an illumination source 34, 35.

In some embodiments, at least one or more switches or buttons 60 can be actuated by a user. In some embodiments, a user can actuate at least one or more switch or buttons 60 by applying a force to at least some partial region of the user interface 50. For example, in some embodiments, the switches or buttons 60 can comprise electromechanical switches, buttons, such as 'push-buttons' (shown in FIG. 28C for example), toggles, or dials. In some other embodiments, a user can actuate at least one or more switches or buttons 60 by applying a force to the switch or button 60. In some further embodiments, a user can actuate at least one or more switch or buttons by touching or nudging at least some partial region of the user interface 50. For example, in some embodiments, the switches or buttons 60 can comprise electro-capacitive or electrostatic switches, buttons, or icons (shown in FIG. 28A and FIG. 28B for example).

In some further embodiments, the switches or buttons 60 can be actuated within the need for direct physical contact between the user and the user interface 50. For example, in some embodiments, the user interface 50 can include a conventional transceiver capable of receiving a signal from at least one conventional remote transceiver. In some embodiments, one or more of the transceivers can communicate using an infra-red. In other embodiments, one or more of the transceivers can communicate using a radio-frequency signal. In some embodiments, any of the switches or buttons 60 can be actuated by at least one remote device emitting at least one of an infra-red signal, a radio-frequency signal, a microwave signal and a light frequency signal.

In some further embodiments, the user interface 50 can include a passive or active receiver. For example, in some embodiments, any of the switches or buttons 60 can be actuated by a user based on an emission of at least one of an infra-red signal, a radio-frequency signal, a microwave signal and a light frequency signal emitted from the user interface 50. For example, in some embodiments, one or more signals emitted by the user interface 50 may be at least partially reflected back from the user and a conventional control system can interpret a control sequence based at least partially on the reflected signal. In some other embodiments, any of the switches or buttons 60 can be actuated by a user based on an emission of at least one of an infra-red signal, a radio-frequency signal, a microwave signal and a light frequency signal emitted from the user interface 50 and an impedance generated within a control system of the user interface based at least in part on absorption of at least some part of the emitted signal by the user.

Some embodiments can include alternative locations for the user interface 50 or alternative locations for controlling the user interface 50. For example, some embodiments can include one or more actuators place within a conventional toe-kick of a conventional cabinet so as to allow a user to actuate the toe-kick device using foot contact. For example, in some embodiments, the downdraft system 10 can include one or more actuators place within a conventional toe-kick of a cabinet for optional use if the user's hands are soiled, thereby potentially reducing the risk of a foodborne illness or other food contamination.

In some embodiments of the downdraft system 10, a user interface 50 can be coupled with at least one conventional control system (not shown) for controlling and monitoring various operations of the downdraft system 10. In some embodiments, the downdraft system 10 may also comprise at least one conventional sensor. In some embodiments, the one or more functions of the downdraft system 10 may be controlled based at least in part on the control system. In some further embodiments, the one or more functions of the downdraft system 10 may be controlled based at least in part on the control system and a signal from the at least one sensor. In some embodiments, conventional control logic of the control system may cause or prevent the operation of at least one function of the downdraft system 10. In some embodiments, conventional control logic of the control system may cause or prevent the operation of at least one function of the downdraft system 10 independent from a user action. For example, in some embodiments, conventional control logic of the control system may cause or prevent the operation of at least one function of the downdraft system 10 to prevent an unsafe operating condition, or to prevent unintended operation of at least one part of the downdraft system 10.

In some other embodiments, one or more of the functions of the downdraft system 10 can be actuated based at least in part on current and/or historical cooking conditions. In some embodiments, the downdraft system 10 can comprise at least one conventional sensor capable of monitoring at least one component of the downdraft system 10 and/or at least one physical variable of the cooking environment (i.e. the environment within the area of the cooktop 15 or within the cooking area 14). For example, in some embodiments, the ventilation system (for example module 13) can be actuated without the need for a user to actuate the fan switch 64 based at least in part on a conventional sensor, and/or at least in part on the activation status of at least one component of the downdraft system 10).

In some embodiments, the downdraft system 10 can include at least one particulate sensor. Some embodiments include a particulate sensor configured to detect a particulate cloud, such as smoke or other particulate material emitted from a material undergoing oxidative combustion. In other embodiments, a particulate sensor can be configured to detect a particulate cloud, such as smoke or other particulate material emitted from a material undergoing non-oxidative combustion and/or pyrolysis. In some embodiments, the particulate sensor can be a digital imaging sensor configured to detect a particulate cloud by imaging and image analysis within a control system of the downdraft system 10.

Some embodiments can include a chemical sensor. In some embodiments, the chemical sensor can be configured to detect at least one chemical and/or a particulate cloud, such as smoke or other particulate material emitted from a material undergoing oxidative combustion, non-oxidative combustion and/or pyrolysis. In some embodiments, the chemical sensor can include an infra-red sensor. In some embodiments, the infra-red sensor can be configured to detect at least one chemical and/or a particulate cloud, such as smoke or other particulate material emitted from a material undergoing oxidative combustion, non-oxidative combustion and/or pyrolysis.

In some embodiments, the particulate sensor can comprise at least one chemical sensor. For example, in some embodiments, the downdraft system 10 can include at least one chemical sensor capable of detecting at least one or more products of oxidative combustion, one or more products of non-oxidative combustion, or one or more products of pyrolytic decomposition. In some other embodiments, the particulate sensor can include a plurality of chemical sensors distributed within the downdraft system 10. In some embodiments, the plurality of chemical sensors can be configured to detect the same chemical species, whereas in other embodiments, each sensor of the plurality of chemical sensors can be configured to detect a different chemical species.

In some embodiments, the chemical sensor can detect at least one non-flammable gas. For example, in some embodiments, the chemical sensor can detect at least one of carbon monoxide, carbon dioxide, and mixtures thereof.

Some embodiments include at least one chemical sensor capable of detecting an oil or grease oxidative degradation product. Some embodiments include at least one chemical sensor capable of detecting an oil or grease non-oxidative degradation product. Some embodiments include at least one chemical sensor capable of detecting an oil or grease pyrolysis product. Some embodiments include at least one chemical sensor capable of detecting an oil or grease vapor or fluid.

Some embodiments include a downdraft system 10 with at least one chemical sensor capable of detecting a carbohydrate oxidative degradation product. Some embodiments include at least one chemical sensor capable of detecting a carbohydrate non-oxidative degradation product. Some embodiments include at least one chemical sensor capable of detecting a carbohydrate pyrolysis product.

In some other embodiments, the downdraft system 10 can include at least one chemical sensor capable of detecting a protein oxidative degradation product. Some embodiments include at least one chemical sensor capable of detecting a protein non-oxidative degradation product. Some embodiments include at least one chemical sensor capable of detecting a protein pyrolysis product.

In some other embodiments, the downdraft system 10 can include at least one chemical sensor capable of detecting the degradation of a cellulosic based material (for example, from a clothing or kitchen cloth or towel product). For example, in some other embodiments, the downdraft system 10 can include at least one chemical sensor capable of detecting a cellulose oxidative degradation product. Some embodiments include at least one chemical sensor capable of detecting a cellulose non-oxidative degradation product. Some other embodiments include at least one chemical sensor capable of detecting a cellulose pyrolysis product.

In some further embodiments, the downdraft system 10 can include at least one chemical sensor capable of detecting the degradation of a polymeric product (for example, a plastic utensil or kitchen container, or at least some portion of the housing of the downdraft system). For example, in some embodiments, the downdraft system 10 can include at least one chemical sensor capable of detecting a oxidative degradation product from at least one of a nylon, a polyurethane, a polyethylene, a polypropylene, a polycarbonate, a polyester, or copolymers or mixtures thereof. Some embodiments include at least one chemical sensor capable of detecting a detecting a non-oxidative degradation product from at least one of a nylon, a polyurethane, a polyethylene, a polypropylene, a polycarbonate, a polyester, or copolymers or mixtures thereof. In some other embodiments, the downdraft system 10 can include at least one chemical sensor capable of detecting a pyrolysis product from at least one of a nylon, a polyurethane, a polyethylene, a polypropylene, a polycarbonate, a polyester, or copolymers or mixtures thereof.

In some other embodiments, the chemical sensor can include a catalyst. For example, in some embodiments, the downdraft system 10 can include at least one sensor capable of detecting one or more products of oxidative combustion, non-oxidative combustion or pyrolytic decomposition as described above by catalytically converting at least one or more products and detecting the converted by-product.

As discussed earlier, in some embodiments, the downdraft system 10 can be further improved using multiple fluid inlets. Some embodiments can include dual inlets comprising an upper inlet 29*a* and a lower inlet 29*b*. For example, FIG. 37 shows chimney 100 including an upper horizontal member 21 coupled to an upper inlet 29*a* and a lower inlet 29*b*. The chimney 100 also includes a lower horizontal member 22 coupled to the lower inlet 29*b* and the cooktop 15. In some embodiments of the invention, at least one inlet 29*a*, 29*b*, 30 can be controlled based at least in part on a particulate and/or chemical sensor as described earlier. As described earlier, in some embodiments of the downdraft system 10, one or more functions of the downdraft system 10 may be controlled based at least in part on a conventional control system. In some embodiments, the one or more functions of the downdraft system 10 may be controlled based at least in part on the control system and a signal from the at least one particulate and/or chemical sensor. In some embodiments, conventional control logic of the control system may cause an operation of at least one function of the downdraft system 10. In some embodiments, conventional control logic of the control system may cause an operation of at least one function of the downdraft system 10 independent from a user action. For example, in some embodiments, conventional control logic of the control system may cause an operation of at least one function of the downdraft system 10 to prevent an unsafe operating condition, to prevent unintended operation of at least one part of the downdraft system 10, and/or to change the effluent concentration with the vicinity of the cooktop 15.

In some embodiments, the dimensions of either the upper horizontal member 21 or lower horizontal member 22 can be varied to comprise a smaller or greater total vertical dimension based at least in part on a particulate and/or chemical sensor as described earlier. Moreover, in some embodiments, the total vertical dimension of the either of the upper inlet 29*a* or the lower inlet 29*b* can be varied to be smaller or greater than that illustrated in FIG. 37 based at least in part on a particulate and/or chemical sensor. For example, in some embodiments, the upper horizontal member 21 and the lower horizontal member 22 can be varied to comprise a smaller or greater total vertical dimension than shown in FIG. 37 based at least in part on a particulate and/or chemical sensor. In some embodiments, the total vertical dimension of the upper inlet 29*a* and the lower inlet 29*b* can be varied to be smaller or greater than that illustrated in FIG. 37 based at least in part on a particulate and/or chemical sensor. In some other embodiments, the total vertical dimension of the upper horizontal member 21, the lower horizontal member 22, the upper inlet 29*a* and the lower inlet 29*b* can be varied to be smaller or greater can be varied to comprise a smaller or greater total vertical dimension than shown in FIG. 37 based at least in part on a particulate and/or chemical sensor.

In some embodiments, either one or both of the upper and lower horizontal members 21, 22 can be independently vertically moveable with respect to the chimney 100 based at least in part on a particulate and/or chemical sensor. For example, in some embodiments, the upper horizontal member 21 can be moved vertically upwards or vertically downwards based at least in part on a particulate and/or chemical sensor. Further, in some embodiments, the lower horizontal member 22 can be moved vertically upwards or vertically downwards based at least in part on a particulate and/or chemical sensor.

In some embodiments, the total vertical dimension of the upper inlet 29*a* can be modified by moving the upper horizontal member 21 upwards (i.e., away from the cooktop 15) or downwards (i.e., towards the cooktop 15) based at least in part on a particulate and/or chemical sensor. In some further embodiments, the total vertical dimension of the lower inlet 29*b* can be modified by moving either or both of the upper horizontal member 21 and lower horizontal member 22 upwards (i.e., away from the cooktop 15) or downwards (i.e., towards the cooktop 15) based at least in part on a particulate and/or chemical sensor. In some embodiments, when modifying the total vertical height of the upper inlet 29*a* through the movement of the upper horizontal member 21, the lower horizontal member 22 can be moved to maintain the total vertical height of the lower inlet 29*b* based at least in part on a particulate and/or chemical sensor. In other embodiments, the lower horizontal member 22 can remain stationary, and the total vertical height of the lower inlet 29*b* can be increased as the total vertical height of the upper inlet 29*a* decreases based at least in part on a particulate and/or chemical sensor.

In some further embodiments, the illumination systems 34, 35 may be actuated automatically based on the current ambient light. For example, in some embodiments, the downdraft system 10 can comprise at least one conventional sensor capable of monitoring the ambient light intensity of the cooking environment (i.e. the environment within the area of the cooktop 15 or within the cooking area 14). In some embodiments, the illumination systems 34, 35 may be actuated automatically based at least partially on the ambient light intensity as determined by a light sensor.

In some embodiments, the user interface can include a power switch 62. In some embodiments, the power switch 62 can be capable of controlling electrical power to at least one component of the downdraft system 10. In some embodiments, the power switch 62 can be capable of powering up or powering down the downdraft system 10.

In some embodiments of the invention, at least one inlet 29*a*, 29*b*, 30 can be controlled by the power switch 62. In some embodiments, movement assemblies 300, 400, 500, 600, 700, 800 can be configured and arranged to move the chimney 100, the upper horizontal member 21 or the lower horizontal member 22. For example, in some embodiments, the movement assemblies 300, 400, 500, 600, 700, 800 can be activated (e.g., automatically or manually) to move the chimney 100, the upper horizontal member 21 or the lower horizontal member 22 to at least partially change the size of the upper inlet 29*a* or the lower inlet 29*b*. As described earlier, in some embodiments of the downdraft system 10, one or more functions of the downdraft system 10 may be controlled based at least in part on a conventional control system. In some embodiments, the at least one inlet 29*a*, 29*b*, 30 can be controlled based at least in part by the control system. For example, in some embodiments, the at least one inlet 29*a*, 29*b*, 30 can be controlled based at least in part on an overload signal detected or received by the control system.

In some embodiments, the movement of either one of the inlets 29*a*, 29*b*, 30 may become at least partially impeded. For example, in some embodiments, either one of the inlets 29*a*, 29*b*, 30 may become at least partially blocked, impeding or preventing further movement of the chimney 100, the upper horizontal member 21 or the lower horizontal member 22. In some embodiments, one or more motors powering the chimney 100, the upper horizontal member 21 or the lower horizontal member 22 may experience a torque overload due at least in part by the chimney 100, the upper horizontal member 21 or the lower horizontal member 22 meeting an obstruction. For example, in some embodiments, if any one of the inlets 29*a*, 29*b*, 30 becomes at least partially obstructed, a motor 307, 407, 507, 607, 707 or other conventional actuator may experience a torque overload or torque spike. In some embodiments, the torque overload or torque spike may be detected or received by the control system, and the control system may prevent any further change in dimension of either one of the inlets 29*a*, 29*b*, 30 by preventing movement of chimney 100, the upper horizontal member 21 or the lower horizontal member 22. For example, in some embodiments, the torque overload or torque spike may be detected or received by the control system, and the control system may prevent any further change in dimension of either one of the inlets 29*a*, 29*b*, 30 by depowering the motor 307, 407, 507, 607, 707 or other conventional actuator to prevent movement of chimney 100, the upper horizontal member 21 or the lower horizontal member 22.

In some embodiments, the torque overload or torque spike may be detected or received by the control system when the chimney 100, the upper horizontal member 21 or the lower horizontal member 22 are moving upwards (i.e., away from the cooktop 15). In some other embodiments, the torque overload or torque spike may be detected or received by the control system when the chimney 100, the upper horizontal member 21 or the lower horizontal member 22 are moving downwards (i.e., towards the cooktop 15). In some embodiments, the control system may prevent any further change in dimension of either one of the inlets 29*a*, 29*b*, 30 by preventing movement of chimney 100, the upper horizontal member 21 or the lower horizontal member 22 when the chimney 100, the upper horizontal member 21 or the lower horizontal member 22 are moving upwards (i.e., away from the cooktop 15). In some other embodiments, the control system may prevent any further change in dimension of either one of the inlets 29*a*, 29*b*, 30 by preventing movement of chimney 100, the upper horizontal member 21 or the lower horizontal member 22 when the chimney 100, the upper horizontal member 21 or the lower horizontal member 22 are moving downwards (i.e., towards the cooktop 15).

In some embodiments, if a conventional control system prevents any further change in dimension of either one of the inlets 29*a*, 29*b*, 30 by depowering the motor 307, 407, 507, 607, 707 or other conventional actuator to prevent movement of chimney 100, the upper horizontal member 21 or the lower horizontal member 22, the movement of either one of the chimney 100, the upper horizontal member 21 or the lower horizontal member 22 may be restarted by the user. For example, in some embodiments, the movement of chimney 100, the upper horizontal member 21 or the lower horizontal member 22, may be restarted by the user actuating the power switch 62. In other embodiments, the movement of chimney 100, the upper horizontal member 21 or the lower horizontal member 22, may be restarted by the user actuating a conventional reset switch 63. In some embodiments, the reset switch 63 can comprise a conventional mechanical switch actuator. In some other embodiments, the reset switch 63 can comprise a capacitor touch type switch actuator. In some embodiments, a reset switch 63 can be integrated within either the first control panel 58 or the second control panel 55 or both. In some further embodiments, the reset switch may be positioned within another region of the downdraft system 10. In some embodiments, after a user actuates the reset switch 63, either the chimney 100 may be fully extended and/or the upper horizontal member 21 or the lower horizontal member 22 can be moved to maximize the vertical dimension of the upper inlet 29*a* or lower inlet 29*b*. In some embodiments, the reset switch 63 is actuated by a user actuating the reset switch 63 for two seconds. In some other embodiments, the reset switch 63 is actuated by a user actuating the reset switch 63 for less than two seconds, and in other embodiments, the reset switch 63 is actuated by a user actuating the reset switch 63 for more than two seconds.

In some embodiments, after a user actuates the reset switch 63, either the chimney 100 may be fully extended and/or the upper horizontal member 21 or the lower horizontal member 22 can be moved to maximize the vertical dimension of the upper inlet 29*a* or lower inlet 29*b* while the user touches or presses the reset switch 63. For example, in some embodiments, when the reset switch 63 is a mechanical type switch, either the chimney 100 may extend and/or the upper horizontal member 21 or the lower horizontal member 22 may move to increase the vertical dimension of the upper inlet 29*a* or lower inlet 29*b* while the user maintains pressure on the reset switch 63. In some other embodiments, when the reset switch 63 is a capacitive touch type switch, either the chimney 100 may extend and/or the upper horizontal member 21 or the lower horizontal member 22 may move to increase the vertical dimension of the upper inlet 29*a* or lower inlet 29*b* while the user maintains contact with the reset switch 63.

Some embodiments include other switches capable of controlled at least one component of the downdraft system 10. For example, in some embodiments, the user interface can include a fan switch 64. For example, as shown in FIGS. 28A-28C, the user interface 50 can comprise at least one switch 64 capable of controlling power to a conventional ventilation fan within a conventional ventilation assembly.

In some further embodiments of the invention, the user interface 50 can include switches or buttons 60 that include one or more icons associated with one or more switches or other user controls. For example, referring to the at least one switch 64, as shown in FIG. 28A, some embodiments comprises switches or buttons 60 that include at least one icon. As shown, the at least one switch 64 can be illuminated when the fan is operational (represented by the fan level indicator 68).

In some embodiments, the one or more icons associated with the one or more switches or other user controls 60 on the user interface 50 may be substantially similar or the same. In some other embodiments, the one or more icons associated with the one or more switches or other user controls 60 on the user interface 50 may be substantially different.

In some other embodiments, the user interface can include an illumination switch 66. In some embodiments, the switches or buttons 66 can comprise the ability to control an illumination source 34, 35.

Some embodiments provide a user interface 50 that is coupled with at least one monitoring system to provide information on at least one functional status of at least one component of the downdraft system 10. In some embodiments, the user interface 50 is coupled with at least one conventional sensor (not shown) to provide information on the operational status of at least one component of the downdraft system 10. In some further embodiments, the switches or buttons 60 can comprise the ability to both control at least one component of the downdraft system 10 while also providing feedback (for example in the form of a indicating light, illuminated icon or display) to the user regarding the function of the component associated with the switches or buttons 60. For example, as shown in FIGS. 28A-28C, in some embodiments, the user interface 50 can include a fan level indicator 68. As shown, in some embodiments, the fan level indicator 68 can comprise a plurality of display bars capable of illumination. In some embodiments, the fan level indicator 68 can comprise display bars illuminated based on a fan speed (for example, a conventional fan, or module 13).

In some embodiments, the user interface 50 can include an illumination level indicator 70. For example, as shown in FIG. 28A, the user interface 50 can include an illumination level indicator 70. As shown, in some embodiments, the illumination level indicator 70 can comprise a plurality of display bars capable of illumination. In some embodiments, the illumination level indicator 70 can comprises display bars illuminated based on illumination intensity.

In some embodiments, the user interface can include a timer indicator 72. For example, as shown in FIG. 28A, the user interface 50 can include a timer indicator 72. In some embodiments, the time indicator 72 can represent an operation time enabled for at least one component (for example a time to operate the ventilation system).

In some other embodiments, the user interface can include an auto function indicator 74. In some embodiments, auto function indicator 74 can illuminate to indicate at least one function of the downdraft system 10 is under control of a conventional control system.

In some embodiments where the ventilation system comprises a conventional filter, the user interface 50 can comprise one or more indicators 76 that can provide an indication of whether the filter needs to be cleaned and/or replaced. In some embodiments, the filter change indicator 76 may indicate to the user the need to change one or more conventional filters in the downdraft system 10. In some embodiments, one or more of the buttons or switches 60 may emit light with a substantially identical or similar luminosity. In some other embodiments, the light luminosity may be intermittent (i.e. the buttons or switches 60 may cycle from an on to an off state to present a 'blinking' effect to a user). For example, in some embodiments, when a total fan operation time reaches a predetermined time (for example 30 hours), the filter change indicator 76 can illuminate, or in some other embodiments, it will cycle on and off (for example with a cycle period of every two seconds). In some embodiments, the filter change indicator 76 will cycle on and off regardless of the operating status of the ventilation assembly. In some embodiments, the filter change indicator 76 can be reset within the control system (not shown). In some embodiments, the downdraft system 10 includes a conventional filter/grease rail that collects excess grease from filter that can easily be accessed and cleaned.

In some embodiments of the invention, the downdraft system 10 can include a user interface 50 that comprises a dark colored surface to provide an improved contrast display. In some embodiments, the user interface 50 can comprise a transparent or semi-transparent overlay. In some embodiments, the overlay may be colored preferably to provide improved visual characteristics, including, but not limited to brightness, and contrast in well-lit or darkened rooms, aesthetic appearance, etc. In some embodiments, at least one portion of the user interface 50 may emit a blue or blue-green light. In other embodiments, at least one portion of the user interface 50 can emit a yellow, orange or substantially red light. It will be recognized that this particular embodiment need not be limited to the use of the colors described, and in fact any combination of user interface color can be used to provide the improved user interface 50. It will also be recognized that the color emitted from the user interface 50 can be changed by altering the light emission characteristics of at least one light emitting component of the user interface 50, or the light transmission characteristics of the overlay of the user interface 50, or both.

Figure 29A:
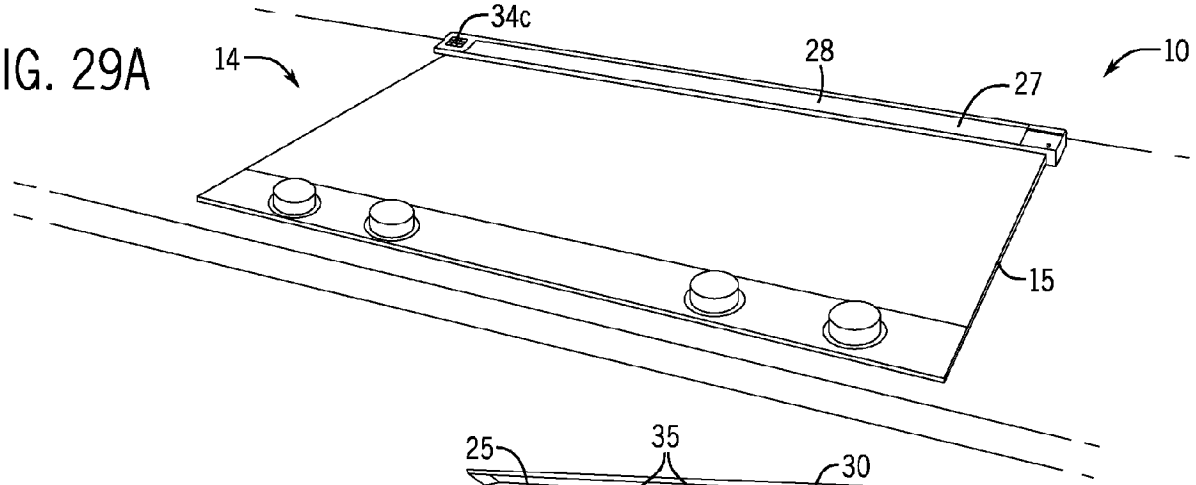
FIGS. 29A-E illustrates various views of a downdraft system according to some embodiments of the invention.
Figure 29B:
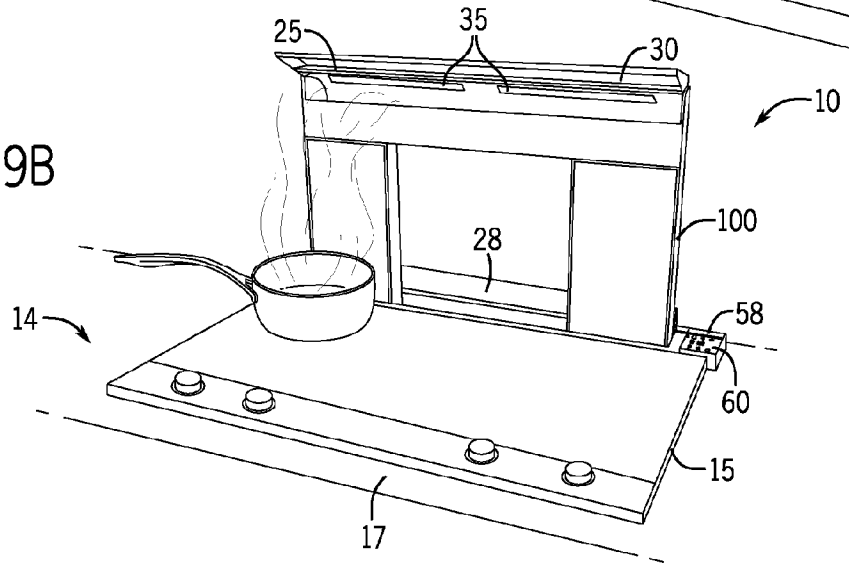
Figure 29C:
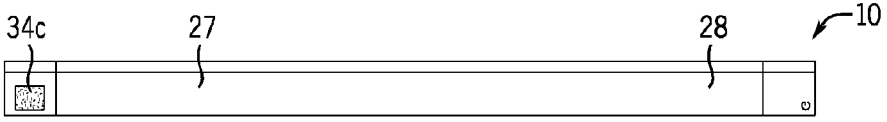
Figure 29D:
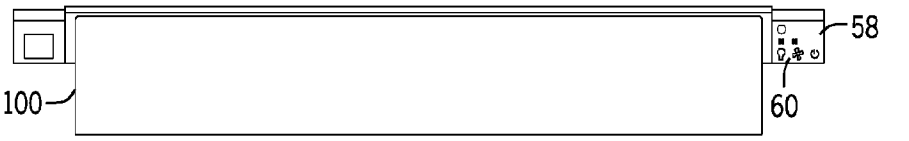
Figure 29E:
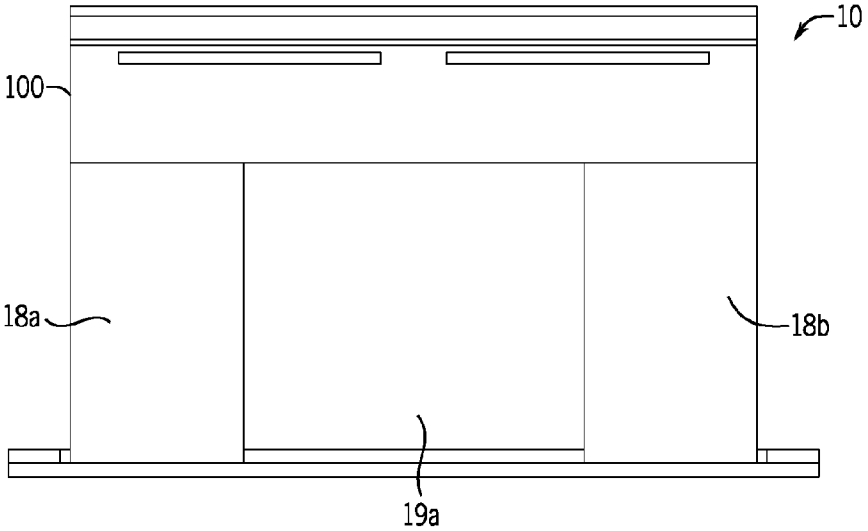
Figure 30A:
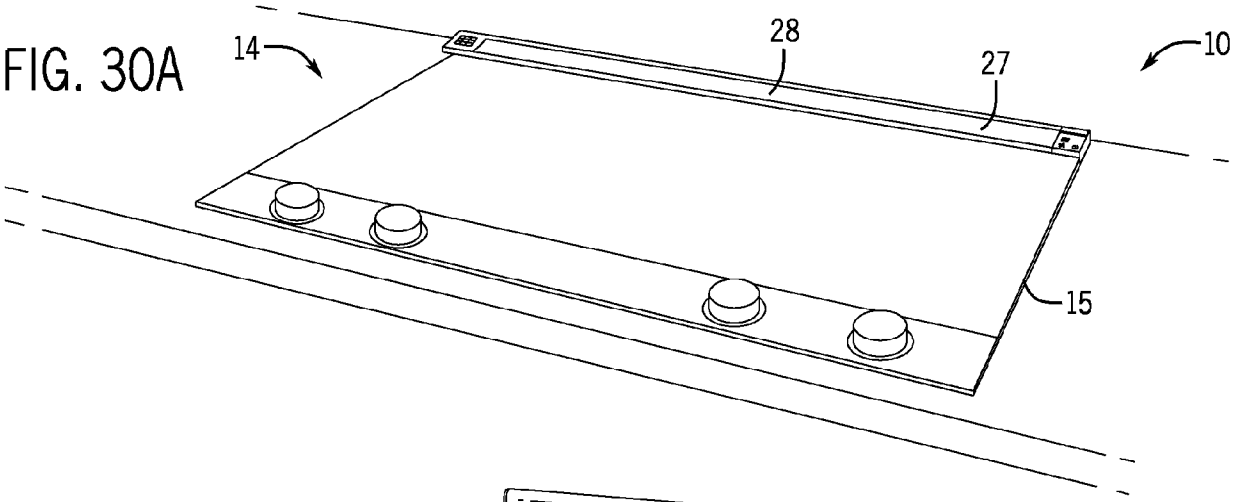
FIGS. 30A-E illustrates various views of a downdraft system according to some embodiments of the invention.
Figure 30B:
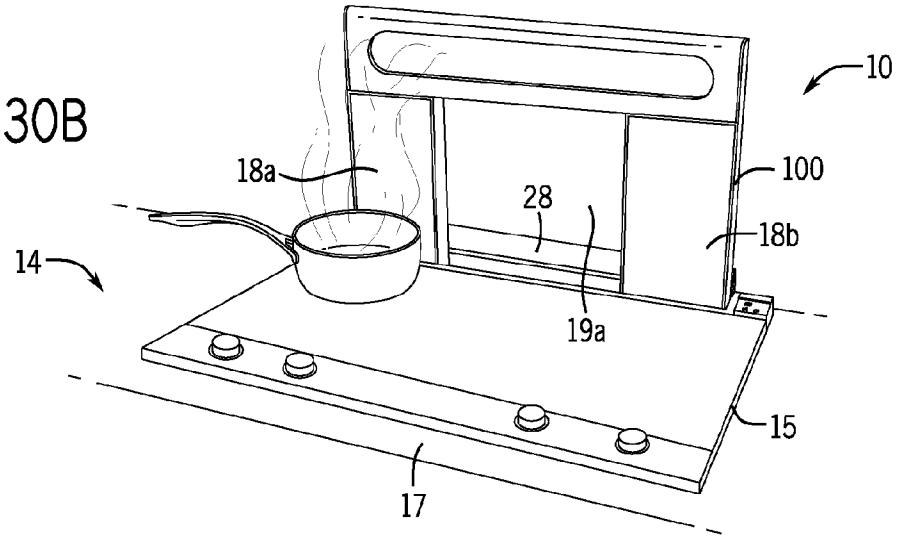
Figure 30C:
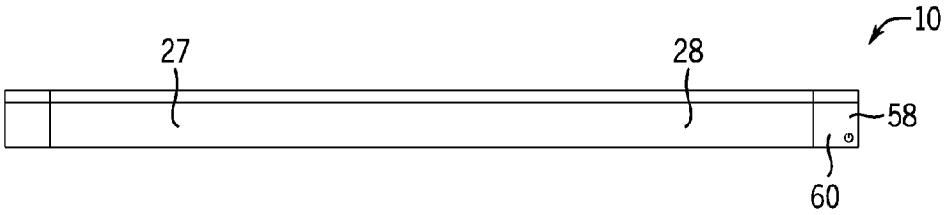
Figure 30D:
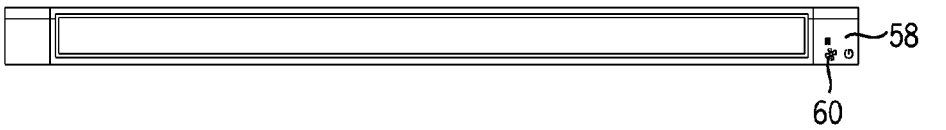
Figure 30E:
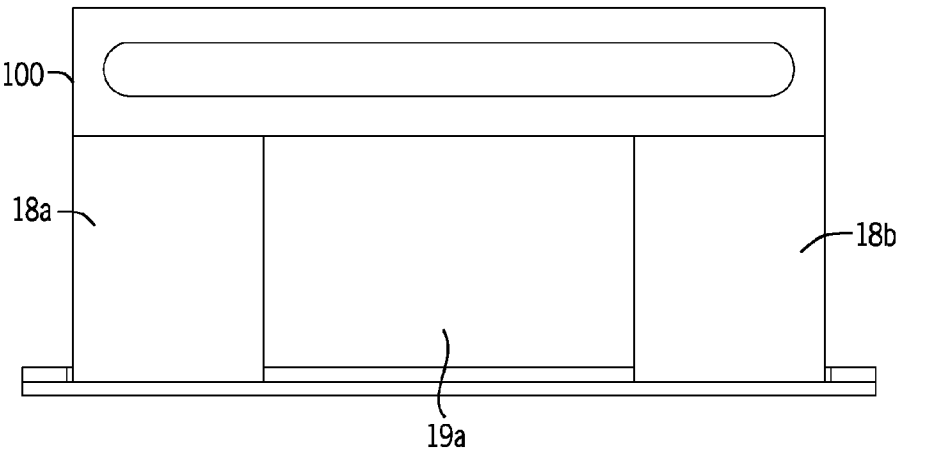
Figure 31A:
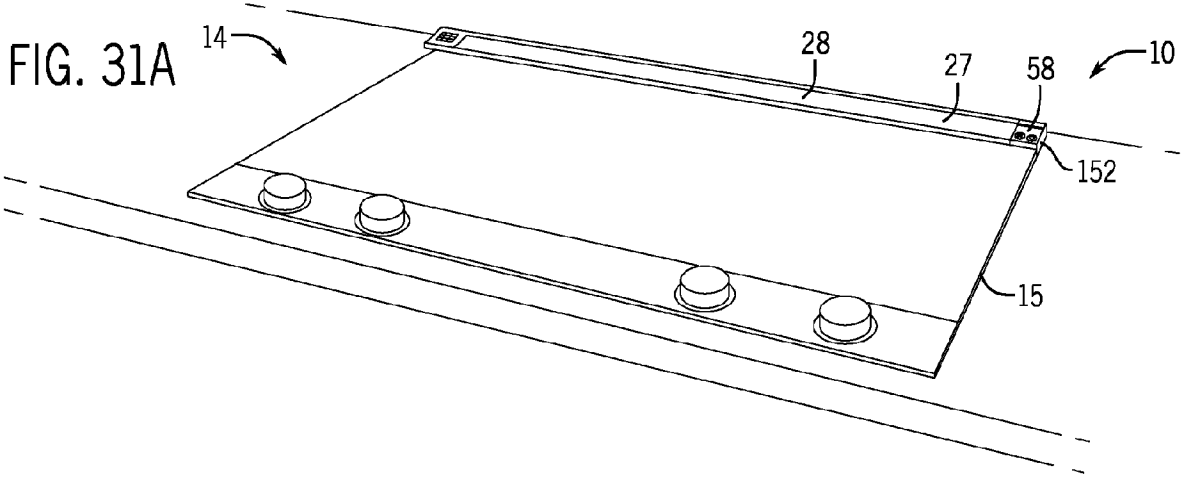
FIGS. 31A-E illustrates various views of a downdraft system according to some embodiments of the invention.
Figure 31B:
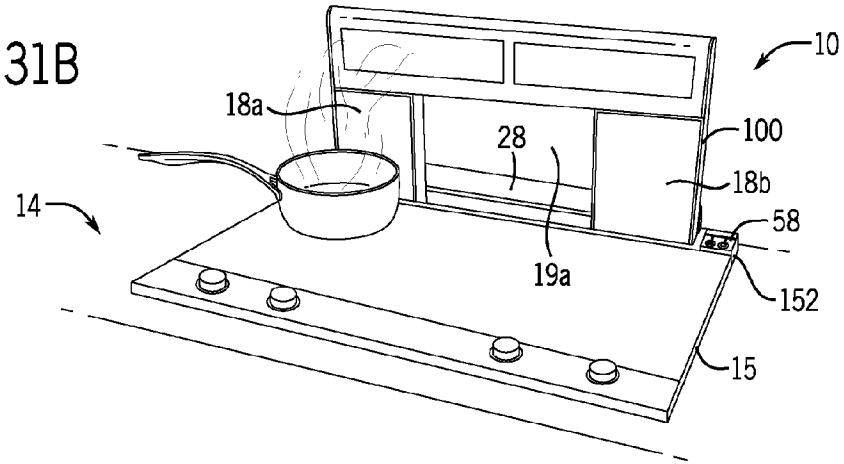
Figure 31C:
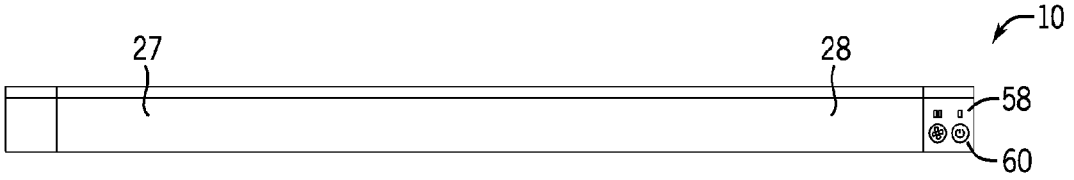
Figure 31D:
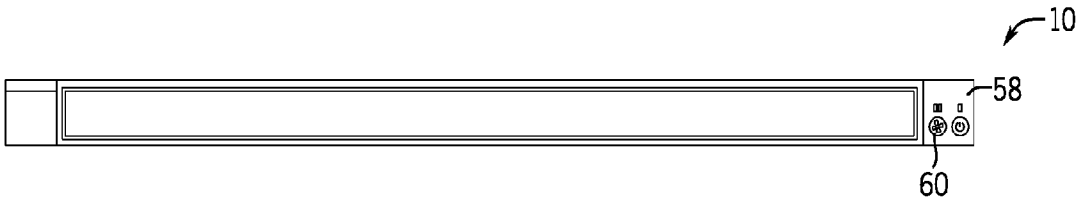
Figure 31E:
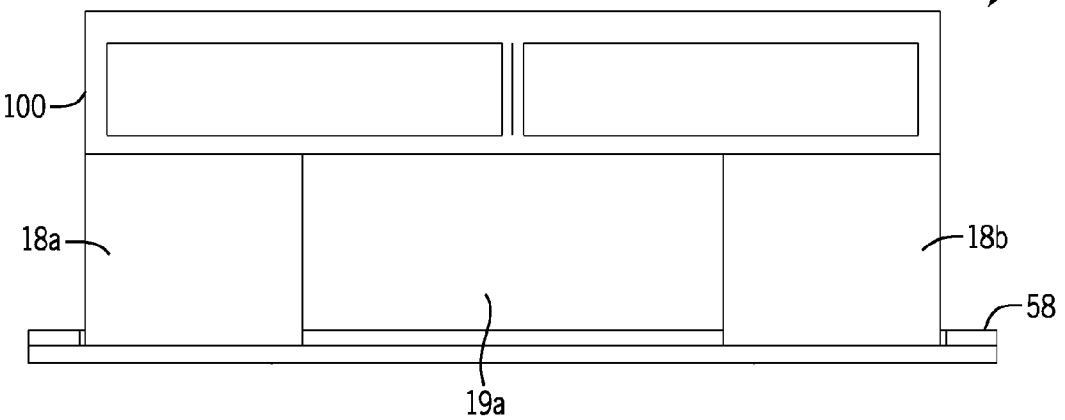

FIGS. 29A-E, 30A-E, and 31A-E illustrate various views of a downdraft system 10 according to some embodiments of the invention. For example, FIG. 29A shows a perspective view of a downdraft system 10 in a closed position (showing the bezel 27 and trap door 28 in a closed position), and FIG. 29C shows a top down view of the downdraft system 10 in the closed position. FIG. 29D shows a top down view of the downdraft system 10 in an open and operational position and FIGS. 29B and 29E shows views of a downdraft system 10 in a fully open and operational position. Further, FIG. 30A shows a perspective view of a downdraft system 10 in a closed position (showing the bezel 27 and trap door 28 in a closed position), and FIG. 30C shows a top down view of the downdraft system 10 in the closed position. FIG. 30D shows a top down view of the downdraft system 10 in an open and operational position and FIGS. 30B and 30E shows views of a downdraft system 10 in a fully open and operational position. FIG. 31A shows a perspective view of a downdraft system 10 in a closed position (showing the bezel 27 and trap door 28 in a closed position), and FIG. 31C shows a top down view of the downdraft system 10 in the closed position. FIG. 31D shows a top down view of the downdraft system 10 in an open and operational position and FIGS. 31B and 31E shows views of a downdraft system 10 in a fully open and operational position.

Figure 32A:
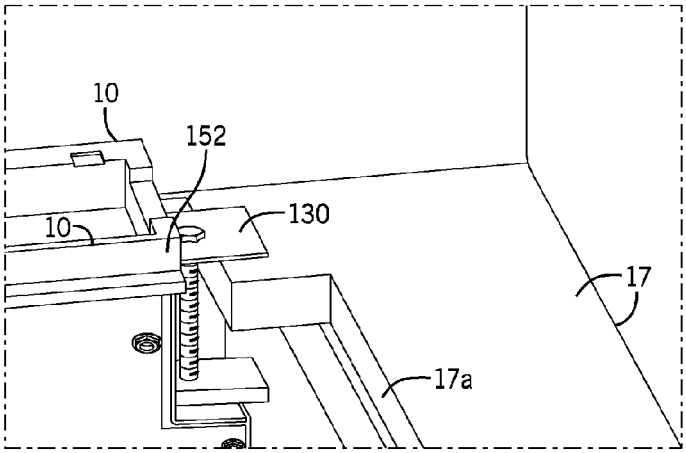
FIGS. 32A-B illustrates various views of installation of a downdraft system according to some embodiments of the invention.
Figure 32B:
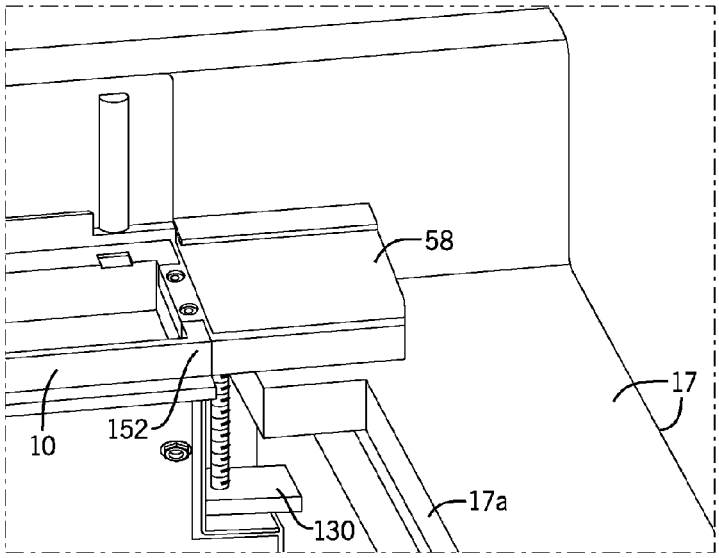

Some embodiments can include various methods of installation of the downdraft system 10. For example, FIGS. 32A-B illustrates various views of installation of a downdraft system 10 according to some embodiments of the invention. In some embodiments, methods of installation of the downdraft system 10 include a mounting bracket 130 that is used with installation from the top of the counter surface 17 (which is different from the installation of conventional downdraft systems 11 which generally includes an installation from the bottom of the counter surface 17). Moreover, in some embodiments, the downdraft system 10 can be substantially modular, allowing installation of individual sub-modules of the downdraft system 10 and facilitating the installation process.

As illustrated in FIGS. 32A-B, the method can include forming an opening 17*a* in the counter surface 17 to enable installation of the cooktop 15 and the downdraft system 10. In some embodiments, the installation procedure includes lowering the downdraft system 10 through the opening 17*a* without the ambient light 34*c*, the first control panel 58 or the bezel 27 and trap door 28 (also shown separately in the exploded assembly view of FIG. 34). In some embodiments, after the downdraft system 10 has been lowered into the opening 17*a*, a mounting bracket 130 can be used to secure the downdraft system 10 to the counter surface 17. In some embodiments, the first control panel 58 and the bezel 27 and trap door 28 can then be mounted to the downdraft system 10.

Figure 33:
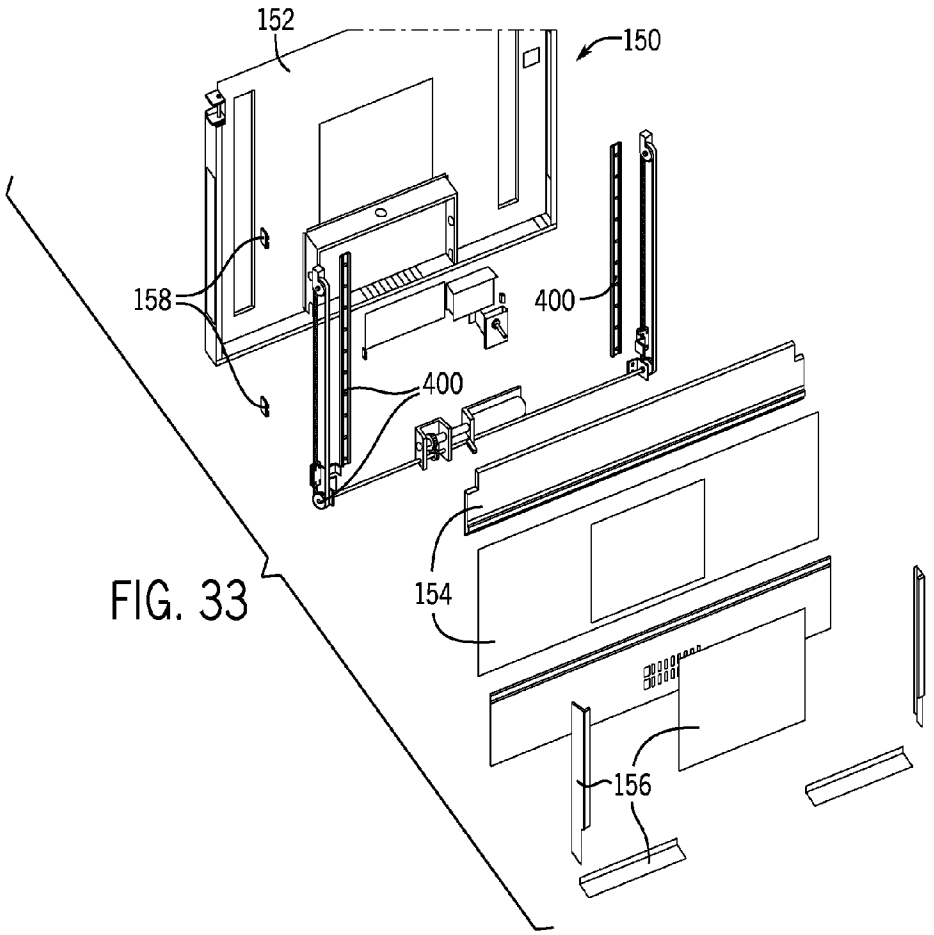
FIG. 33 illustrates an assembly view of an fluid box of a downdraft system according to some embodiments of the invention.
Figure 34:
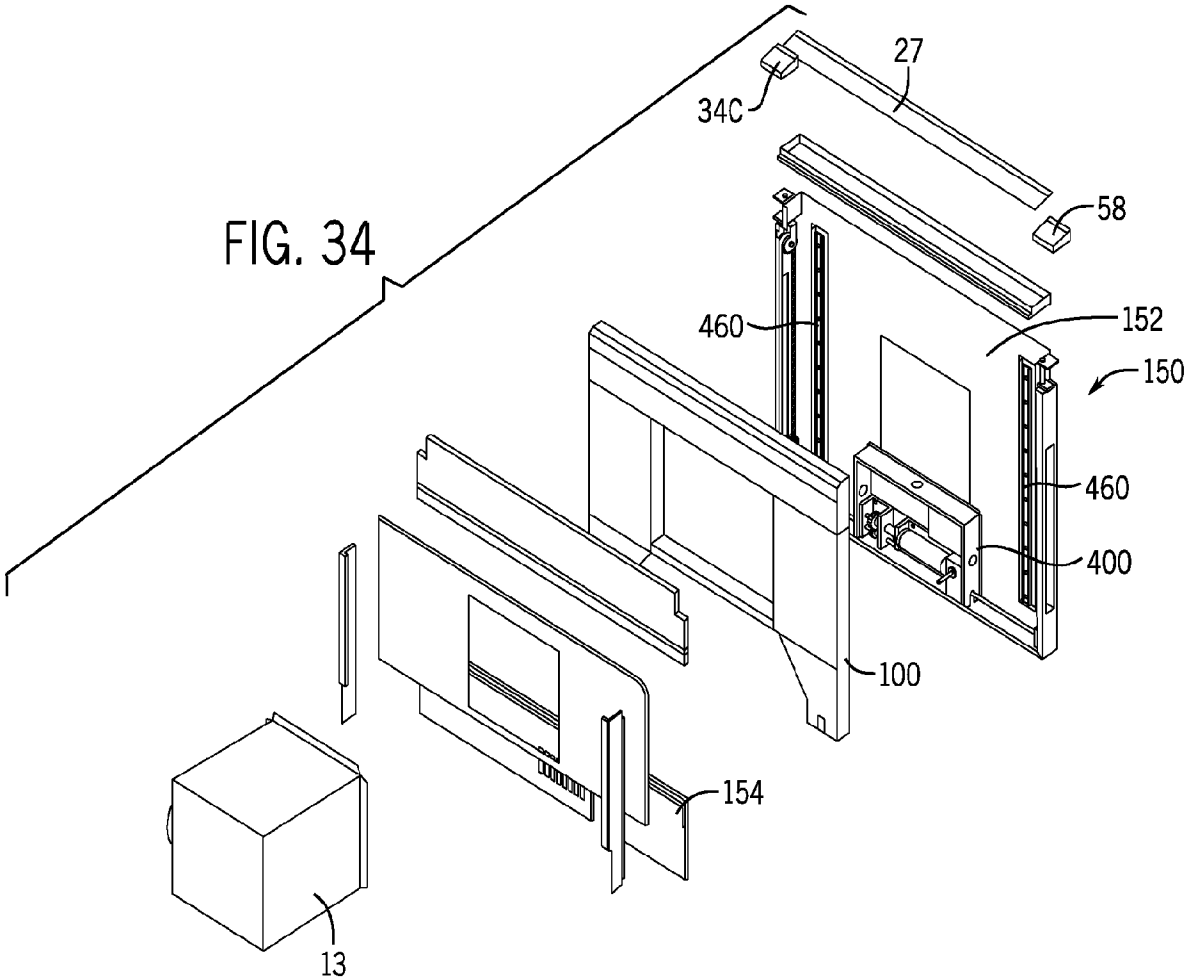
FIG. 34 illustrates an assembly view of a downdraft system according to some embodiments of the invention.
Figure 35B:
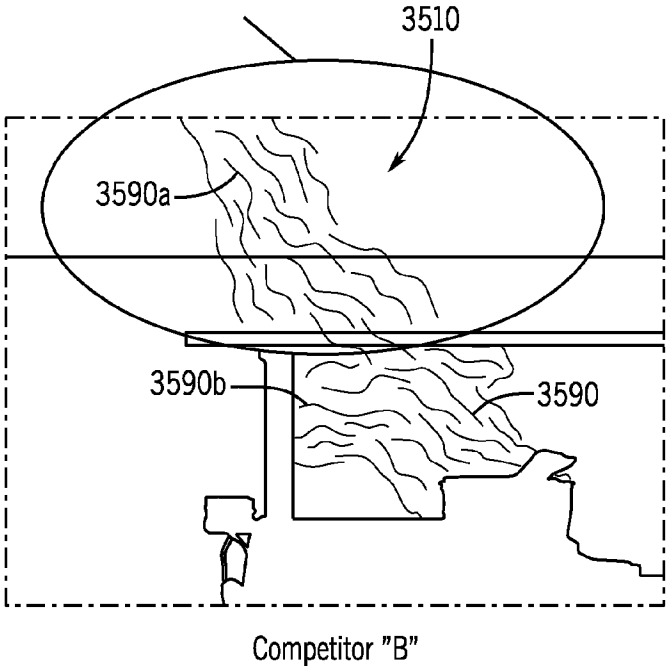
FIGS. 35A-E illustrate side shadowgraphs of various prior-art downdraft systems.
Figure 35A:
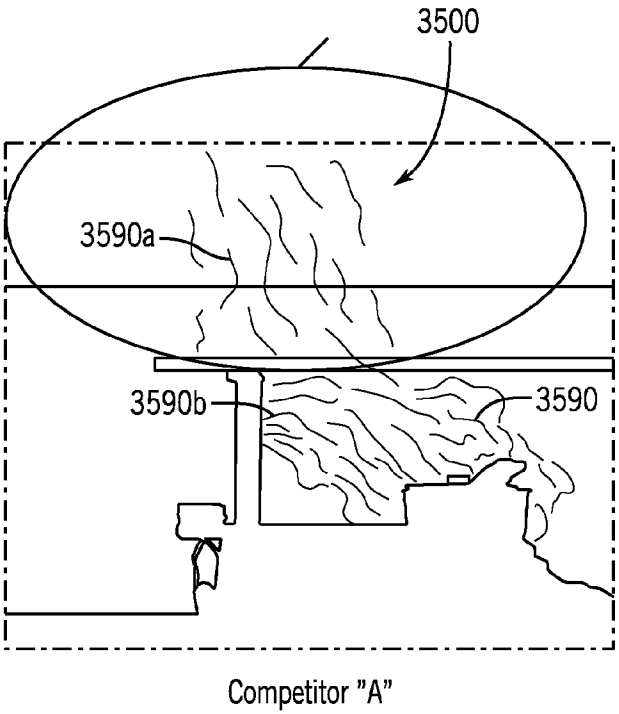
Figure 35D:
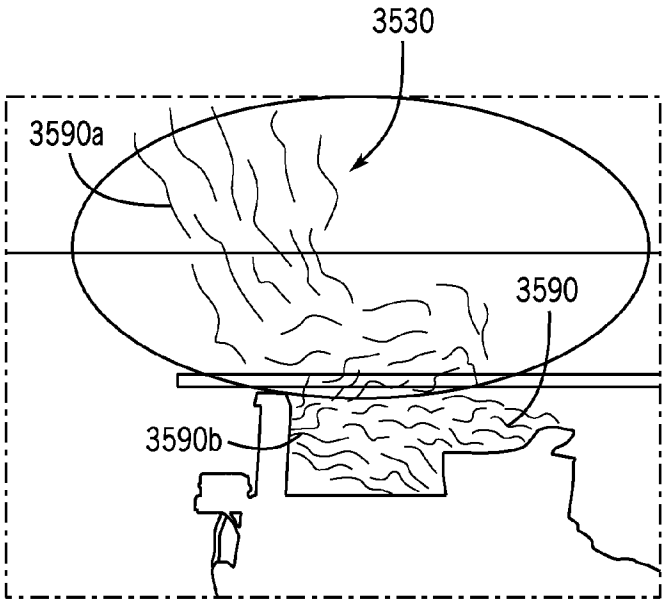
Figure 35C:
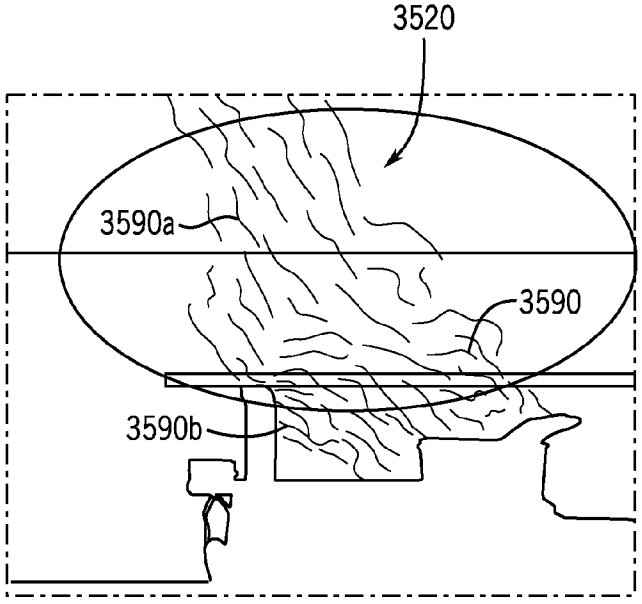
Figure 35E:
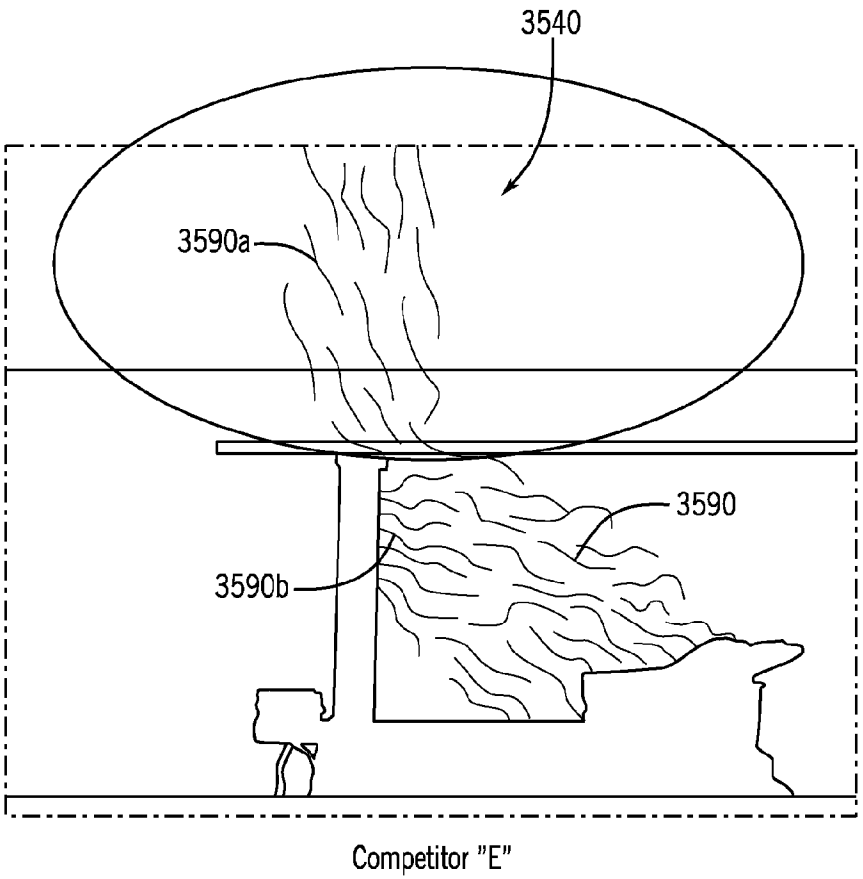

In some embodiments, following the installation procedures of the downdraft system 10 described earlier, the fluid box 150 may be installed and coupled with the downdraft system 10. As shown in FIG. 33, illustrating an assembly view of a fluid box 150 of a downdraft system 10, in some embodiments, the fluid box 150 can include a fluid box housing 152, front covers 154, outlet covers 156, and an electrical coupling 158. Further, some embodiments include at least one removeable panel (for instance, such as knock-out panel 159) to enable access and installation of conventional control boards and motors, and other conventional components. FIG. 34 illustrates an assembly view of a downdraft system 10 according to some embodiments of the invention. In some embodiments, the fluid box 150 including a movement assembly (or example, movement assembly 400 shown in FIG. 34) can be coupled to the downdraft system 10 substantially below the counter surface 17. In some embodiments, the guides 460 coupled to the frame 403 can be coupled with conventional rails within the fluid box 150. In some embodiments, the chimney 100 can be mounted to conventional carriages through access holes. In some embodiments, front covers 154 can be mounted after the chimney 100 is installed. In some embodiments, a blower assembly (for example, cub-like module 13) can be coupled to the downdraft system 10.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the invention.

The invention claimed is:

1. A downdraft assembly capable of ventilating a cooktop comprising:

a housing including a frame and a fluid box;

a movement assembly coupled to the housing;

a vertically moveable chimney coupled to the fluid box and the movement assembly, the chimney comprising:

a chimney housing, an upper horizontal member cooperating with the chimney housing to define an upper inlet, and a lower horizontal member cooperating with the chimney housing and the upper horizontal member to define a lower inlet, and a first control panel including a user interface, the first control panel coupled to the housing and configured and arranged to activate at least one function of the downdraft assembly and to remain substantially stationary when the chimney is moved by the movement assembly; and wherein the upper horizontal member is movable to adjust the vertical height and vertical center of the lower inlet.

2. The downdraft assembly of claim 1, wherein the chimney housing is movable to adjust the vertical height of the upper inlet.

3. The downdraft assembly of claim 1, wherein the upper horizontal member is independently movable such that the vertical height of the lower inlet and the vertical height of the upper inlet are adjustable.

4. The downdraft assembly of claim 1, wherein the upper inlet and the lower inlet are configured and arranged to extract substantially all effluent from the cooktop.

5. The downdraft assembly of claim 1, further including at least one illumination source configured and arranged to at least partially illuminate the cooktop.

6. The downdraft assembly of claim 5, further including a visor, the visor including at least one illumination source capable of at least partially illuminating the cooktop.

7. The downdraft assembly of claim 6, wherein the visor includes an articulating top capable of articulation about a pivot point on the chimney.

8. The downdraft assembly of claim 7, wherein an articulation of the articulating top of the visor about the pivot point can at least partially alter the illumination of the cooktop.

9. The downdraft assembly of claim 7, wherein an articulation of the articulating top of the visor about the pivot point can at least partially control the flow of a cooking effluent into the upper inlet.

10. The downdraft assembly of claim 1, further comprising a second control panel coupled to the chimney.

11. The downdraft assembly of claim 10, wherein the second control panel is coupled to at least one of the substantially horizontal member and the first vertical region and the second vertical region, the second control panel vertically moveable with respect to the cooktop.

12. The downdraft assembly of claim 1, wherein the movement assembly comprises a belt-lift configuration, the belt-lift configuration comprising:

at least one linear guide coupled to the frame;

a motor including a gear box coupled to a drive shaft;

at least one drive pulley coupled to the drive shaft; and a drive belt coupled to the drive pulley and at least one idler pulley, the at least one drive pulley and the at least one idler pulley coupled to a lateral side of the housing, and configured and arranged to at least partially move the chimney within the fluid box at least partially guided on the at least one linear guide.

13. The downdraft assembly of claim 1, further comprising a pivotable bezel, the pivotable bezel configured and arranged to pivot open to allow movement of the chimney out of the fluid box and to pivot shut when substantially all of the chimney is within the fluid box.

14. The downdraft assembly of claim 13, further comprising at least one ambient light illumination source.

15. The downdraft assembly of claim 14, wherein the ambient light illumination source is a night light coupled to the bezel.

16. The downdraft assembly of claim 1, wherein the fluid box comprises inner walls, the inner walls including at least one curved wall including a substantially non-linear transition configured and arranged to at least partially guide fluid into the fluid box from at least one of the dual inlets.

17. The downdraft assembly of claim 16, wherein the at least one curved wall is configured and arranged to at least partially guide fluid into the fluid box from substantially the width of the chimney.

18. The downdraft assembly of claim 1, wherein the upper inlet comprises a chimney intake opening of a size of about one to about two inches in vertical length.

19. The downdraft assembly of claim 1, wherein the lower inlet comprises a chimney intake opening of a size of about one to about two inches in vertical length.

20. The downdraft assembly of claim 3, wherein the vertical height of the lower inlet and the vertical height of the upper inlet are independently adjustable based at least in part on effluent emitted from the cooktop.

21. The downdraft assembly of claim 3, wherein the vertical height of the lower inlet and the vertical height of the upper inlet are independently adjustable based at least in part on effluent drawn into either of the lower inlet or the upper inlet.

* * * * *